US007792470B2

(12) United States Patent
Eto et al.

(10) Patent No.: US 7,792,470 B2
(45) Date of Patent: Sep. 7, 2010

(54) TONER CONTAINER AND DEVELOPER REPLENISHING DEVICE

(75) Inventors: Daisuke Eto, Osaka (JP); Toshinori Nishimura, Osaka (JP); Yoshiaki Ikebata, Osaka (JP)

(73) Assignee: Kyocera Mita Corporation (JP)

( * ) Notice: Subject to any disclaimer, the term of this patent is extended or adjusted under 35 U.S.C. 154(b) by 104 days.

(21) Appl. No.: 12/008,824

(22) Filed: Jan. 14, 2008

(65) Prior Publication Data

US 2008/0170889 A1 Jul. 17, 2008

(30) Foreign Application Priority Data

Jan. 15, 2007 (JP) ..... 2007-006340
Jan. 15, 2007 (JP) ..... 2007-006344

(51) Int. Cl.
*G03G 15/08* (2006.01)

(52) U.S. Cl. ..... 399/263; 399/260; 399/262; 399/258

(58) Field of Classification Search ..... 399/27, 399/106, 120, 236, 256, 258, 259, 263, 260, 399/262, 119
See application file for complete search history.

(56) References Cited

U.S. PATENT DOCUMENTS 4,313,674 A * 2/1982 Ura et al. ..... 399/360
4,825,244 A 4/1989 Hediger
5,381,217 A * 1/1995 Ishida ..... 399/120
6,044,235 A * 3/2000 Hashimoto ..... 399/99
6,266,511 B1 * 7/2001 Murakami et al. ..... 399/358
6,751,431 B2 * 6/2004 Ichikawa et al. ..... 399/262
6,766,135 B2 * 7/2004 Wang et al. ..... 399/262
6,839,533 B2 * 1/2005 Ban et al. ..... 399/260
6,882,821 B2 * 4/2005 Jeong et al. ..... 399/358
6,892,036 B2 * 5/2005 Ito ..... 399/27
6,934,490 B2 * 8/2005 Koyama et al. ..... 399/120
6,993,273 B2 * 1/2006 Yamada ..... 399/258
7,106,995 B2 * 9/2006 Nagai et al. ..... 399/258
7,366,451 B2 * 4/2008 Yokoyama ..... 399/256
7,386,250 B2 * 6/2008 Ban et al. ..... 399/106
7,412,192 B2 * 8/2008 Nakajima et al. ..... 399/262
7,486,910 B2 * 2/2009 Kitozaki ..... 399/111
2007/0077101 A1 * 4/2007 Tamura et al. ..... 399/262

FOREIGN PATENT DOCUMENTS

JP 07191591 A * 7/1995
JP 2003-280344 10/2003
JP 2005077783 3/2005

* cited by examiner

*Primary Examiner*—David M Gray
*Assistant Examiner*—Francis Gray
(74) *Attorney, Agent, or Firm*—Gerald E. Hespos; Michael J. Porco

(57) ABSTRACT

A toner container contains toner and includes: a container having a toner discharge hole; a toner conveyance screw for conveying the toner within the container toward the toner discharge hole; and a shutter cylinder including a peripheral wall formed with a toner discharge opening at a position corresponding to the toner discharge opening. The toner conveyance screw is rotatably supported at one end thereof by a bearing within the shutter cylinder. The shutter cylinder is mounted to a side wall of the container in a rotation free manner.

16 Claims, 26 Drawing Sheets

TONER CONTAINER AND DEVELOPER REPLENISHING DEVICE

BACKGROUND OF THE INVENTION

1. Field of the Invention

The present invention relates to a toner container and a developer replenishing device to be detachably installed in an image forming apparatus in order to replenish a developing device built-in the image forming apparatus such as a copying machine, a printer, a facsimile machine, and the like with toner.

2. Description of the Related Art

A toner container disclosed in Japanese Unexamined Patent Publication (Kokai) No. 2003-280344 is known as prior art. This toner container is detachably installed in a developing device in order to replenish the developing device built-in an apparatus main body of an image forming apparatus with toner. More specifically, the toner container replenishes the developing device with toner when an amount of toner within the developing device becomes less than the preliminary set amount.

Such a toner container includes a box-like container to be charged with toner, a toner conveyance screw provided at a bottom of this container in order to replenish the container with toner to further replenish the developing device, an agitating member for agitating toner within the container, and a cylindrical shutter member rotationally provided at an appropriate location of the toner container along an outer peripheral surface of the toner conveyance screw. The shutter member is rotatable around the cylinder axis between a closed position where the shutter is closed and an open position where the shutter is open. The agitating member includes an agitating shaft provided in parallel with the toner conveyance screw and an agitating blade integrally rotatably mounted to the agitating shaft.

When the toner container is slidably installed to the developing device, the rotational shutter member rotates from the closed position to the open position due to an interference with some member of the developing device to allow a passage between an inside of the toner container and an inside of the developing device. Accordingly, the developing device is replenished with toner from the container by a driving force of the toner conveyance screw through a refill opening of the container.

To the contrary, when the toner is removed from the developing device in order to exchange an old one for an new one, the rotational shutter member rotates in a backward direction (namely, from the open position to the closed position) to close the shutter member by release of the rotational shutter member from the interference (i.e., an interference opposite to the former interference is applied), thereby preventing the residual toner within the container from leaking to the outside.

On the other hand, the toner container disclosed in the Japanese Unexamined Patent Publication No. 2003-280344 includes the toner conveyance screw disposed only adjacent to a center of the container in a longitudinal direction. Therefore, it is not possible for toner residing outside both ends of the toner conveyance screw to head to a replenishing opening and thus it is hard to push the toner away so as not for the toner to stay within the container.

In order to place the toner conveyance screw almost the center of the container in the longitudinal direction, there is such an inconvenience that the toner conveyance screw needs to be rotatably supported on the container and thus it is hard to keep a stable supporting state of the toner conveyance screw. Further, in order to assemble the toner conveyance screw in the container, since the toner conveyance screw should be rotatably supported by a predetermined bearing member after the toner conveyance screw is once placed in the container, there is such a problem that an assembling operation becomes hard.

SUMMARY OF THE INVENTION

An object of the invention is to provide a toner container or a developer replenishing device which can accomplish a stable bearing of a toner conveyance screw and improve the assembling operation of the toner conveyance screw into a container.

A toner container according to an aspect of the present invention which achieves the above object is adapted for containing toner, and includes: a container having a toner discharge hole; a toner conveyance screw for conveying the toner within the container to the toner discharge hole; and a shutter cylinder including a peripheral wall which is formed with a toner discharge opening at a position corresponding to the toner discharge hole. One end of the toner conveyance screw is supported by a bearing in the shutter cylinder. The shutter cylinder is mounted to a side wall of the container in a rotation free manner.

A developer replenishing device according to another aspect of the invention is adapted for replenishing a developing device with developer, which contains the developer and includes: a container having a developer discharge hole; a developer conveying member having a rotational shaft for conveying the developer within the container to the developer discharge hole; and a shutter cylinder including a peripheral wall formed with a developer discharge opening at a position corresponding to the developer discharge hole. One end of the rotational shaft of the developer conveyance member is supported by a bearing in the shutter cylinder. The shutter cylinder is mounted to a side wall of the container in a rotation free manner.

BRIEF DESCRIPTION OF THE DRAWINGS

FIGS. 1A and 1B are external perspective views illustrating a printer to which a toner container embodying the present invention is provided, in which FIG. 1A is a perspective view when the printer is viewed from its right rear direction and FIG. 1B is a perspective view when the printer is viewed from its left rear direction.

FIGS. 2A and 2B are perspective views each illustrating the printer with a paper output tray removed from an apparatus main body, in which FIG. 2A is a perspective view when the printer is viewed from its right rear direction and FIG. 2B is a perspective view when the printer is viewed from its left rear direction.

FIG. 18A illustrates the shutter cylinder in the closed position; FIG. 18B illustrates the shutter cylinder about to change its position from the closed position to the open position; and FIG. 18C illustrates the shutter cylinder with its position changed to the open position.

FIG. 26A illustrates a state that the shutter cylinder is set to a first closed position; FIG. 26B illustrates a state that the shutter cylinder is set to a second closed position; and FIG. 26C illustrates a state that the shutter cylinder is set to an open position, respectively.

DETAILED DESCRIPTION OF THE PREFERRED EMBODIMENTS

Embodiments of the present invention will be described below in detail with reference to the accompanying drawings.

First Embodiment

An image forming apparatus to which a toner container 20 according to a first embodiment of the present embodiment is provided will be briefly described with reference to FIGS. 1, 2, and 3, exemplifying a printer 10.

Figure 1A:
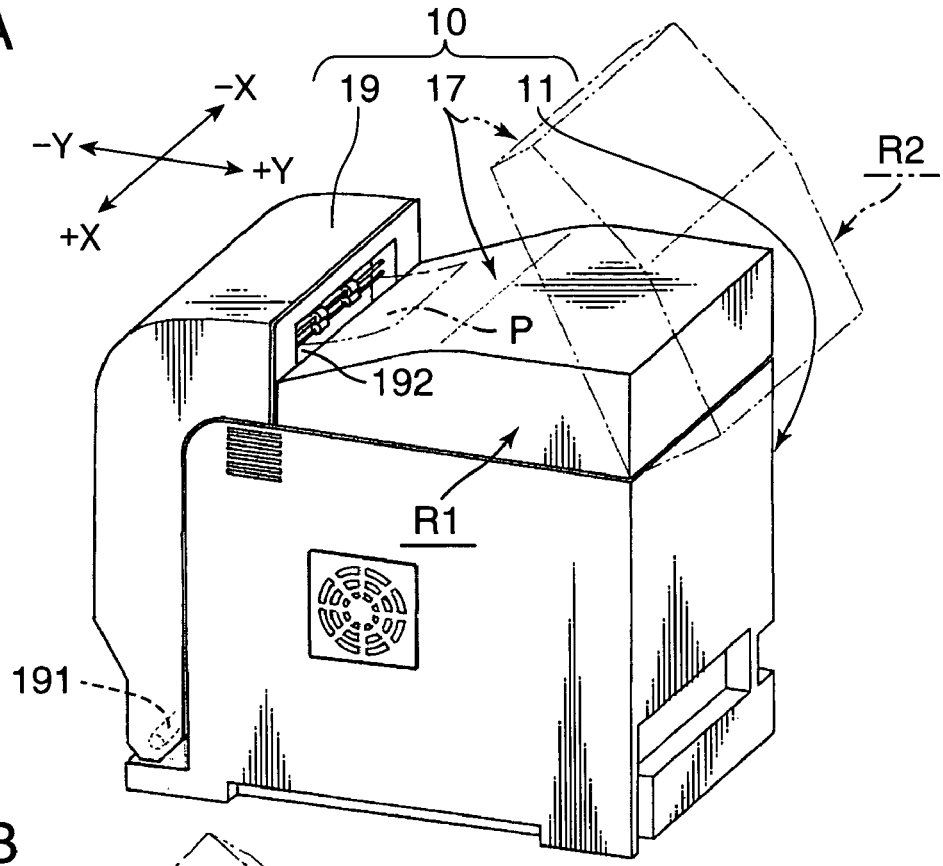
Figure 1B:
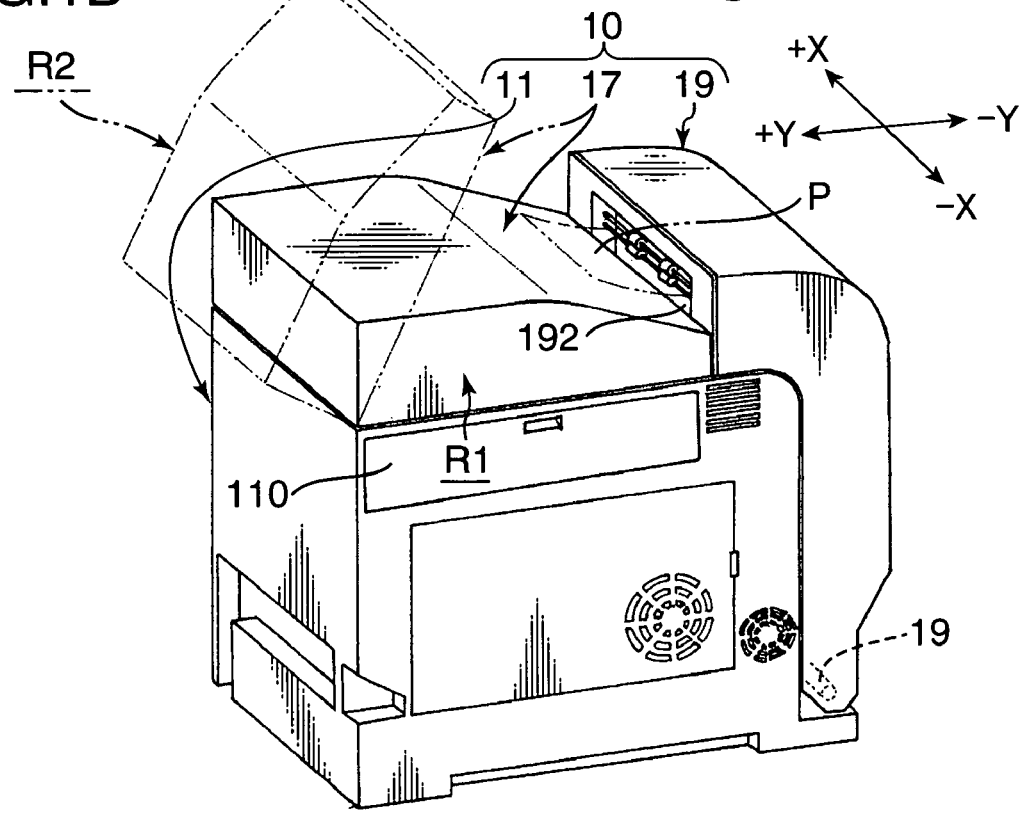
Figure 2A:
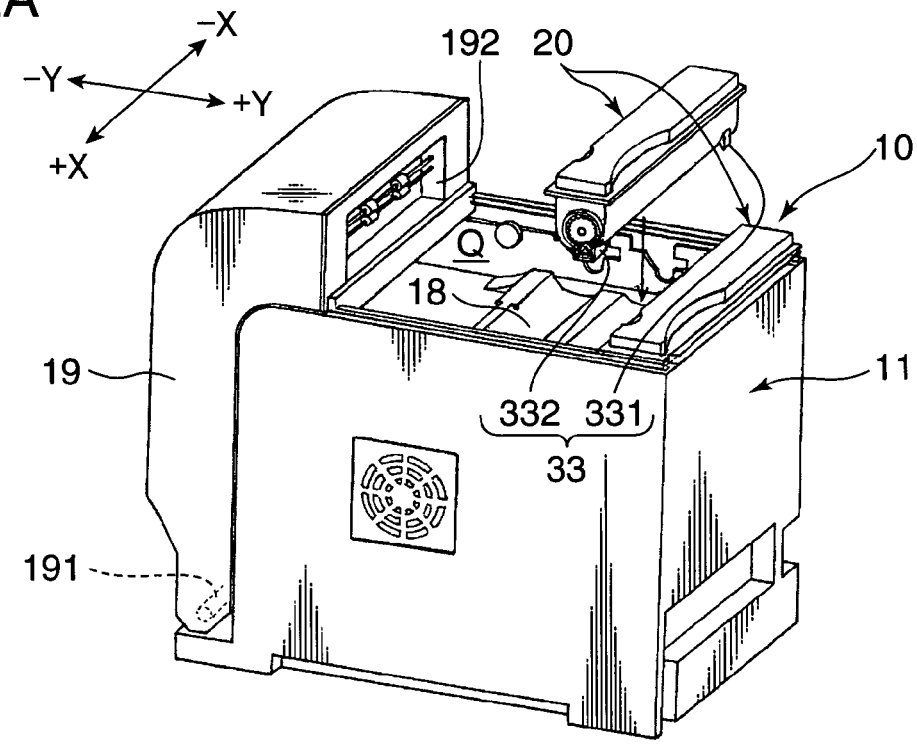
Figure 2B:
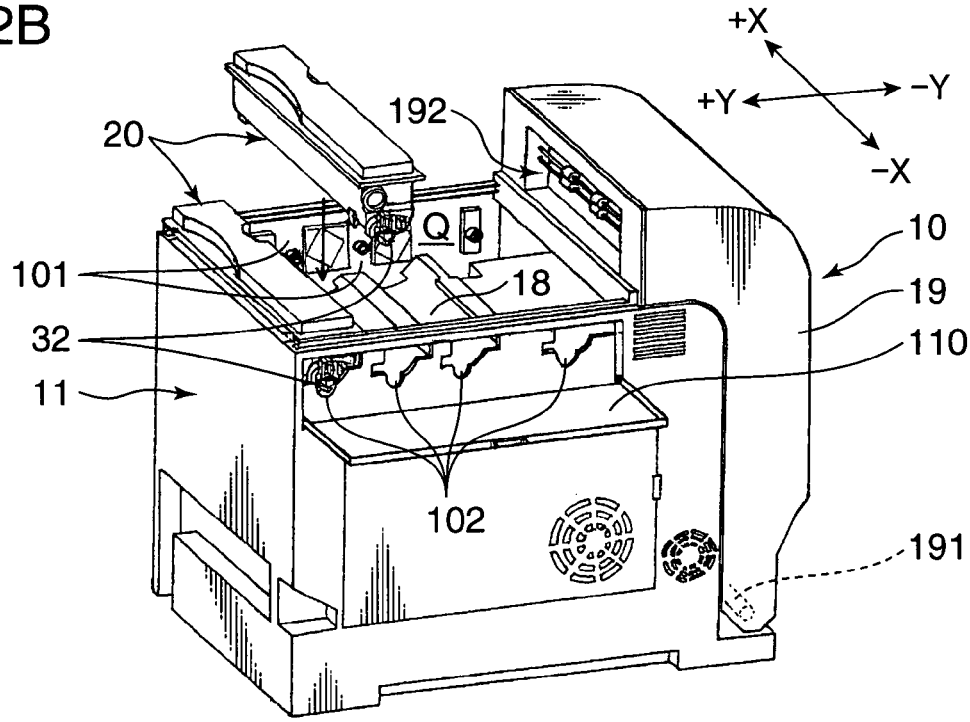
Figure 3:
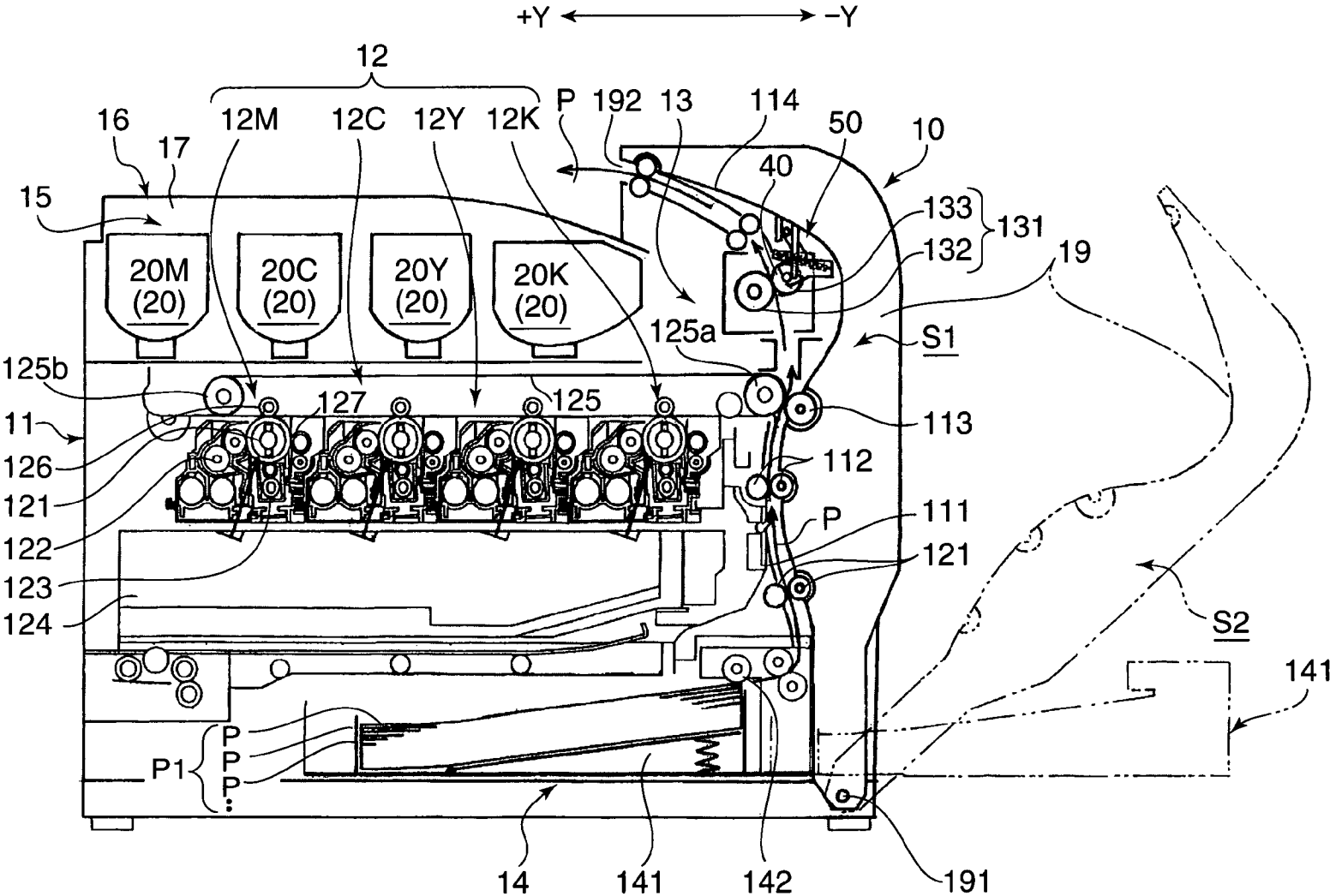
FIG. 3 is a cross sectional view illustrating an internal structure of the printer when it is viewed from its left side.

FIGS. 1A through 2B are external perspective views illustrating the printer 10. FIGS. 1A and 1B illustrate a paper output tray 17 installed in an apparatus main body 11; and FIGS. 2A and 2B illustrate the paper output tray 17 removed from the apparatus main body 11. FIGS. 1A through 2B are external perspective views illustrating the printer to which the toner container is provided. FIGS. 1A and 2A are perspective views when the printer is viewed from a right rear direction; and FIGS. 1B and 2B are perspective views when the printer is viewed from a left rear direction. FIG. 3 is a cross sectional view of an internal structure of the apparatus main body 11 viewed from a left side. In FIGS. 1A through 3, the X-X direction is referred to as a widthwise direction and the Y-Y direction is referred to as a forward and backward direction. More specifically, −X direction is referred to as the leftward, +X direction is referred to as the rightward, −Y direction is referred to as the forward, and +Y direction is referred to as the backward. In FIGS. 1A through 2B, an actual widthwise direction over the drawing paper is opposite to that indicated by X.

The printer 10 includes a box-shaped apparatus main body 11 including therein various members for forming images that will be described later, a paper output tray 17 provided on a top surface of the apparatus main body 11 in an openable and closable manner, and a covering body 19 provided on a front surface of the apparatus main body 11 in an openable and closable manner.

The paper output tray 17 receives a paper sheet P discharged after it is subjected to an image forming process within the apparatus main body 11. The paper output tray 17 rotates forward and backward around a back lower end of the paper output tray 17, thereby enabling a change of position between a closed position R1 where an opening in the top surface of the apparatus main body 11 is closed as illustrated by a solid line in FIG. 1, and a open position R2 where the opening is open as illustrated by a broken line in FIG. 1. The paper output tray 17 has an inclined surface which is formed such that a front surface of a front half thereof declines forward, and the paper sheet P discharged from an upper rear surface of the covering body 19 is discharged onto the paper output tray 17 guided by this declined surface.

The paper output tray 17 is detachable from the apparatus main body 11. As shown in FIG. 3, the top surface of the apparatus main body 11 is provided with an opening starting at the upper rear of the covering body 19 and extending backwards to the rear side of the apparatus main body 11. This opening makes it possible to attach and detach a toner container 20, which will be described below, when the paper output tray 17 is removed. Slightly below the opening, there is provided a partition 18 for partitioning off an image forming portion 12 in the lower section. The toner container 20 is detachably installed in the apparatus main body 11 with the toner container being supported by a top surface of this partition 18.

The covering body 19 has a reverse-L shape when viewed from the side or from the +X direction, and an upper section of the covering body 11 hangs over an upper front corner of the apparatus main body 11. The covering body 19 is rotatable at its bottom end around a support shaft 191 provided on a predetermined frame of the apparatus main body 11, thereby being able to change its position between a closed position S1 where the front opening of the apparatus main body 11 is closed and an open position S2 where the front opening of the apparatus main body 11 is open as illustrated by an alternating long and two dashed line in FIG. 3. A rear surface of the top end of the covering body 19 is formed with a paper discharge opening 192 for discharging the paper sheet P onto the paper output tray 17. The paper sheet P passes between a front surface of the apparatus main body 11 and a rear surface of the covering body to be discharged onto the paper output tray 17 through the paper discharge opening 192.

An internal structure of the apparatus main body 11 will be described below with reference to FIG. 3. The apparatus main body 11 includes therein an image forming portion 12 for forming an image on the basis of image information from an external apparatus such as a computer, a fixing portion 13 for fixing the toner image formed by this image forming portion 12 and transferred onto the paper sheet P, a paper stacker 14 for stacking the papers, and a toner replenish portion 15 for replenishing the image forming portion 12 with toner. A paper discharge section 16 comprising the paper output tray 17 is formed on the apparatus main body 11 in order for the paper sheet P to be discharged onto the paper output tray after it is subjected to a fixing process.

A not-shown operation panel is provided at an appropriate position of the apparatus main body 11 for the purpose of inputting output conditions of the paper sheet P. This operation panel includes a not-shown electric power supply key, a start button, and other various keys for inputting other output conditions.

The image forming portion 12 forms a toner image onto the paper sheet P fed from the paper stacker 14. The present embodiment exemplifies the image forming portion 12 including a magenta unit 12M using a magenta toner (developer), a cyan unit 12C using a cyan toner, a yellow unit 12Y using a yellow toner, and a black unit 12K using a black toner sequentially arranged from upstream (rear side in FIG. 3) to downstream.

Each of the units 12M, 12C, 12Y, and 12K has a photoconductive drum 121 and a developing device 122. The photoconductive drum 121 is adapted for forming an electrostatic latent image and a toner image according to this electrostatic latent image on a peripheral surface of the photoconductive drum 121. Multiple photoconductive layers constitute the peripheral surface of the photoconductive drum 121 such as amorphous silicon layers or the like which are tough and have excellent wear resistance. Each of the photoconductive drums 121 receives toner from the corresponding developing device 122 while being rotated in a clockwise direction in FIG. 3. Each of the developing devices 122 is replenished with toner from a toner replenishing portion 15.

A charging device 123 is provided immediately under each of the photoconductive drums 121, and an exposing device 124 is further provided under each of the charging devices 123. A peripheral surface of each photoconductive drum 121 is uniformly charged by the corresponding charging device 123. The peripheral surface of the charged photoconductive drum 121 is irradiated by laser light corresponding to each color based on image data input by a computer or the like and thereby an electrostatic latent image is formed on the peripheral surface of each photoconductive drum 121. Then, toner is supplied from the developing device 122 to the electrostatic latent image to form a toner image on the peripheral surface of the photoconductive drum 121.

Above each of the photoconductive drums 121, a transfer belt 125 is stretched between a driving roller 125*a* and a driven roller 125*b* such that the transfer belt comes into contact with each of the photoconductive drums 121. This transfer belt 125 orbits between the driving roller 125*a* and the driven roller 125*b* such that it is synchronized with and pressed against the peripheral surface of the photoconductive drum 121.

Therefore, while the transfer belt 125 orbits, a toner image of magenta toner is transferred onto the surface of the transfer belt by the photoconductive drum 121 of the magenta unit 12M, followed by a transfer of a cyan toner image, a yellow toner image, and then a black toner image at the same position on the transfer belt 125 in such a manner that the images are superimposed one another. Accordingly, a color toner image is formed on the surface of the transfer belt 125. The color toner image formed on the surface of the transfer belt 125 is further transferred onto the paper sheet P fed from the paper stacker 14.

In a forward position of each of the photoconductive drums 121, there is provided a cleaning device 127 for removing residual toner from the peripheral surface of the photoconductive drum 121 thus cleaning the surface. The peripheral surface of the photoconductive drum 121 thus cleaned by the cleaning device 127 then proceeds to the corresponding charging device 123 for the following charging process.

Waste toner removed from the peripheral surface of the photoconductive drum 121 by the cleaning device 127 is collected through a predetermined path and contained by a not-shown toner collecting bottle.

In front of the image forming portion 12, a paper feeding path 111 is formed extending vertically parallel to a back surface of the covering body 19. This paper feeding path 111 is provided with a pair of a pair of registration rollers 112 at an appropriate position, and the paper sheet P from the paper stacker 14 is conveyed toward the transfer belt 125 looped over the driving roller 125*a* by a driving force from the pair of a pair of registration rollers 112.

The paper feeding path 111 is provided with a second transfer roller 113 which comes into contact with the surface of the transfer belt 125 at a position opposite to the driving roller 125*a*. While the paper sheet P is conveyed through the paper feeding path 111 and pinched under pressure between the transfer belt 125 and the second transfer roller 113, the toner image on the transfer belt 125 is transferred onto the paper sheet P.

The fixing portion 13 is provided with a fixing device 131 adapted for fixing the toner image on the paper sheet P which has been transferred in the image forming portion 12 including the photoconductive drums 121, the transfer belt 125, and the like. The fixing device 131 is provided immediately above the second transfer roller 113. The paper sheet P having the toner image transferred from the transfer belt 125 is conveyed to the fixing portion 13 where it is fixed by this fixing device 131.

The fixing device 131 includes therein a fixing roller 132 with an electrical heating element such as a halogen lamp or the like and a pressure roller 133 placed opposite to the fixing roller 132 such that peripheral surfaces of both of the rollers contact each other. The paper sheet P on which an image was formed in the image forming portion 12 is then subjected to a fixing process helped by heat from the fixing roller 132 while the paper sheet P passes through a nip portion between the fixing roller 132 and the pressure roller 133 by the fixing roller 132 being driven. Then, the paper sheet P is discharged to the paper output tray 17 of the paper discharge section 16 through the paper feeding path 114 and the paper discharge opening 192 that extends above the fixing portion 13.

The paper stacker 14 is placed at a position below the exposing device 124 within the apparatus main body 11 and includes a paper tray 141 detachably installed therein. The paper tray 141 is formed into a box-like body including an entirely open top surface in order to stack a bundle of papers P1 composed of a plurality of papers P in a layered manner. The uppermost paper sheet P of the bundle of papers P1 stacked in the paper tray 141 is forwarded to the paper feeding path 111 by a driving force of a pick up roller 142 provided at a downstream end (a front end in FIG. 3). Then, the paper sheet P passes through the paper feeding path 111 by the driving force of the pair of a pair of registration rollers 112 to be conveyed to the nip portion between the second transfer roller 113 and the transfer belt 125 in the image forming portion 12.

The toner replenishing portion 15 is provided with four toner containers 20 (a magenta container 20M, a cyan container 20C, a yellow container 20Y, and a black container 20K) corresponding to the respective units 12M, 12C, 12Y, and 12K of the image forming portion 12. The developing device 122 of each of the units 12M, 12C, 12Y, 12K is replenished with toner from each of the corresponding containers 20M, 20C, 20Y, 20K when a remaining amount of toner becomes less.

The covering body 19 is openable and closable with respect to the front side of the apparatus main body 11 by changing its position between the closed position S1 and the open position S2 as described above. The covering body 19 is normally set to the closed position S1, thereby forming the paper feeding path 111 for conveying papers from the paper stacker 14 to the second transfer roller 113, wherein the paper feeding path is formed between the covering body and the front surface of the image forming portion 12 in FIG. 3.

When the pair of a pair of registration rollers 112 and the fixing portion 13 are jammed with papers, the covering body 19 is opened. In other words, the covering body position is changed from the closed position S1 to the open position S2. Thereby, the user can easily remove the jammed papers from the paper feeding path 111 and the fixing portion 13 which are exposed to the outside.

The covering body 19 is provided therein with a reverse feeding path to reverse a paper sheet P having been passed through the fixing portion 13 to be thereby applied with the fixing process, and return it to the paper feeding path 111 to make printing to a reverse side of the paper sheet. Description and illustration thereof are omitted here.

On an upper left surface of the apparatus main body 11, there is provided a horizontally long opening and closing cover 110. When the toner container 20 is attached to or detached from the apparatus main body 11 in the state where the cover 110 is opened (see FIG. 2B), the shutter cylinder 60 for conveying toner is operated for opening or closing by use of an operation of an operation lever 642 (FIGS. 12A and 12B) which will be described later.

Figure 4:
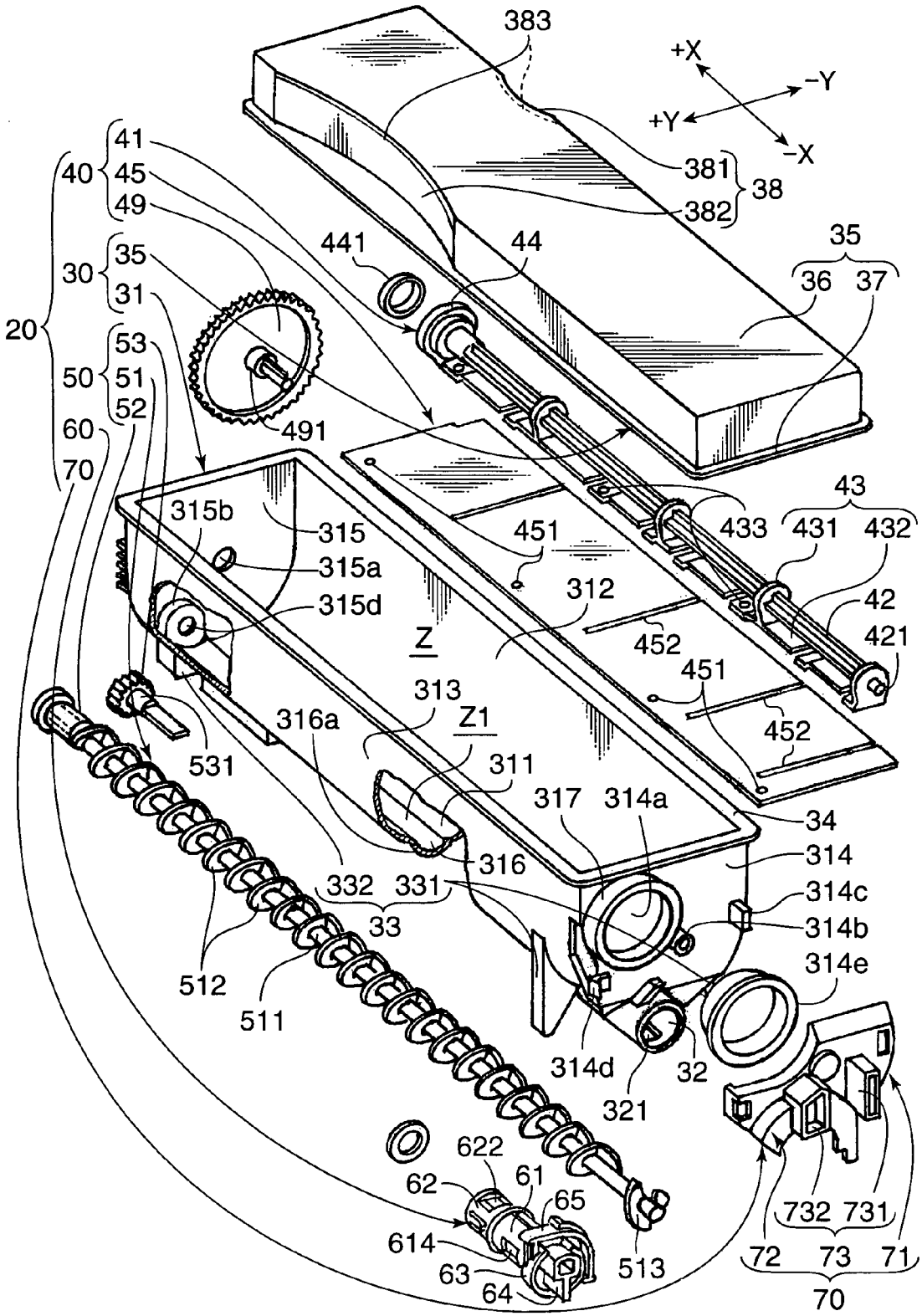
FIG. 4 is a partially cut exploded perspective view illustrating the toner container according to a first embodiment.
Figure 5:
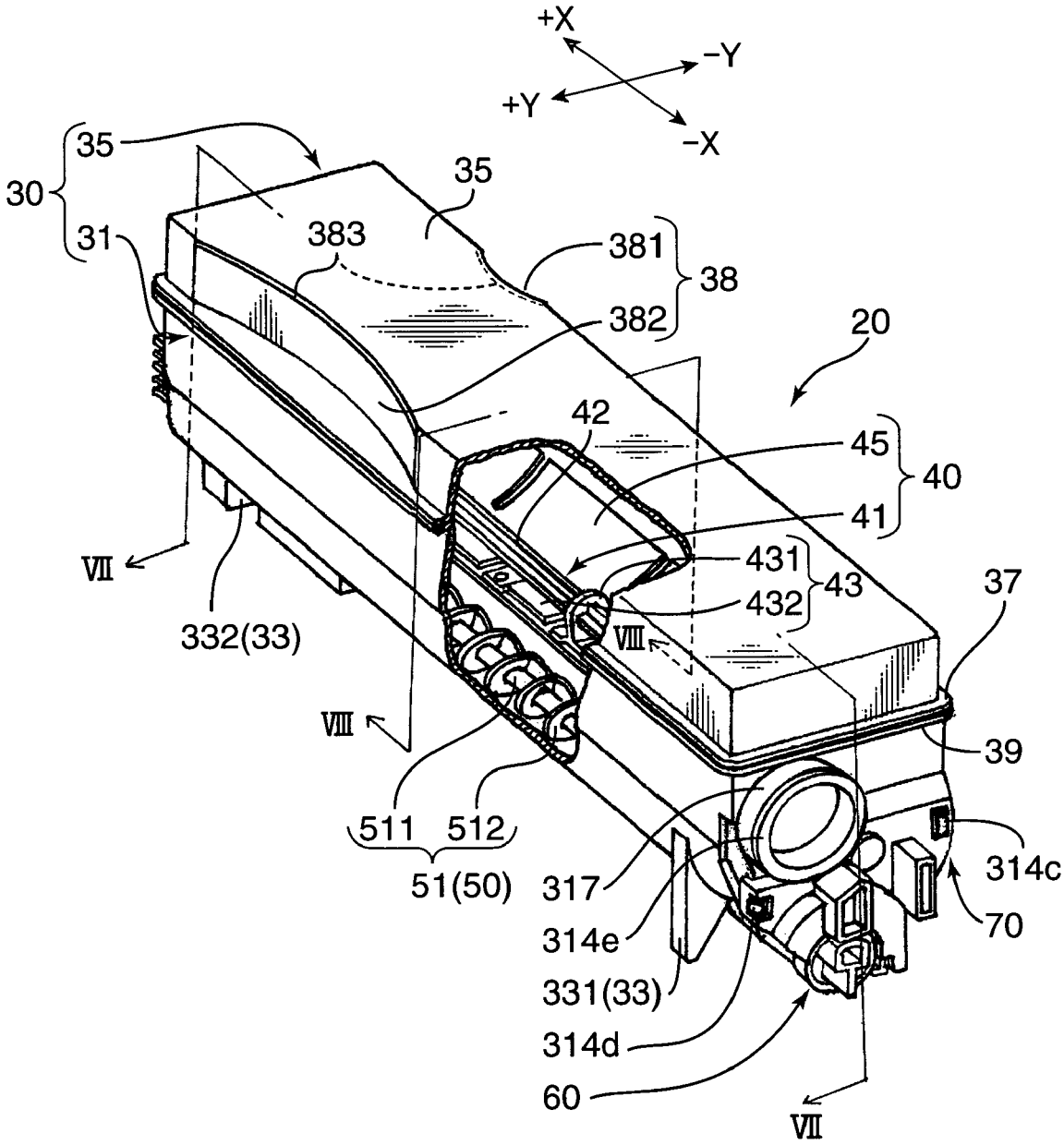
FIG. 5 is a partially cut perspective view of the assembled toner container shown in FIG. 4 when it is viewed from an obliquely upward front direction.
Figure 6:
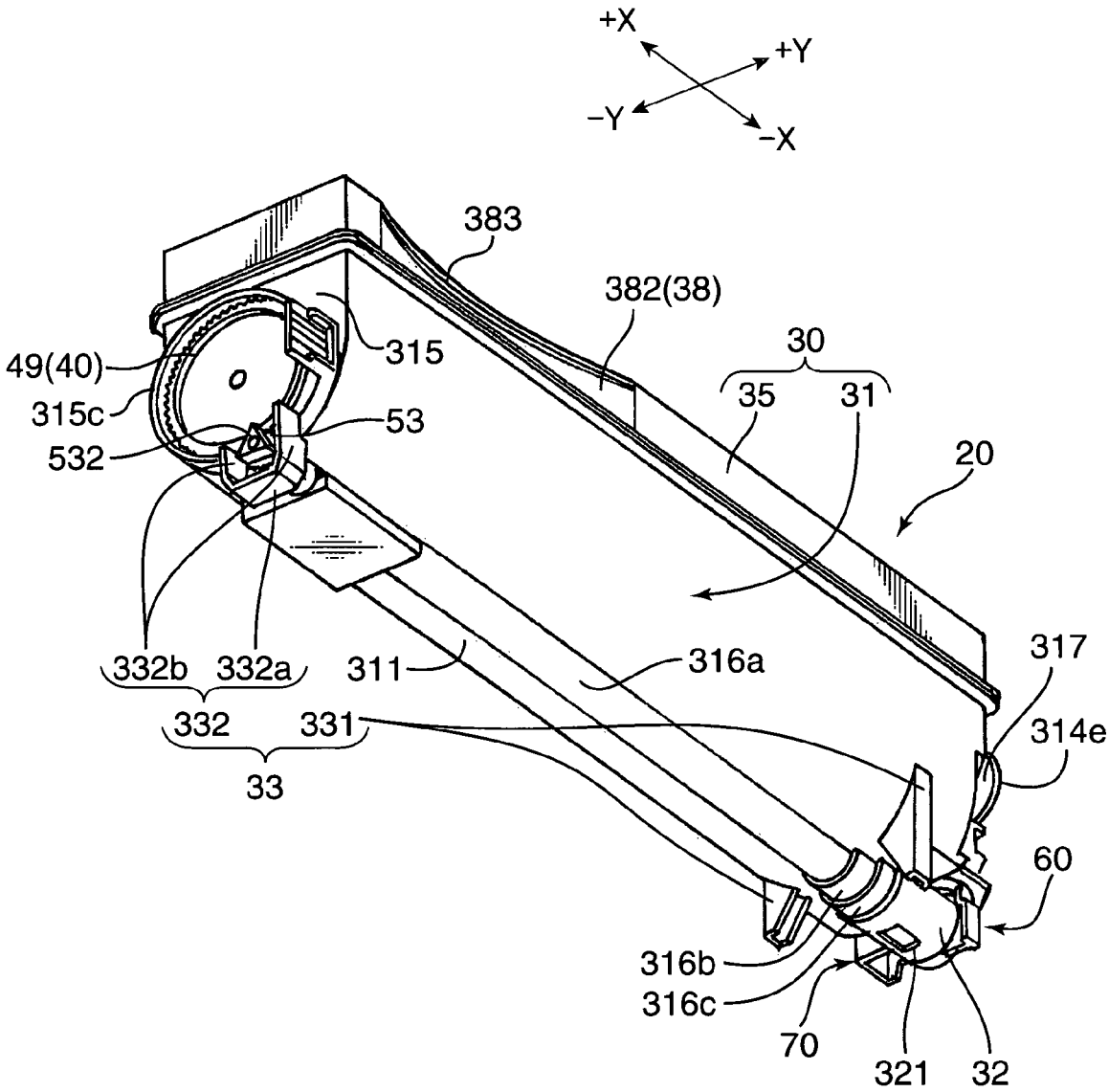
FIG. 6 is a perspective view of the toner container shown in FIG. 4 when it is viewed from an obliquely downward rear direction.
Figure 7:
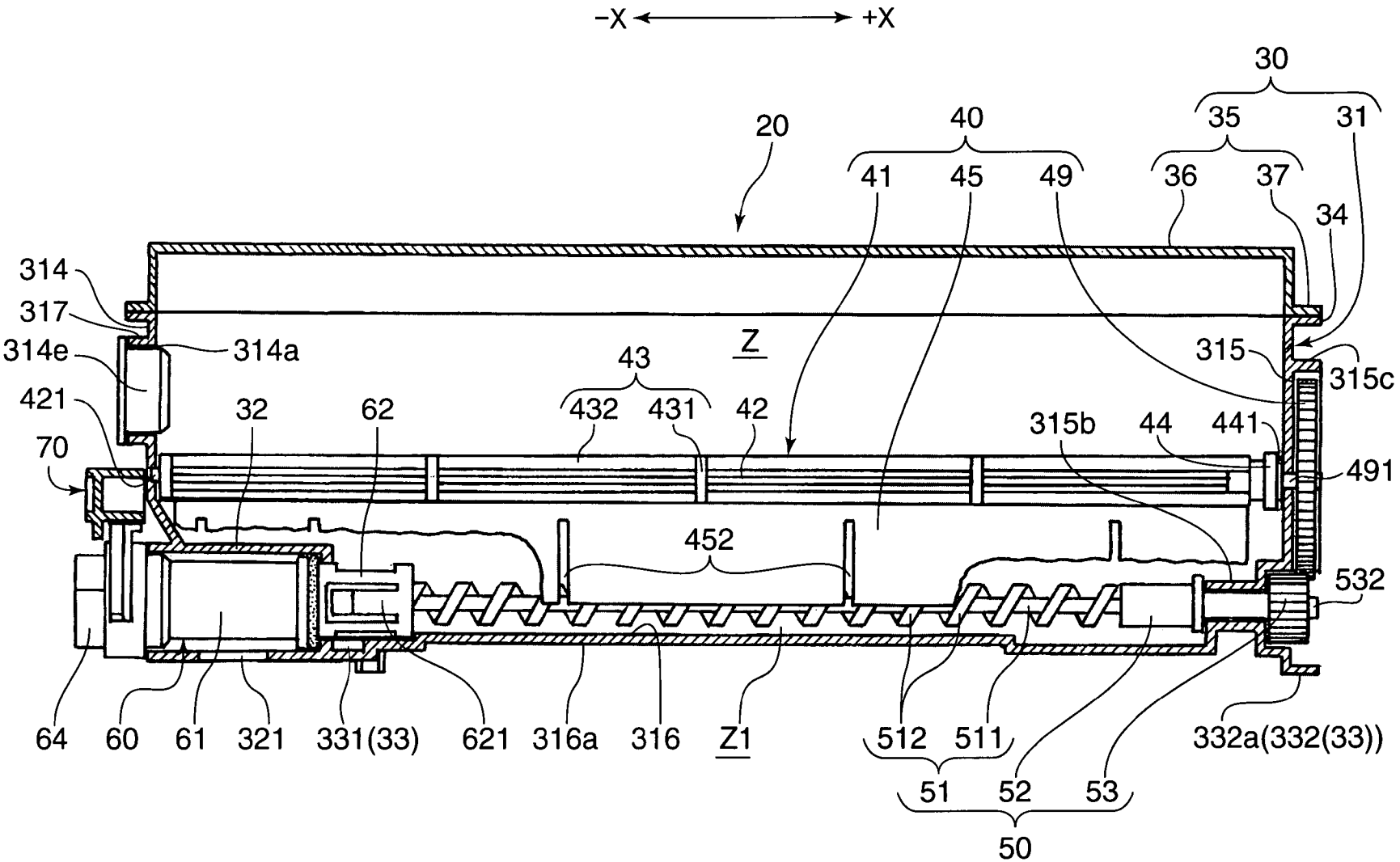
FIG. 7 is a cross sectional view of the toner container taken along line VII-VII in FIG. 5.
Figure 8:
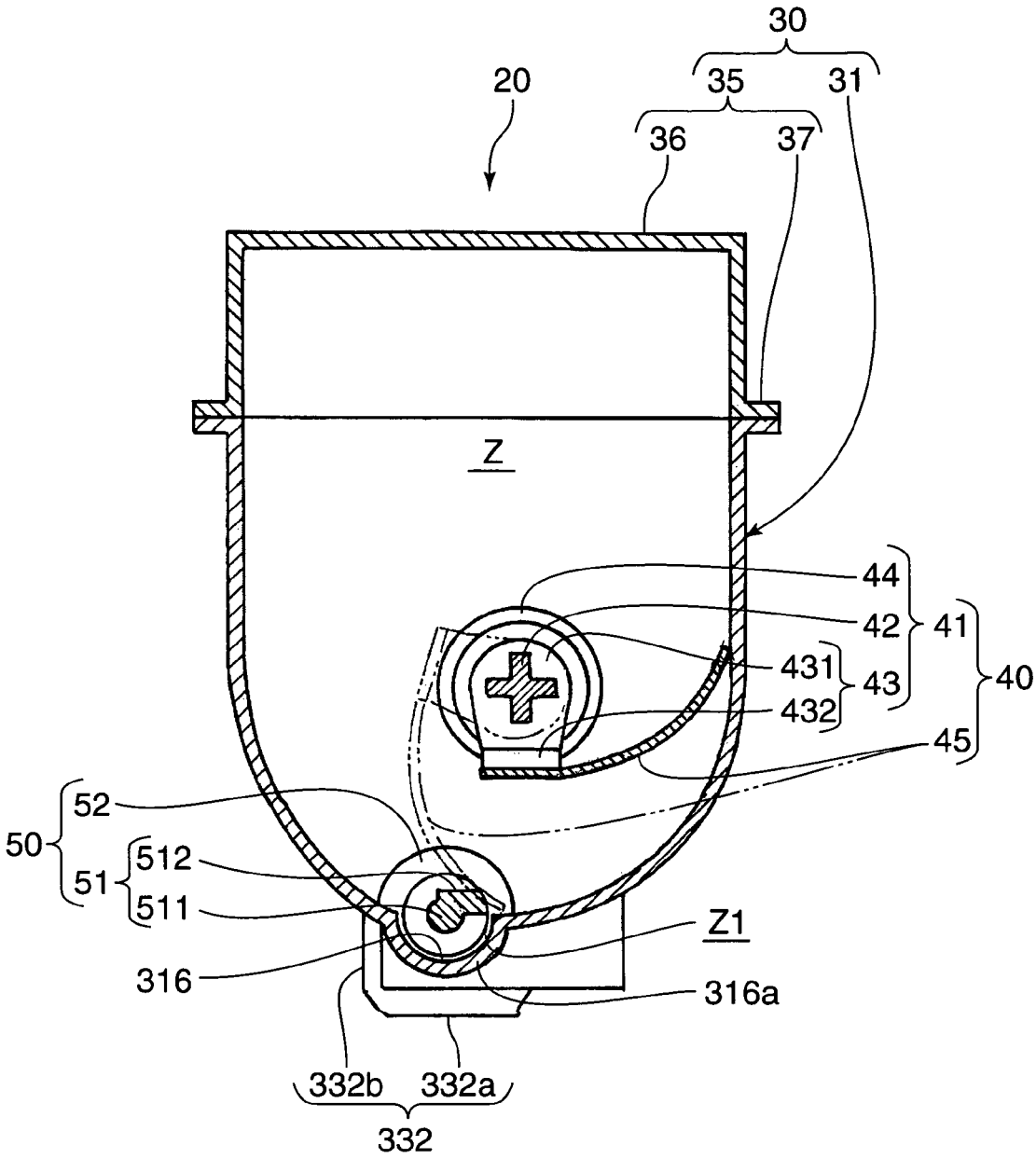
FIG. 8 is a cross sectional view of the toner container taken along line VIII-VIII in FIG. 5.

FIGS. 4, 5, and 6 are perspective views illustrating the toner container 20 according to the embodiment. FIG. 4 is a partially cut exploded perspective view of the toner container 20, and FIGS. 5 and 6 are a perspective views of the assembled toner container 20. FIG. 5 is a partially cut assembly perspective view of the toner container 20 viewed obliquely from the front, and FIG. 6 is a perspective view of the toner container 20 viewed obliquely downward from the rear. FIG. 7 is a cross sectional view of the toner container taken along line VII-VII of FIG. 5. FIG. 8 is a cross sectional view of the toner container taken along line VIII-VIII of FIG. 5. In FIGS. 4 to 7, X and Y indicates the same direction as they are illustrated in FIGS. 1A and 1B, namely, X indicates the widthwise direction (−X: leftward, +X: rightward) and Y indicates the forward and backward direction (−Y: forward, +Y: backward).

Of the four toner containers 20, the magenta container 20M, the cyan container 20C, and the yellow container 20Y have the same capacities and the same specifications. On the contrary, the black container 20K has a larger capacity and a specification different from the other three. In the following description, the magenta container 20M, the cyan container 20C, and the yellow container 20Y will be described as the container 20. However, it should be noted that the black container 20K has a structure basically identical to the other three containers, except for the capacity and a specific specification.

The toner container 20 (developer replenishing device) includes: a container 30 (developer container) for containing toner (developer) wherein the long container extends in the widthwise direction; an agitator 40 for agitating toner within the container 30; a conveying member 50 for conveying toner while being agitated to supply the toner to the developing device 122; a shutter cylinder 60 capable of changing its position between the open position when the toner is conveyed by the conveying member 50 toward the developing device 122 and a closed position for controlling toner supply to the developing device 122; and a covering cap 70 for covering a left member 314 of the container 30 which will be described later.

The container 30 includes a container main body 31 of which a top surface opens almost in its entirety and a cover 35 for closing the opening on the top surface of the container main body 31. The container main body 31 includes a shutter installation cylinder 32 (cylindrical receiving section) at a left end position of a bottom of the container into which a shutter cylinder 60 is inserted from the left side to be installed therein.

The container main body 31 includes: an arc-shaped bottom portion 311 formed into a downward projecting arc-like shape; a front side portion 312 vertically extended from a front edge of the arc-shaped bottom portion 311; a rear side portion 313 extending from a rear edge of the arc-shaped bottom portion 311; a left portion 314 (side wall) bridged between a right edge of the rear side portion 313, a right edge of the front side portion 312 and a right edge of the arc-shaped bottom portion 311; and a right portion 315 bridged between a left edge of the rear side portion 313, a left edge of the front side portion 312 and a left edge of the arc-shaped bottom portion 311. A space enclosed by the arc-shaped bottom portion 311, the front side portion 312, the rear portion 313, the left portion 314, and the right portion 315 is a toner charging chamber Z to be charged with toner.

The arc-shaped bottom portion 311 is provided with a recessed screw accommodation portion 316 as shown in FIG. 7. The recessed screw accommodation portion 316 is provided such that it extends downward from a position slightly forward of a center in a frontal direction of the arc-shaped bottom portion 311 and is a recessed section extending throughout an entire length in a widthwise direction, the recessed section having an arc shape in its cross section.

An interior side of the recessed screw accommodation portion 316 is formed with a toner conveying space Z1 of a gutter-shape formed therein, and the conveying member 50 is installed in this toner conveying space Z1. The recessed screw accommodation portion 316 is formed generally into a shape with a semicircle cross section as viewed in the widthwise direction. An upper half of the toner conveyance screw 51, which will be described later, is installed in the toner conveying space Z1 projecting upward from the toner conveying space Z1 (see FIG. 7).

Since the recessed screw accommodation portion 316 is formed on the interior surface of the arc-shaped bottom portion 311, an outer surface of the arc-shaped bottom portion 311 is provided with an arc-shaped projection 316*a* having an arc-like shape in its cross section along the recessed screw accommodation portion 316. The arc-shaped projection 316*a* gives the container main body 31 an enhanced structural strength.

The left portion 314 is formed with a toner charging hole 314*a* for charging toner into the toner charging chamber Z at an upper rear position of the left portion as well as a shaft supporting cylinder 314*b* (bearing portion). A central shaft 421 (rotational shaft) of the agitator 40 is fit in a slidable manner into this shaft supporting cylinder 314*b* that projects to the right at a slightly forward position from the center of curvature of the arc-shaped bottom portion 311.

The toner charging hole 314*a* is formed and enclosed by a toner charging cylinder 317. This toner charging cylinder 317 receives a synthetic resin stopper member 314*e* after toner is charged in a container main body 31.

Figure 9:
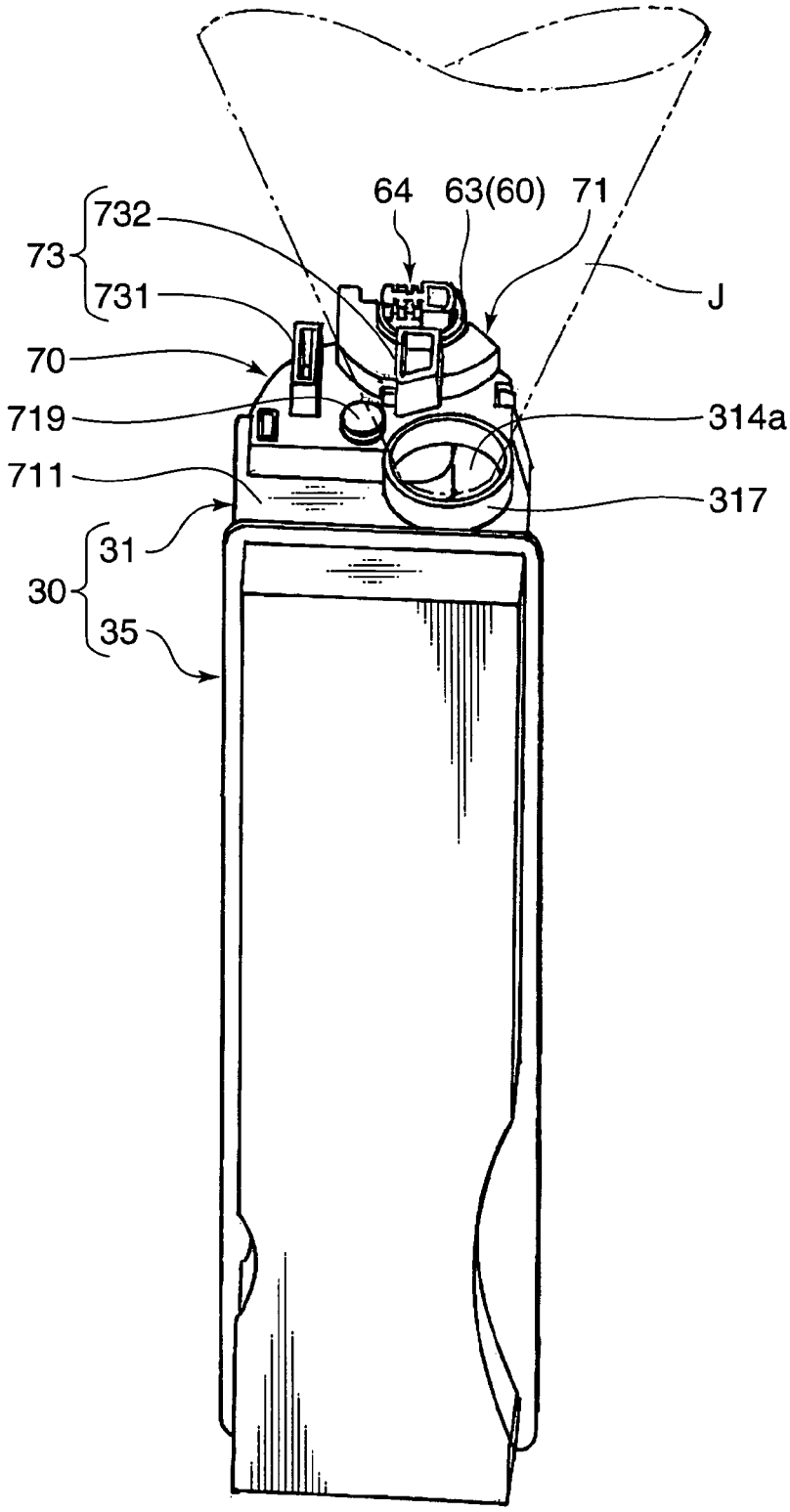
FIG. 9 is a perspective view showing a toner charging operation in the toner container.

FIG. 9 is a perspective view illustrating a toner charging operation for the toner container 20. As shown in FIG. 9, upon charging toner in the toner container 20, the toner container 20 is erected with the side of the driving members (the right portion 315 side where the agitating gear 49 and the conveying gear 53 are provided) facing downward, such that the operation side including the left portion 314 and an operation lever 642 facing upward. In the above described position, a tip of the funnel J is inserted into the toner charging hole 314*a* to charge toner into the toner container 20 through the funnel J.

The toner charging hole 314*a* is provided in the left portion 314 for the following reasons. Namely, the toner container 20 is attached to and detached from the container accommodation chamber Q of the apparatus main body 11 from above in the present embodiment. In the case where the cylindrical toner charging hole 314*a* is formed in a surface along the attachment and detachment direction (front side portion 312 and rear side portion 313), a projection comes to being over the surface along the attachment and detachment direction in the state where the stopper member 314*e* seals the toner charging hole 314*a*, and consequently obstructs the attachment and detachment of the toner container 20.

Also, the toner container 20 extends in the widthwise direction. Accordingly, it is advantageous in the charging efficiency to charge toner in the widthwise direction. Furthermore, because the right portion 315 serving as driving force transmission is provided with the agitating gear 49 and the conveying gear 53, there is not sufficient space for the toner charging hole 314*a* therein. Accordingly, the toner charging hole 314*a* having a large diameter suitable for high-speed toner charging is formed in the left portion 314 which includes the operation members and has sufficient space.

The toner charging hole 314*a* is provided at a convenient position at an upper rear of the shaft supporting cylinder 314*b* as a bearing portion for supporting one end of the agitating shaft (actually, a sheath cylinder 719 described below is externally engaged with the shaft supporting cylinder 314*b* with the covering cap 70 being mounted to the container main body 31). Accordingly, the shaft supporting cylinder 314*b* is positioned between the toner charging hole 314*a* and a forward swing prevention projection 731 which will be described later.

Since the toner charging hole 314*a* is formed in the left portion 314 at the above described position, the toner charging funnel J does not interfere with the other members on the left portion 314 (covering cap 70 and forward swing prevention projection 731). Therefore, the toner charging operation through the toner charging hole 314*a* can be carried out smoothly.

The left portion 314 is provided with a retaining projection 314*d* and an engaging claw portion 314*c*, respectively, for retaining the covering cap 70 at a rear end position slightly upward from center in a vertical direction and at a front end position slightly downward from center in a vertical direction.

The left portion 314 is provided with a shutter installation cylinder 32 for receiving a shutter cylinder 60, the shutter installation cylinder projecting rightward at a position lower than the engaging claw portion 314*d* and concentrically with the center of curvature of the recessed screw accommodation portion 316.

The arc-shaped bottom portion 311 is provided with a supporting leg 33 for supporting the container 30 on the partition 18 (FIG. 2). The supporting leg 33 includes, as shown in FIG. 6, a pair of left legs 331 in the frontal direction which project downward from an appropriate right position of the arc-shaped bottom portion 311, and one right leg (covering member) 332 provided at a bottom left end of the arc-shaped bottom portion 311.

The right leg 332 serves as a positioning member in the toner charging chamber Z and as a protector of a conveyance gear (driving force transmitting portion) 53 which will be described below, and is provided such that it project downward and leftward at a position corresponding to the recessed screw accommodation portion 316. Such a right leg 332 includes a horizontal small portion 332*a* and a front and a rear vertical small portion 332*b* vertically extending from the front and rear ends of the horizontal small portion 332*a* respectively. The conveying gear 53 is housed and protected in an enclosed space by the horizontal small portion 332*a* and the pair of vertical small portions 332*b*.

The right leg 332 is formed such that a bottom surface of the horizontal small portion 332*a* abuts and is in flush with a plane identical to each of the bottom ends of the pair of left legs 331. Accordingly, the container main body 31 is supported in three points by the supporting legs 33 such that the toner container 20 is placed on the partition 18 of the apparatus main body 11, whereby an entire bottom surface of the horizontal small portion 332*a* abuts the partition 18.

On the other hand, on the side of the driving members (right side) of the apparatus main body 11 that convey a driving force to the conveying member 50, a wall surface of a right wall within the container accommodation chamber Q is provided with positioning grooves 101 corresponding to the respective right legs 332 of each of the toner containers 20 as shown in FIG. 2B. When the toner container 20 is installed in the container accommodation chamber Q, the right leg 332 is engaged in the corresponding positioning groove 101. In this state, the toner container 20 is moved down and installed into the container accommodation chamber Q with the guidance of the positioning grooves 101.

Further, on the side of the operation members (left side) that operate the shutter cylinder 60 of the toner container 20 of the apparatus main body 11, a left wall of the toner charging chamber Z is provided with recessed support portions 102 for supporting the shutter installation cylinders 32 of the toner containers 20, respectively, as shown in FIG. 2B. An upper portion of each of the recessed support portions 102 is formed with a width suitable to guide the corresponding shutter installation cylinder 32 to the recessed support portion 102 with ease.

When the toner container 20 is installed into the container accommodation chamber Q, the toner container 20 is moved downward to insert the shutter installation cylinder 32 into the wide portion of the upper section of the recessed support portion 102 after the right leg 332 is engaged with the corresponding positioning groove 101. Accordingly, the toner container 20 is kept moving downward with the guidance of the positioning groove 101 to reach the partition 18, and thereby the shutter installation cylinder 32 is installed into the container accommodation chamber Q with the shutter installation cylinder 32 being engaged with the recessed support portion 102.

As stated above, the right leg 332 also serves as a supporting leg 33 to protect the conveying gear 53 and to position the toner container 20 thus eliminating the necessity of a dedicated protection member and a dedicated positioning member for the conveying gear 53 and helping to reduce the number of parts.

The right portion 315 is provided with a shaft supporting hole 315*a* opposite to the shaft supporting cylinder 314*b* in the widthwise direction. The shaft supporting hole 315*a* is provided for inserting a coupling shaft 491 of the agitating gear 49, which will be described later, from an outer side of the right portion 315. The agitator 40 is rotatably supported and a right end of the agitator is integral with the coupling shaft 491. The right portion 315 is provided with a gear installation cylinder 315*b* at a rear bottom of the shaft supporting hole 315*a* that extends toward the toner charging chamber Z. This gear installation cylinder 315*b* receives generally a half of the thickness of the conveying gear 53, which will be described below. A partitioning wall provided on a left end surface of the gear installation cylinder 315*b* is provided with the shaft supporting hole 315*d* for supporting the coupling shaft 531 of the conveying gear 53, which will be described later.

The outer surface of the right portion 315 is, as shown in FIG. 6, provided with an annular strip 315*c* concentric with a the shaft supporting hole 315*a* in order to protect the agitating gear 49 which will be described later. This annular strip 315*c* is provided with a notch at a portion of the annular strip corresponding to the right leg 332, and thus this notch provides a spatial relationship between a space encircled by the annular strip 315*c* and an inside of the right leg 332.

Turning back to FIG. 4, the cover 35 closes the top opening of the container main body 31 and has a shape identical to the container main body 31 when viewed on a plane. The cover 35 includes a cover main body 36 having an opening over its entire lower surface and a cover side flange 37 projecting outward from the lower edge of this cover main body 36 over the entire peripheral.

On the other hand, the container main body 31 includes a main body side flange 34 projecting from a leading edge over the entire peripheral so as to be opposed to the cover side flange 37. Opposing surfaces of the flanges 34 and 37 are bonded to each other with a predetermined gluing or adhesion process, and thereby the cover 35 is fixedly attached to the container main body 31.

The cover main body 36 is provided with concave handles 38 at appropriate positions of front and rear sides extending in a widthwise direction (rightward position of the present embodiment). These concave handles 38 are formed such that the front and the rear sides of the cover main body 36 are recessed into mutually opposing arcs. In the present embodiment, the small concave handle 381 capable of receiving a thumb is formed on the front side of the cover main body 36, whereas a large concave handle 382 capable of receiving an index finger, a middle finger, a ring finger, or a little finger is formed on the rear side of the cover main body opposing to the small concave handle 381.

Vertical dimensions of the cover 35 are set such that the cover 35 can be held by at least fingers (about 10 mm in the present embodiment). Accordingly, the user can stably hold the cover 35 and carry the toner container 20.

Leading edges of the concave handle 38 (small concave handle 381 and large concave handle 382) are provided with hooking flanges 383 extending outward for entire lengths of the concave handle, as shown in FIG. 6. The hooking flanges 383 catch on fingers when the small concave handle 381 and the large concave handle 382 are held. Thus, such an inconvenience of slipping fingers can be eliminated so that the user can hold the cover 35 securely.

Figure 10:
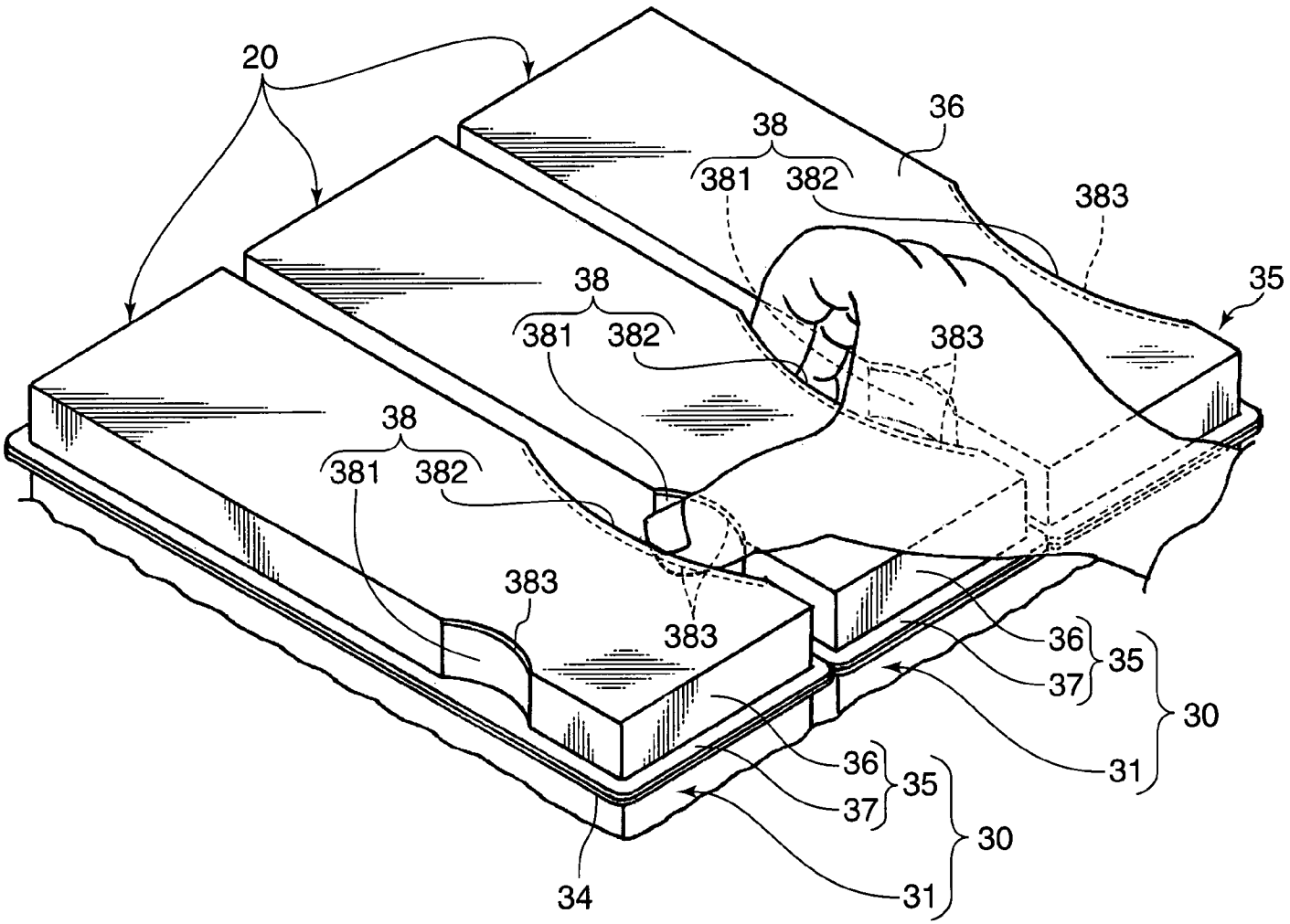
FIG. 10 is a perspective view illustrating a user holding the toner container.

FIG. 10 is a perspective view illustrating the user holding the toner container 20. The toner container 20 is held up by inserting a thumb into the small concave handle 381 as well as inserting any of the second, third, fourth, or little finger to hold the concave handle 318 as shown in FIG. 10. Then, the user lifts the toner container 20 such that the toner container 20 is pulled out of the top of the container accommodation chamber Q of the printer 10.

Now, turning back to FIG. 4, the agitator 40 is provided for agitating the toner within the container main body 31. The agitator 40 includes a shaft member 41 which is bridged between the shaft supporting cylinder 314*b* provided on the left portion 314 of the container main body 31 and the shaft supporting hole 315*a* provided in the right portion 315 of the container main body 31; the agitating blade 45 mounted on the shaft member 41; and the agitating gear 49 coupled to the shaft member 41 concentrically in an integrally rotatable manner.

The shaft member 41 is set to be slightly shorter than a distance between the left portion 314 and the right portion 315. The shaft member 41 includes a joint cross (agitating shaft) 42 having a cross shape in a cross sectional view, a plurality of blade supporting members 43 fit into this joint cross 42, and a joint disc 44 fixed concentrically to a right end of the joint cross 42.

Each blade supporting member 43 includes a fitting portion 431 fitted to the joint cross 42 and a blade receiving portion 432 extending from an edge of this fitting portion 431 so as to be parallel with the joint cross 42. In the present embodiment, it is exemplified that four blade supporting members 43 are used and the fitting portions 431 of the four blade supporting members 43 are fitted to the joint cross 42 with equal pitches in an integrally rotatable manner. The joint cross 42 has a central shaft 421 concentric with the joint cross 42. The central shaft 421 passes through the leftmost fitting portion 431 at the left end surface of the joint cross 42 to project further leftward. The central shaft 421 is fit into the shaft supporting cylinder 314*b* of the left portion 314.

A joint disc 44 is coupled to the agitating gear 49 through the shaft supporting hole 315*a* in a manner concentrically with and integrally rotatable with the agitating gear. The rotation of the agitating gear 49 is conveyed to the shaft member 41 through the joint disc 44.

The agitating gear 49 includes at its central position a coupling shaft 491 projecting to the left. This coupling shaft 491 has a diameter slightly smaller than that of the shaft supporting hole 315*a* and is fit into the shaft supporting hole 315*a* in a slidable manner. A leading end of the coupling shaft 491 is provided with a key projection. On the other hand, a right surface of the joint disc 44 includes a key hole corresponding to the key projection. When the key projection is fit into the key hole, the agitating gear 49 can be rotatable together with the shaft member 41 around an axial direction thereof, thereby conveying the rotation of the agitating gear 49 to the shaft member 41.

The shaft member 41 and the agitating gear 49 are coupled to each other by an annular sealing member 441 disposed between the right portion 315 and the joint disc 44 as shown in FIG. 7. Owing to the annular sealing member 441, the toner within the container main body 31 is prevented from leaking through the shaft supporting hole 315*a*.

The agitating blade 45 is fixed to the blade receiving portions 432 of the joint cross 42 at an edge of a longer side of the agitating blade in order to agitate the toner, and is made of a flexible synthetic resin film. The agitating blade 45 is given a length identical to that of the joint cross 42 and a width (diameter of the joint cross 42) slightly longer than a distance between an axis of the joint cross 42 and an interior surface of the arc-shaped bottom portion 311 of the container main body 31.

The agitating blade 45 is formed with a predetermined number of small holes 451 along the edge of a longer side of the agitating blade at equal pitches in order to install the agitating blade 45 to the blade receiving portion 432. The blade receiving portion 432 includes threaded screw holes 433 at positions corresponding to the small holes 451. A predetermined screw is screwed and secured into the corresponding screw hole 433 through the corresponding small hole 451, thereby mounting the agitating blade 45 to the shaft member 41.

The agitating blade 45 is provided with a plurality of cut grooves 452. The cut grooves 452 are formed such that the agitating blade 45 is cut in its width direction toward the base end from an edge opposite to a base side where the small holes 451 are provided.

The shaft member 41 is rotated in a clockwise direction in FIG. 8 with the shaft member 41 mounted in the toner charging chamber Z of the container main body 31, thereby allowing the agitating blade 45 to come into contact with the interior surface of the arc-shaped bottom portion 311 while the agitating blade is curved according to elastic deformation. The agitator 40 agitates the toner within the toner charging chamber Z such that the toner adhered to the interior surface of the arc-shaped bottom portion 311 is scraped out by the contact by the agitating blade 45.

Figure 11:
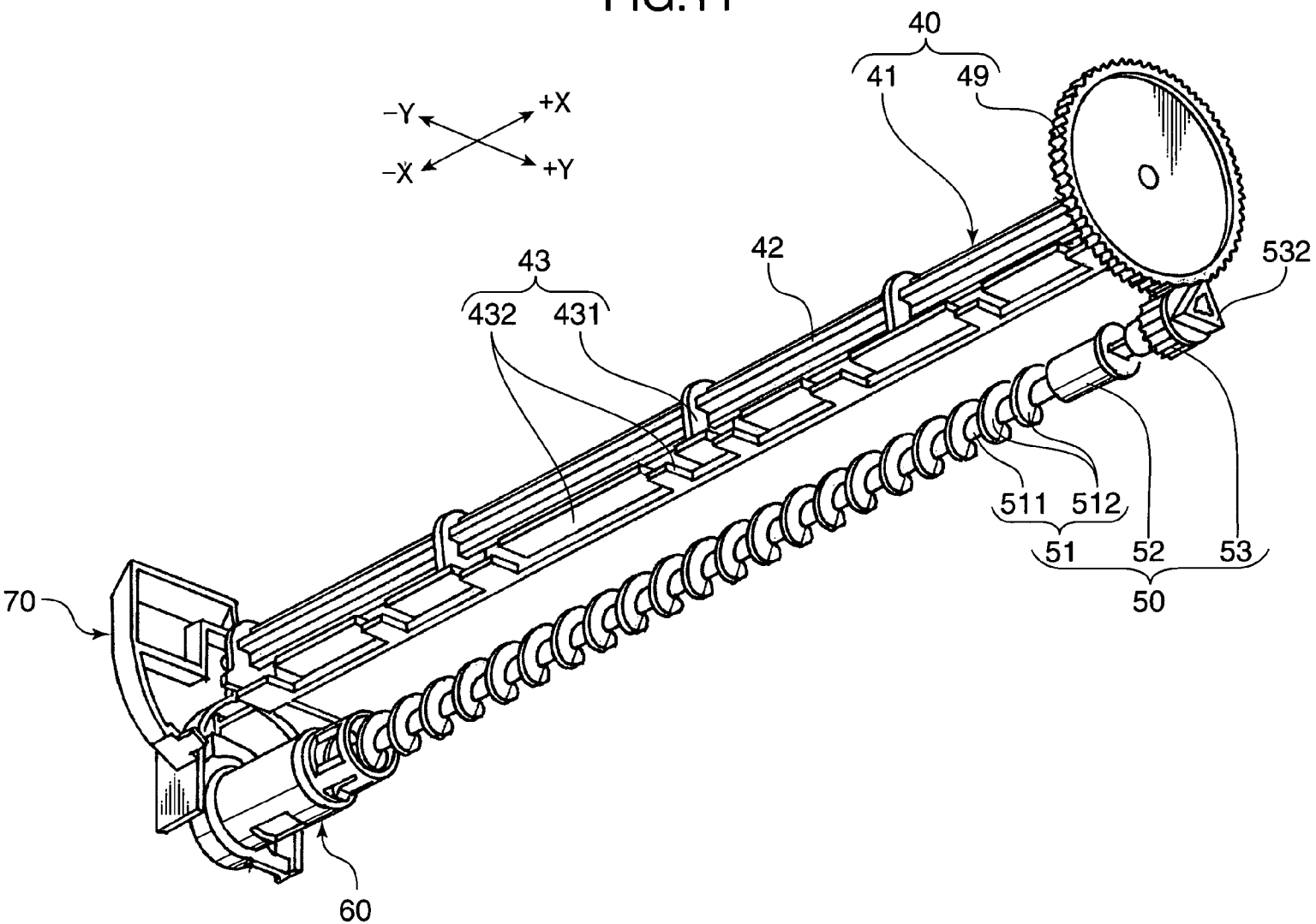
FIG. 11 is a perspective view of an agitator and a conveying member viewed from an obliquely right front direction focusing on a relative positional relation between the two.

The conveying member 50 will now be described with reference to mainly FIGS. 4 and 11, and to the other drawings, if required. FIG. 11 is a perspective view of the agitator 40 and the conveying member 50 viewed obliquely from a right front direction and focused on the relative positional relation therebetween. In FIG. 11, directions indicated by X and Y are identical to those in FIG. 1, namely, X indicates a widthwise direction (−X: leftward and +X: rightward) and Y indicates a forward and backward direction (−Y: forward, +Y: backward).

The conveying member 50 conveys toner to the shutter cylinder 60 along the toner conveying space Z1 of the recessed screw accommodation portion 316 provided on the arc-shaped bottom portion 311 of the container main body 31, while toner is being agitated by the agitator 40.

The conveying member 50 includes a toner conveyance screw 51 (developer conveyance member) arranged conforming with the toner conveying space Z1 of the recessed screw accommodation portion 316, a cylindrical body 52 integrally extending concentrically from a right end of the toner conveyance screw 51, and the conveying gear 53 mounted concentrically to this cylindrical body 52.

The toner conveyance screw 51 includes a screw shaft 511 extending in a widthwise direction and a plurality of agitating fins (spiral blades) 512 which are integrally fit into the screw shaft 511 at equal pitches. Each of the agitating fins 512 is mounted to the screw shaft 511 almost throughout the entire length of the screw shaft 511 such that the agitating fins 512 are linked to each other to form a spiral shape. A left end of the screw shaft 511 is supported by the shutter cylinder 60 installed in the shutter installation cylinder 32 provided on the left portion 314 so as to be concentric to the shutter cylinder in a relatively rotatable manner.

The agitating fin 512 is not provided on a portion of the screw shaft 511 corresponding to the toner discharge hole 321 of the shutter installation cylinder 32 which is described later. Instead thereof, at least one projecting rib that is not shown is provided in parallel to the screw shaft 511, and a leading end (left end) of the screw shaft 511 is provided with the agitating fins 512 and a reverse spiral agitating fin 513 of which the spiral direction is opposite to that of the agitating fins 512. Therefore, the toner that reaches the toner discharge hole 321 by a driving force of the toner conveyance screw 51 is forwarded to the toner discharge hole 321 by means of the agitating fins 512 and the reverse spiral agitating fin 513, thereby allowing a smooth discharge of toner through the toner discharge hole 321.

The cylindrical body 52 conveys driving rotation of the conveying gear 53 to the toner conveyance screw 51 and includes the concentric key hole in the right end surface of the cylindrical body. The cylindrical body 52 is coupled to the conveying gear 53 installed in the gear installation cylinder 315*b* in a concentrically integrally rotatable manner.

The conveying gear 53 rotates owing to a driving force from a not-shown driving motor provided at an appropriate position within the apparatus main body 11. The rotation of the conveying gear 53 is directly conveyed to the toner conveyance screw 51 as well as conveyed to the shaft member 41 of the agitator 40 through the agitating gear 49. The conveying gear 53 is placed within an interior space of the right leg 332 and meshes with the agitating gear 49.

A left surface of the conveying gear 53 is provided with a coupling shaft 531 which is concentrically projected to the left and which is inserted into the shaft supporting hole 315*d* to be coupled to the cylindrical body 52. A right surface of the conveying gear 53 is provided with a triangular joint projection 532 for conveying a driving force of the driving motor (see also FIG. 6).

A front end surface (left surface) of the coupling shaft 531 is concentrically provided with the key projection, while a right end surface of the cylindrical body 52 is formed with the key hole corresponding to the key projection. Since the key projection is fit into the key hole, the drive rotation of the conveying gear 53 is conveyed to the toner conveyance screw 51 through the cylindrical body 52.

A substantially upper half of the toner conveyance screw 51 projects upward from the toner conveying space Z1, as shown in FIG. 8, when the toner conveyance screw 51 is installed in the recessed screw accommodation portion 316 within the container main body 31 (i.e., within the toner conveying space Z1). On the other hand, the agitating blade 45 is dimensioned such that it elastically deforms to curve when a leading edge of the agitating blade slidably comes into contact with an interior surface of the arc-shaped bottom portion 311.

Therefore, when the agitator 40 integrally rotates around the shaft member 41 in a clockwise direction in FIG. 8, the leading end of the agitating blade 45 will stroke an upper surface of the toner conveyance screw 51 as shown by an alternating long and two dashed line in FIG. 8. This prevents a phenomenon known as bridging wherein toner accumulates on an upper position of the toner conveyance screw 51 and thus consistently and reliably supplies the toner from the toner charging chamber Z.

In other words, if a depth of the toner conveying space Z1 is larger than a radial length (diameter) of the toner conveyance screw 51 and if the curve of the agitating blade 45 is not large as in prior art, the leading end of the agitating blade 45 cannot come into contact with the peripheral surface of the toner conveyance screw 51 and only passes through an upper surface opening of the recessed screw accommodation portion 316 in a frictional manner. This works as a force for compressing the toner residing in the recessed screw accommodation portion 316. Accordingly, the bridging phenomenon occurs wherein the toner accumulates and creates a tunnel-like sealing at a portion of the top surface opening of the recessed screw accommodation portion 316, and therefore the toner cannot be appropriately replenished in the developing device 122. However, such an inconvenience is reliably prevented by setting the depth of the recessed screw accommodation portion 316 so that the upper half of the toner conveyance screw 51 projects to consistently come into contact with the leading end of the agitating blade 45.

Figure 12A:
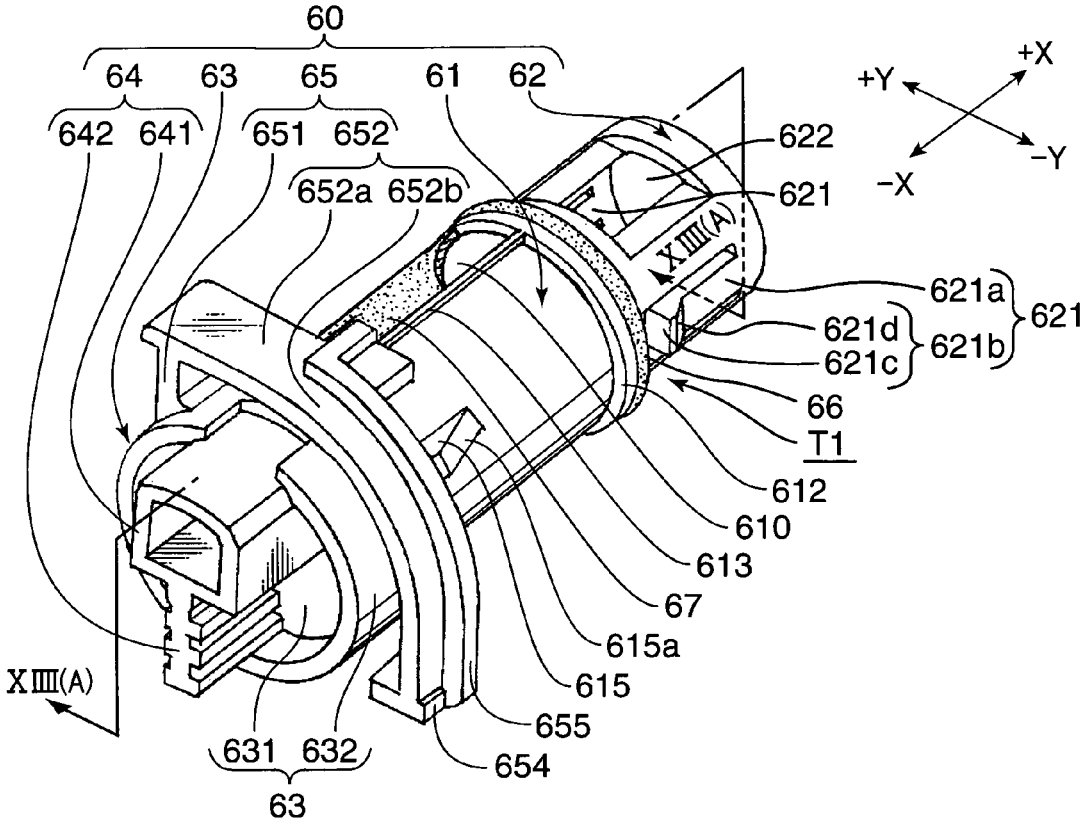
FIGS. 12A and 12B are partially cut perspective views each illustrating a shutter cylinder, showing a state where the shutter cylinder is in a closed position.
Figure 12B:
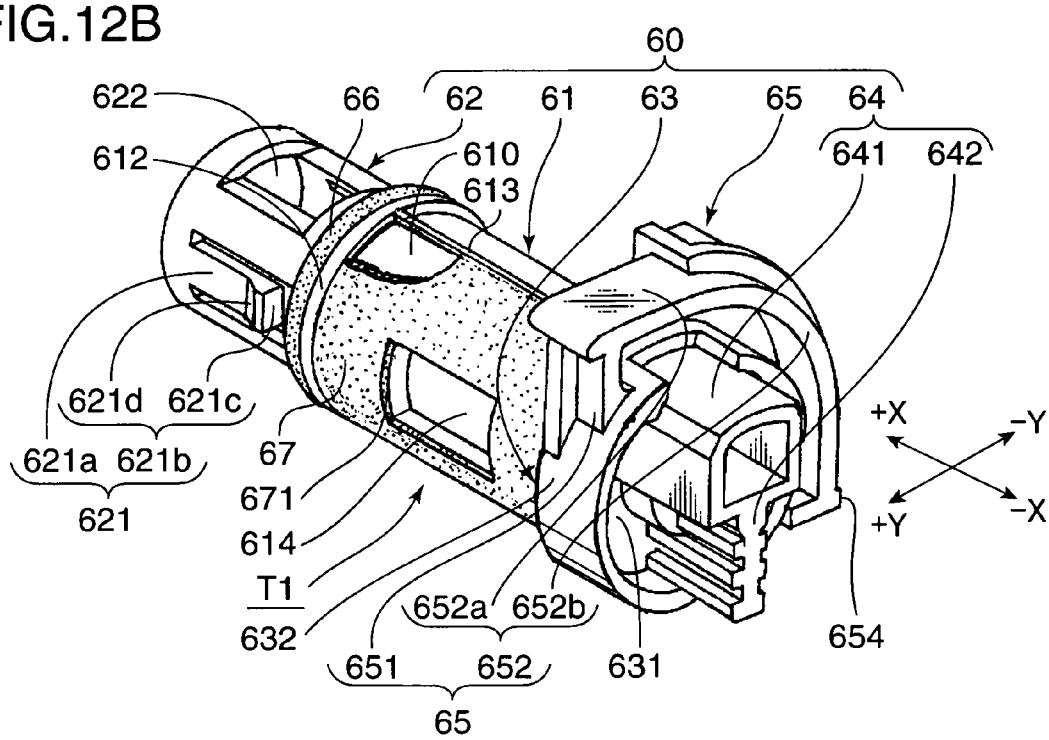
Figure 13A:
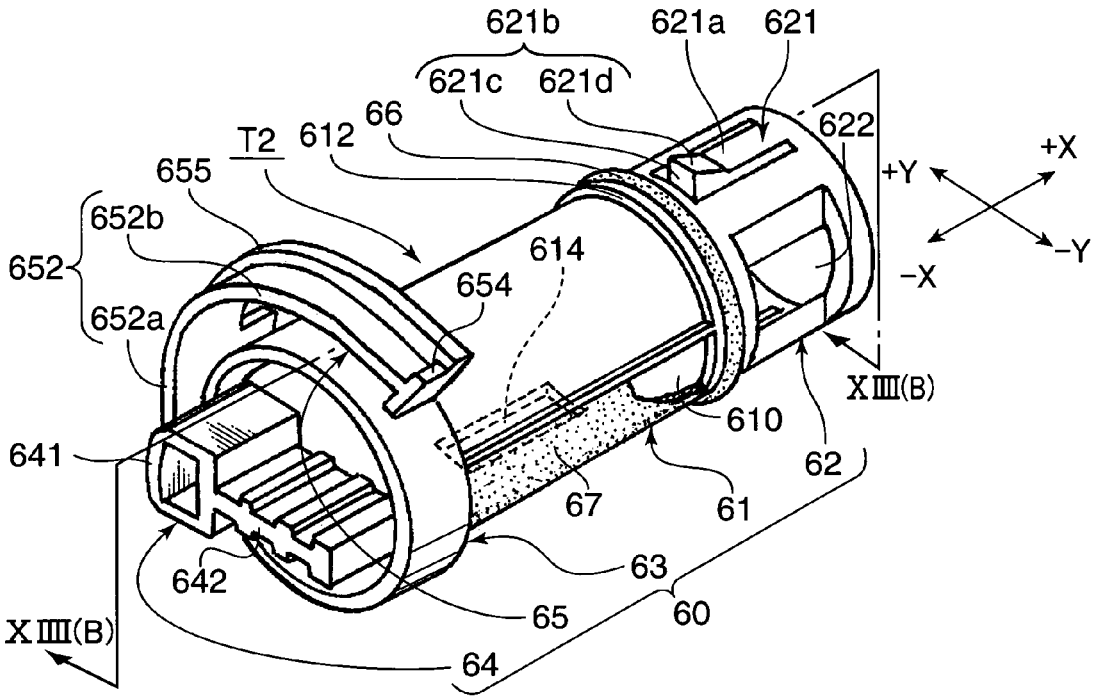
FIGS. 13A and 13B are perspective views each illustrating a state where the shutter cylinder is in an open position.
Figure 13B:
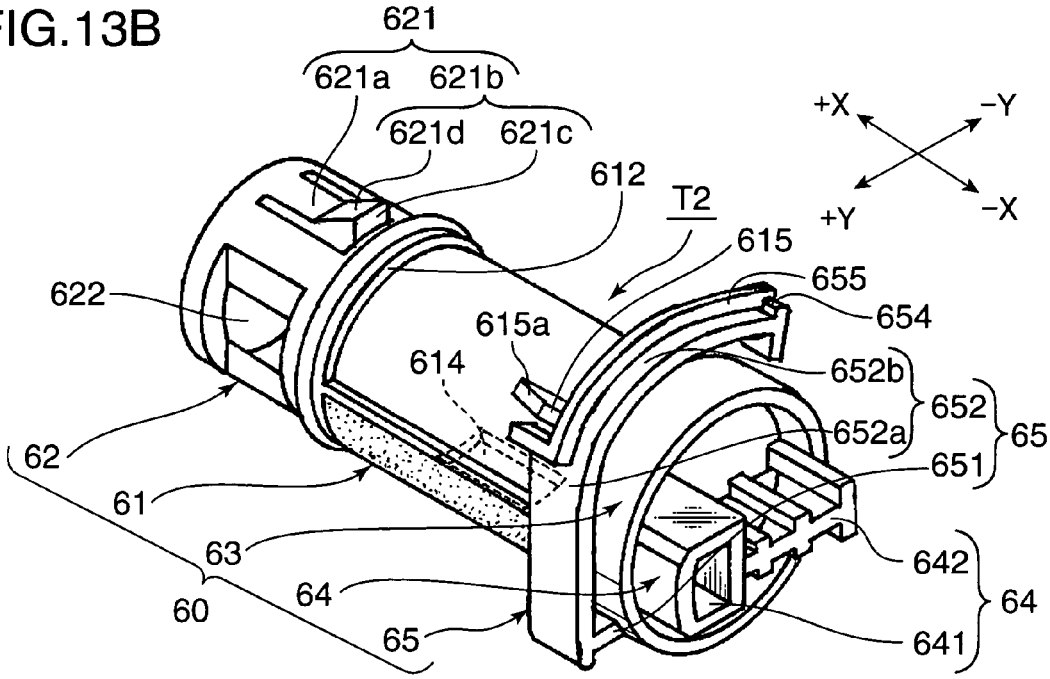

A shutter cylinder 60 will now be described with reference to FIG. 4 and FIGS. 12A through 15 and other drawings as necessary. FIGS. 12A through 13B are partially cut perspective views illustrating the shutter cylinder 60. FIGS. 12A and 12B illustrate the shutter cylinder 60 in a closed position T1. FIGS. 13A and 13B illustrate the shutter cylinder 60 in an open position T2. FIGS. 12A and 13A are views of the shutter cylinder from a left front direction, and FIGS. 12B and 13B are views of the shutter cylinder from a left rear direction.

Figure 14A:
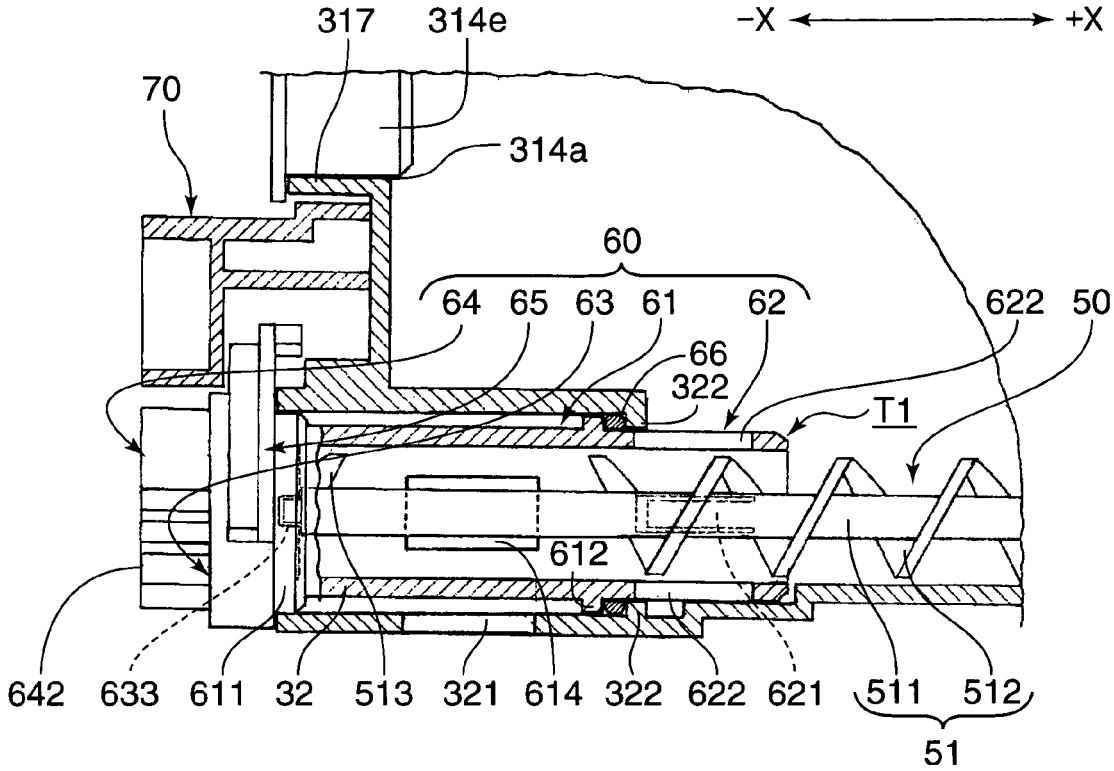
FIG. 14A is a cross sectional view of the shutter cylinder taken along line XIIII(A)-XIIII(A) in FIG. 12A.
Figure 14B:
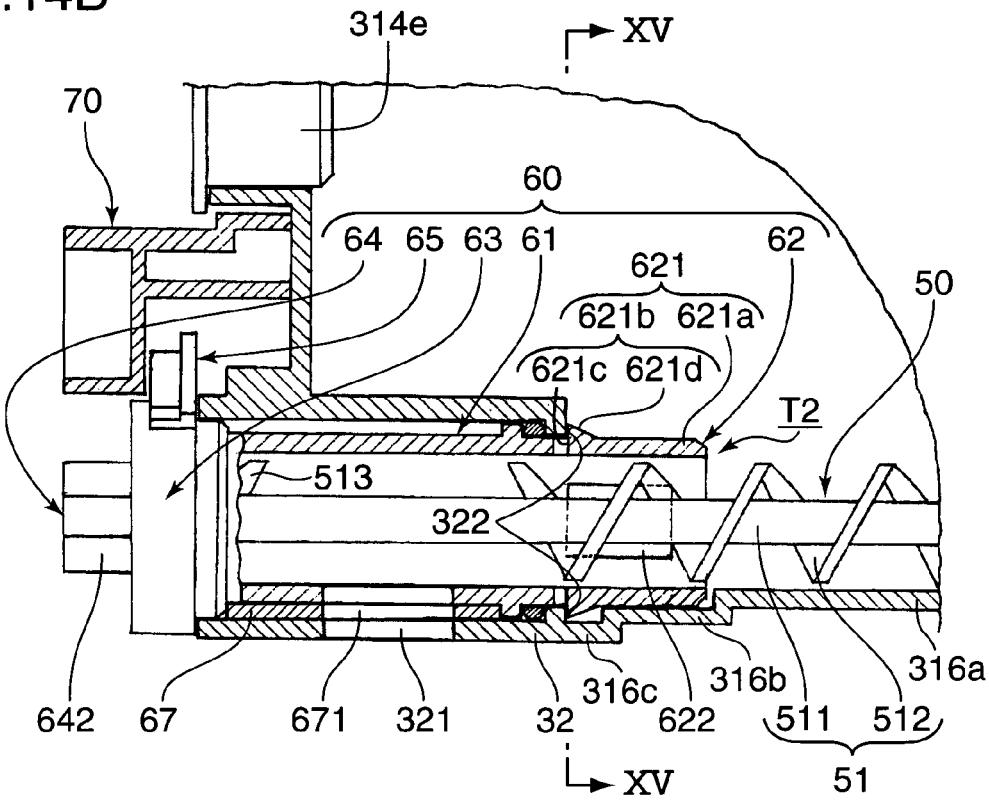
FIG. 14B is a cross sectional view of the shutter cylinder taken along line XIIII(B)-XIIII(B) in FIG. 13A.
Figure 15:
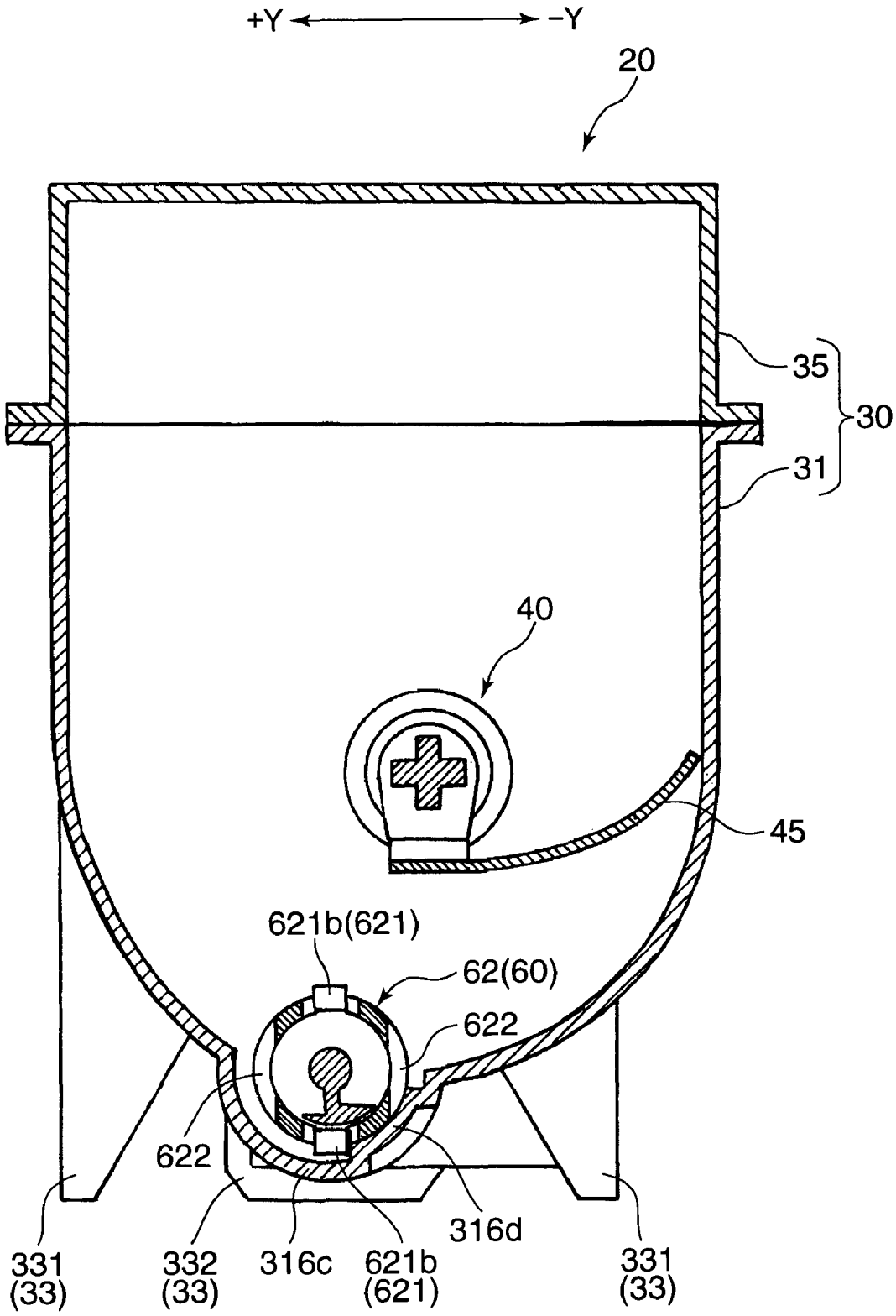
FIG. 15 is a cross sectional view of the shutter cylinder taken along line XV-XV in FIG. 14B.

FIG. 14A is a cross sectional view of the shutter cylinder taken along line XIIII(A)-XIIII(A) in FIG. 12A. FIG. 14B is a cross sectional view of the shutter cylinder taken along line XIIII(B)-XIIII(B) in FIG. 13A. FIG. 15 is a cross sectional view of the shutter cylinder taken along line XV-XV in FIG. 14B. In FIGS. 14A, 14B, and 15, adjacent members such as the shutter installation cylinder 32 and the toner conveyance screw 51 and the like are also illustrated. Directional indication by X and Y in FIGS. 12A to 15 is identical to those in FIGS. 1A and 1B, namely, X indicates a widthwise direction (−X: leftward, +X: rightward) and Y indicates a forward and backward direction (−Y: forward, +Y: backward).

The shutter cylinder 60 includes a cylindrical body and is rotated around the cylinder axis in a clockwise direction and a counterclockwise direction. The shutter cylinder 60 is installed in the shutter installation cylinder 32 (FIG. 4) of the container main body 31, thereby allowing the shutter cylinder to change its position between the open position T2 to replenish the developing device 122 of FIG. 3 with toner conveyed by the conveying member 50, and the closed position T1 disabling the replenishing operation. The left end of the screw shaft 511 of the toner conveyance screw 51 is supported by the shutter cylinder 60 concentrically and relatively rotatable around the shaft center while the shutter cylinder 60 is fit into the shutter installation cylinder 32 as shown in FIG. 7.

The shutter cylinder 60 includes a shutter cylinder body 61, a cylindrical retaining body (cylindrical leading portion) 62, a circular closure 63, an operating portion 64, a locking member 65, and a ring-shaped seal (annular sealing member) 66. The shutter cylinder body 61 has a cylindrical body to be inserted into the shutter cylinder 32 of the container main body 31. The cylindrical retaining body 62, extended concentrically rightward from a leading end (right end) of the shutter cylinder body 61, is a member for retaining the shutter cylinder body 61 in the shutter installation cylinder 32. The circular closure 63 is provided at a base end (left end) of the shutter cylinder body 61 and has a diameter larger than that of the shutter cylinder body 61. The operating portion 64, extending from a left end surface of the circular closure 63 to the left, is a member for rotating the shutter cylinder body 61. The locking member 65, projecting from a peripheral surface of the circular closure 63, is a member for locking a setting position such as closed position T1 or the open position T2 of the shutter cylinder 60. The ring-shaped seal 66 is an elastic sealing member fit into a periphery between the shutter cylinder body 61 and the cylindrical retaining body 62.

On the other hand, the shutter installation cylinder 32 is given a slightly longer length in its widthwise direction than a length of the shutter cylinder body 61 as shown in FIGS. 14A and 14B. The shutter cylinder 60 is inserted into the shutter installation cylinder 32 from a left end opening of the shutter installation cylinder 32 and then the circular closure 63 is fixedly attached to the left edge of the shutter installation cylinder 32. In the above insertion state, the shutter cylinder body 61 is housed within the shutter installation cylinder 32, and the cylindrical retaining body 62 projects rightward from the shutter installation cylinder 32 to be positioned in the toner conveying space Z1 of the container main body 31.

The shutter installation cylinder 32 is given an inner diameter slightly larger than the outer diameter of the shutter cylinder body 61. Also, a leading end (right end) of the shutter installation cylinder 32 is provided with an annular projection (first engagement portion) 322 concentrically projecting to the interior. An interior peripheral surface of this annular projection 322 is able to come into sliding contact with an exterior peripheral surface of the cylindrical retaining body 62.

The shutter cylinder body 61 is given an inner diameter slightly larger than the outer diameter of the agitating fin 512 such that the agitating fin 512 can be inserted into the shutter cylinder body 61. A base end (left end) of the shutter cylinder body 61 is concentrically provided with a base end flange 611. A leading end (right end) of the shutter cylinder body is provided with a leading end flange 612. The flanges 611 and 612 have outer diameters such that an outer peripheral surface thereof slidably contacts an inner peripheral surface of the shutter installation cylinder 32.

A peripheral surface of the shutter cylinder body 61 is provided with a pair of ribs 613 bridged between the flange 611 and the flange 612 at point-wise symmetric positions with regard to the cylinder axis. One peripheral surface of the shutter cylinder body 61 between a pair of ribs 613 includes a toner discharge opening 614 at a central position of the shutter cylinder body which extends in a widthwise direction and has a rectangular shape when viewed from a radial direction.

One side (reduced portion) 610 of the shutter cylinder body 61 including the toner discharge opening 614 is provided with a sponge-like seal pad 67 adhered thereto. The seal pad 67 may be made of any synthetic resin-made foam. Specifically, a suitable example of the sealing pad includes a high density microcell urethane sheet. Such a seal pad 67 is provided with a corner hole 671 of the same shape as the toner discharge opening 614 and at a position corresponding to the toner discharge opening.

On the other hand, the shutter installation cylinder 32 is formed with a toner discharge hole 321 at a position opposite to the toner discharge opening 614. Therefore, the toner within the shutter cylinder body 61 is replenished into the developing device 122 through the toner discharge opening 614, the corner hole 671, and the toner discharge portion 321 by a driving force of the conveying member 50 such that the toner is prevented from leaking to the outside by the seal pad 67 when the shutter cylinder 60 is set to an open position T2.

A peripheral surface of the shutter cylinder body 61, namely, a peripheral surface opposite to a peripheral surface including the toner discharge opening 614, is provided with a guide rib 615 extending rightward from the base end flange 611. This guide rib 615 is provided in order to make it easy to insert the shutter cylinder 60 into the shutter installation cylinder 32. The guide rib 615 is given a length in the widthwise direction equal to or less than a half of a length of the shutter cylinder body 61 and a thickness in a radial direction slightly smaller than a thickness of the base end flange 611.

A leading end (right end) of the guide rib 615 is provided with an inclined surface 615*a* inclining to a peripheral surface of the shutter cylinder body 61. Therefore, when the shutter cylinder 60 is inserted into the shutter installation cylinder 32, the inclined surface 615*a* of the guide rib 615 contacts a left edge of the shutter installation cylinder 32, thereafter to be raised with respect to the inclined surface 615*a*. As such, upon assembling, the shutter cylinder 60 can be inserted into the shutter installation cylinder 32 smoothly without the base end flange 611 interfering with a left edge of the shutter installation cylinder 32. As a result thereof, ease of assembly of the shutter cylinder 60 with respect to the shutter installation cylinder 32 can be improved.

The cylindrical retaining body 62 is provided with a pair of engaging claw portions 621 formed such that portions of the peripheral surface opposite to each other are cut into a U-shape, and is formed with a pair of spill holes 622 such that they are opposite to the pair of engaging claw portions 621 with a phase shift of 90 degrees.

The engaging claw portion 621 prevents a movement of the screw shaft 511 in its axial direction when the shutter cylinder 60 is inserted into the shutter installation cylinder 32 from a left surface opening, and more specifically, it prevents the screw shaft from dropping off to the left. The engaging claw portion 621 also regulates rotation around the cylinder axis beyond a predetermined range, and more specifically, it allows the shutter member 60 to rotate only between the closed position T1 and the open position T2.

The engaging claw portion 621 includes a claw main body 621*a* projecting from a right end of the cylindrical retaining body 62 to the space cut into the U-shape, and an engaging claw 621*b* projecting outward from a leading end (left end) of this claw main body 621*a*. The claw main body 621*a* projects outward from the ring-shaped seal 66. The engaging claw 621*b* includes an orthogonal surface 621*c* that is orthogonal to the cylinder axis, and an inclined surface 621*d* that inclines toward the claw main body 621*a* from the outermost side of this orthogonal surface 621*c*.

When the shutter cylinder 60 is inserted into the shutter installation cylinder 32, the inclined surface 621*d* of the engaging claw portion 621 contacts the annular projection 322 after a right end of the cylindrical retaining body 62 passes the annular projection 322 of the shutter installation cylinder 32. This contact guides and elastically presses down the engaging claw portion 621 in the axial direction such that the engaging claw 621*b* can pass through the annular projection 322.

Then, the engaging claw portion 621 recovers to an original shape when the engaging claw 621*b* passes the annular projection 322. Accordingly, the orthogonal surface 621*c* of the engaging claw 621*b* comes to be opposite to the annular projection 322, such that the shutter cylinder 60 is prevented from dropping off to the left.

On the other hand, a bottom of the container main body 31 is provided with a small arc-shaped trough 316*b* (FIG. 6) between the arc-shaped projection 316*a* and the shutter installation cylinder 32, and a large arc-shaped trough 316*c* bridged between a left edge of the small arc-shaped trough 316*b* and a right edge of the shutter installation cylinder 32.

The small arc-shaped trough 316*b* is given a curvature radius of an inner surface slightly larger than a radius of an outer surface of the cylindrical retaining body 62 and thereby the cylindrical retaining body 62 slidably rotates together with the small arc-shaped trough 316*b*. Also, the large arc-shaped trough 316*c* is given a curvature radius of the inner surface that is slightly larger than a curvature radius of an inner surface of the small arc-shaped trough 316*b* and is such that interference is avoided with a leading end of the engaging claw 621*b* of the cylindrical retaining body 62 in the radial direction as shown in FIG. 14B.

The large arc-shaped trough 316*c* includes an arc-like projecting portion 316*d* which is a recessed part of the large arc-shaped trough 316*c* at a position forward from center, thereby allowing the part of the large arc-shaped trough to project inward. This arc-like projecting portion 316*d* is given a curvature radius of an interior surface smaller than a distance between a shaft center of the screw shaft 511 and a leading end of the engaging claw 621*b*. Therefore, the shutter cylinder 60 can rotate around the cylinder axis in a range between a position where either one of the pair of engaging claws 621*b* contacts and thus is stopped by the arc-like projecting portion 316*d*, and a position where the remaining one of the pair of engaging claws comes into contact likewise comes into contact with and is stopped by the arc-like projecting portion 316*d*. FIG. 15 illustrates the lower engaging claw 621*b* contacting and thus being stopped by a lower edge of the arc-like projecting portion 316*d*. Accordingly, a rotatable range of the shutter cylinder 60 is limited and thereby rotation in a range other than this rotatable range is prevented.

As shown in FIG. 15, the shutter cylinder 60 is set in the open position T2 so that the lower engaging claw 621*b* comes into contact with and thus is stopped by the lower end of the arc-like projecting portion 316*d*. The shutter cylinder 60 in the above state can be rotated in a clockwise direction around the cylinder axis until the shutter cylinder 60 changes to the closed position T1 whereby the upper engaging claw 621*b* comes into contact with and is stopped by an upper end of the arc-like projecting portion 316*d*.

The spill holes 622 are adapted for allowing toner into the toner charging chamber Z when the toner within the toner charging chamber Z is fed to the shutter cylinder 60 by the driving force of the conveying member 50, for example, with the shutter cylinder 60 in the closed position T1. With this structure, the toner fed to the shutter cylinder 60 is prevented from clotting.

The circular closure 63 is provided for closing a left end surface of the shutter cylinder body 61. The circular closure 63 includes a closing disc 631 and an annular member 632. The closing disc 631 is concentric with the axis of the shutter cylinder body 61, secured to a left end of the shutter cylinder body 61, and has a diameter larger than that of the shutter cylinder body 61. The annular member 632 is integrally attached with a peripheral surface of the closing disc 631 with the annular member projecting to the left from the closing disc 631.

At a central position of a right surface of the closing disc 631, there is provided a shaft supporting hole (bearing within the shutter cylinder) 633 in a recessed manner as shown in FIG. 14A. The shaft supporting hole 633 receives a left end of the screw shaft 511 in order to support the screw shaft 511 of the toner conveyance screw 51.

In other words, when the toner conveyance screw 51 is placed in the toner conveying space Z1 within the container main body 31 and a left end of the toner conveyance screw is inserted into the shutter installation cylinder 32, a left end of the screw shaft 511 is fit into the shaft supporting hole 633. Accordingly, the toner conveyance screw 51 is mounted in the toner convey space Z1 within the container main body 31 in an integrally rotatable manner around the screw shaft 511.

The operation portion 64 is provided for rotating the shutter cylinder 60 and projects leftward from the closing disc 631 of the circular closure. The operating portion 64 includes a hollow rectangle member 641 and an operation lever 642. The operating portion 64 has a hollow rectangle shape in an end surface view and projects to the left from the annular member 632 while upper corners comes into contact with the inner peripheral surface of the annular member 632. The operation lever 642 is provided to allow the user to operate by fingers of a hand and extends in a radial direction of the annular member 632 from a lower surface of the hollow rectangle member 641.

The hollow rectangle member 641 and the operation lever 642 include a not-shown holder cover having a shape suitable for grasping and operating. Rotation of the shutter cylinder 60 is actually performed by this holder cover; however, the following description is worded such that the rotation of the shutter cylinder 60 is actuated by operation of the operation lever 642.

In the present embodiment, the hollow rectangle member 641 is positioned at the uppermost position of the closing disc 631, and the operation lever 642 hangs down from the hollow rectangle member 641 when the shutter cylinder 60 is set to the closed position T1 (FIGS. 12A and 12B). The shutter cylinder 60 in the closed position T1 as recited above is changed to the open position by rotating the operation lever 642 in a counterclockwise direction by about 90 degrees (see FIGS. 13A and 13B).

The locking member 65 is provided for locking the shutter cylinder 60 in the closed position T1 or in the open position T2 in a positional relation with the covering cap 70. The locking member 65 includes a projecting portion 651 projecting from an outer peripheral surface of the annular member 632 of the circular closure 63, and an elastically deformable arc-like operation member 652 which is formed into an arc-like shape and extends from a leading end of the projecting portion 651 in a clockwise direction in FIG. 12A In the example here, the projecting portion 651 is provided at the upper rear of the annular member 632 and the arc-shaped operation member 652 is given a central angle of curvature of 90 degrees such that the shutter cylinder 60 is set to the closed position T1 (FIGS. 12A and 12B).

The arc-like operation member 652 includes a wide portion 652*a* extending from the projecting portion 651 in a clockwise direction a predetermined distance slightly shorter than half of an entire length. A narrow portion 652*b* is formed in front of this wide portion 652*a* by notching the right edge over its entire length. A leading end of the narrow portion 652*b* is provided with a engagement portion 654 arranged such that it crosses the arc-like operation member 652. The engagement portion 654 projects toward an opposite and outer side of a center of curvature of the arc-like operation member 652.

An outer surface of the arc-like operation member 652 is provided with a reinforcing rib 655 which extends throughout an entire length of the narrow portion 652*b* starting from a position slightly offset from the interface between the wide portion 652*a* and the narrow portion 652*b* in the direction of the wide portion 652*a*. The arc-like operation member 652 is structurally reinforced by this reinforcing rib 655. A locking effect of a locking member 65 and its relation to the covering cap 70 will be described later together with that of the covering cap 70.

The ring-shaped seal 66 prevents toner within the toner charging chamber Z of the container main body 31 from intruding into a space between an inner peripheral surface of the shutter installation cylinder 32 and an outer peripheral surface of the shutter cylinder body 61 when the shutter cylinder 60 is inserted into the shutter installation cylinder 32. The ring-shaped seal 66 is made of an elastomer material such as a rubber material or a soft synthetic resin material (elastic material).

The ring-shaped seal 66 is given an inner diameter slightly smaller than an outer diameter of the cylindrical retaining body 62 and an outer diameter slightly larger than an inner diameter of the shutter installation cylinder 32. The ring-shaped seal 66 is fit into a base end of the cylindrical retaining body 62 of the shutter cylinder 60 such that it comes into contact with the leading end flange 612 as shown in FIGS. 14A and 14B.

The ring-shaped seal 66 is held between the leading end flange 612 of the shutter cylinder 60 and the annular projection 322 of the shutter installation cylinder 32 with the ring-shaped seal kept compressed and elastically deformed when the shutter cylinder 60 is inserted into the shutter installation cylinder 32. Accordingly, the toner within the toner charging chamber Z of the container 30 is prevented from intruding into a space between an outer peripheral surface of the shutter cylinder body 61 and an inner peripheral surface of the shutter installation cylinder 32.

Figure 16:
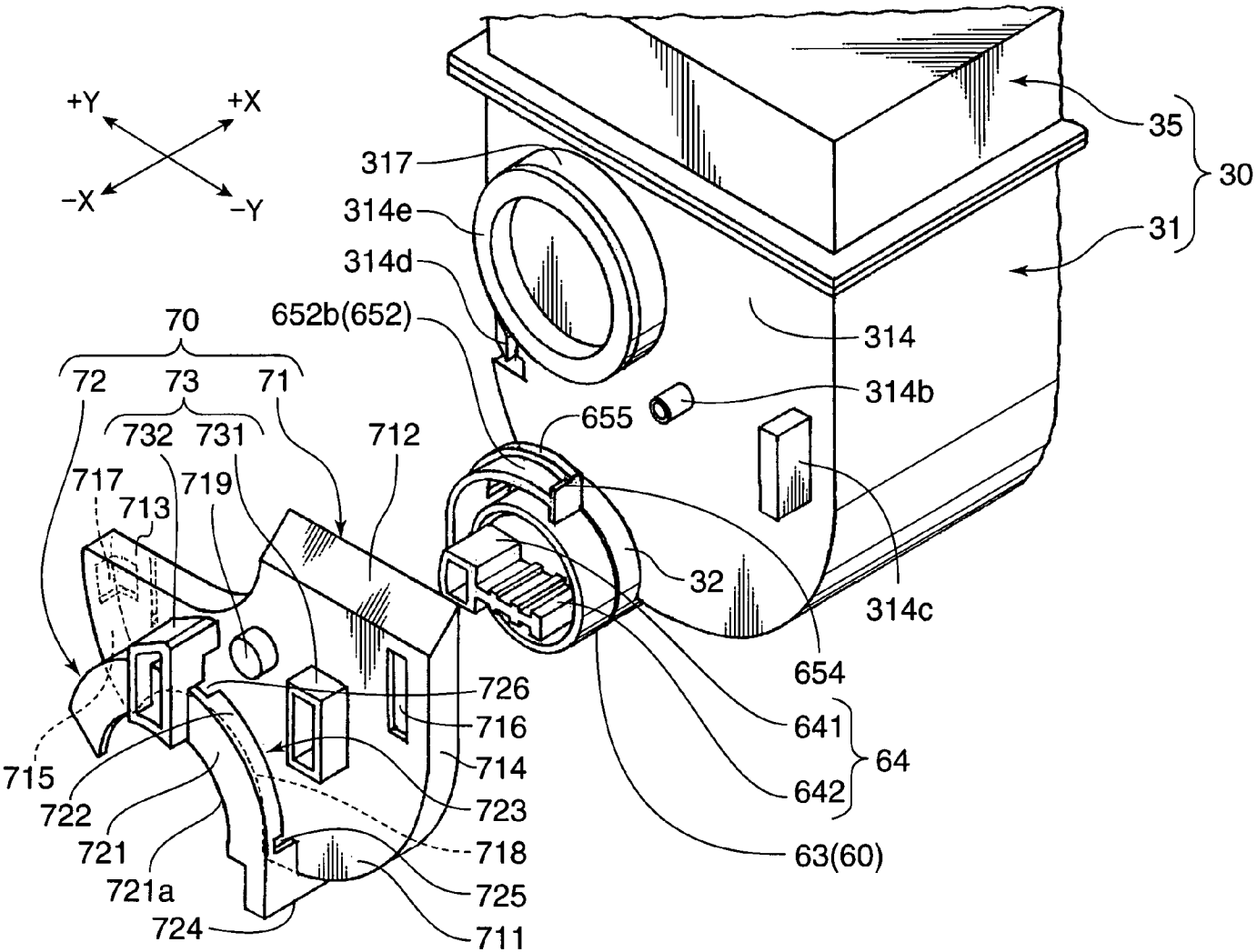
FIG. 16 is a perspective view illustrating a covering cap immediately before being mounted onto a left portion.
Figure 17:
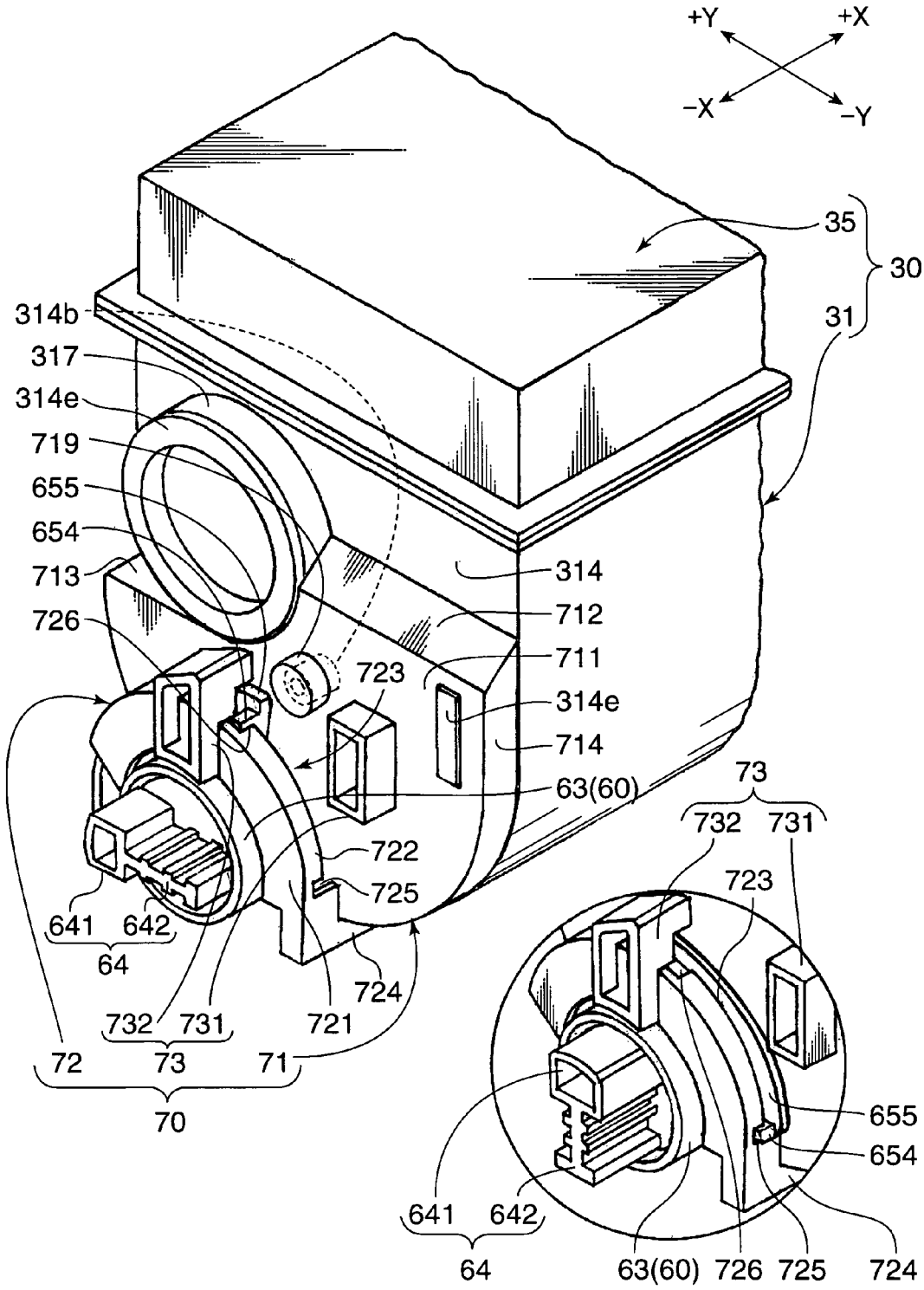
FIG. 17 is a perspective view illustrating the covering cap mounted onto the left portion, in which the shutter cylinder is in the open position. The shutter cylinder is illustrated in the closed position in the circle.

The covering cap 70 illustrated in FIG. 4 is mounted to the left portion 314 of the container main body 31 after the shutter cylinder 60 having the above described structure is inserted into the shutter installation cylinder 32. FIGS. 16 and 17 are perspective views illustrating the covering cap 70. FIG. 16 illustrates a configuration immediately before the covering cap 70 is mounted to the left portion 314, and FIG. 17 illustrates the covering cap 70 mounted to the left portion 314 and the shutter cylinder 60 set to the open position T2. The circle in FIG. 17 illustrates the shutter cylinder set to the open position T2. Indication of directions by X and Y in FIGS. 16 and 17 are identical to those in FIGS. 1A and 1B, namely, X represents a widthwise direction (−X: leftward, +X: rightward) and Y represents a forward and backward direction (−Y: forward, +Y: backward).

As shown in FIG. 16, the covering cap 70 includes: a cover main body 71 having a shape extending along a lower half of the left portion 314 of the container main body 31; a cylinder cover 72 projecting to the left in a lower position slightly to the rear of the center of the cover main body 71 in the forward axial direction; and a projecting portion 73 projecting to the left from a front of the cover main body 71. The projecting portion 73 includes a swing prevention projection (swing prevention portion) 731 provided at a front position of a half-moon shaped member 711, which will be described below, and a central projection 732 formed on the cylinder cover 72 at a substantially central position of the half-moon shaped member 711.

The forward swing prevention projection 731 is a linear projection extending in the mounting direction of the toner container 20 onto the container accommodation chamber Q. The forward swing prevention projection 731 engages with a not-shown retaining member provided on a side wall opposing the forward swing prevention projection 731 of the apparatus main body 11 when the container 30 is mounted to the partition 18 of the container accommodation chamber Q of the apparatus main body 11. Accordingly, the toner container 20 is prevented from swinging by the driving force of the toner conveyance screw 51.

The cover main body 71 includes: the half-moon shaped member 711 in which its lower portion forms a half-moon shape so as to conform to a shape of a lower portion of the left portion 314 of the container main body 31 excluding a certain portion where the cylinder cover 72 is provided; an upward inclining edge portion 712 extending obliquely upward from a leading edge of the substantially front half portion of the half-moon shaped member 711; an upper curved edge portion 713 extending from a leading edge of the about the substantially rear half portion of the half-moon shaped member 711; a front arc-shaped edge portion 714 extending to the right from an arc-shaped edge portion located forward of the half-moon shaped member 711; and a rear arc-shaped edge portion 715 extending to the right from an arc-shaped edge portion located to the rear of the half-moon shaped member 711.

A leading portion of a rear portion of the half-moon shaped member 711 is provided with a notch along an outer periphery of the toner charging cylinder 317 in order to avoid interference with the toner charging cylinder 317 which encloses the toner charging hole 314*a* of the container main body 31. The upward curved edge portion 713 is formed into an arc-shape so as to conform with this notch.

An upper front of the half-moon shaped member 711 is formed with a retaining hole 716. The retaining hole 716 receives the retaining projection 314*c* provided on the left portion 314 of the container main body 31, and thus is positioned corresponding to the retaining projection 314*c*. Also, a corner where the rear of the half-moon shaped member 711 mates with the rear arc-shaped edge portion 715 has a square hole 717 for receiving the engaging claw portion 314*d* provided on the left portion 314.

At a lower and slightly backward position of the half-moon shaped member 711, further, there is provided an arc-shaped recessed portion 718 for mating the half-moon shaped member 711 with the shutter installation cylinder 32 from above. Additionally, a sheath cylinder 719 for receiving the shaft supporting cylinder 314*b* (FIG. 4) projecting to the left from the left portion 314 is formed at substantially the center of the half-moon shaped member 711.

This sheath cylinder 719 is open at an interior side (right side) but is closed at an exterior side (left side), resulting in forming a so-called dead-end cylinder. The shaft supporting cylinder 314*b* has a through-hole into which the shaft member 41 of the agitator 40 is inserted, whereas the sheath cylinder 719 serves as a cap for sealing this through-hole. An inner diameter of the sheath cylinder 719 is such that it can be slidably fit onto the shaft supporting cylinder 314*b*. When the covering cap 70 is mounted onto the left portion 314 of the container main body 31, the sheath cylinder 719 is fit onto the shaft supporting cylinder 314*b* in a sealing manner as shown in FIG. 17. Accordingly, the toner within the container main body 31 is prevented from leaking to the outside through the through-hole of the shaft supporting cylinder 314*b*.

Thus, the engaging claw portion 314*d* is mounted into the square hole 717 and secured thereto when the retaining hole 716 is fit to the left portion 314, whereby the covering cap 70 is latched on the container main body 31.

The cylinder cover 72 is provided for covering the shutter cylinder 60 after the covering cap 70 is mounted to the container main body 31. Such a cylinder cover 72 includes a crescent portion 721 of a crescent shape, and a periphery portion 722 formed so as to conform to an outer peripheral edge of curvature of the arc-like crescent portion 721. The periphery portion 722 is secured at its base edge to an edge of the arc-shaped recessed portion 718 of the half-moon shaped member 711.

In the arc-like crescent portion 721, a center of curvature is concentric with an axis of the circular closure 63 of the shutter cylinder 60, and there is included an inner arc-like edge 721*a* having a curvature radius slightly larger than an outer diameter of the circular closure 63. Therefore, when the covering cap 70 is mounted to the left portion 314 of the container main body 31 while the shutter cylinder 60 is inserted into the shutter installation cylinder 32, an outer peripheral surface of the circular closure 63 will be opposed to an inner peripheral edge of the inner arc-like edge 721*a*.

The periphery portion 722 is provided such that its interior surface slidably comes into contact with the arc-like operation member 652 of the shutter cylinder 60. There is formed a guide groove 723 between the periphery portion 722 and the arc-shaped bottom portion 311 of the container main body 31. The guide groove 723 receives the reinforcing rib 655 provided on the arc-like operation member 652 of the shutter cylinder 60. The reinforcing rib 655 is given a thickness in a radial direction such that an outer peripheral surface of the reinforcing rib 655 projects slightly outward from the guide groove 723 when engaged with the guide groove 723.

An end of the guide groove 723 in a clockwise direction in FIG. 16 is provided with a securing portion 724 for securing the cylinder cover 72 to the cover main body 71. In the shutter cylinder 60, a leading end of the reinforcing rib 655 interferes with the securing portion 724, thereby restricting further rotation of the shutter cylinder in a clockwise direction.

A position corresponding to an end of the guide groove 723 in its clockwise direction in the periphery portion 722 is provided with a first retaining groove 725 which is notched to the left in a recessed manner. Also, a position adjacent to the front of a central swing prevention projection 732 in the guide groove 723 is provided with a second retaining groove 726 which is formed such that the periphery portion 722 is notched to the left. The first retaining groove 725 is provided for engaging therewith an engagement portion 654 of the arc-like operation member 652 when the shutter cylinder 60 is set to the closed position T1. The second retaining groove 726 is provided for engaging therewith the engagement portion 654 when the shutter cylinder 60 is set to the open position T2.

Therefore, when the covering cap 70 is attached to the container main body 31 to which the shutter cylinder 60 is mounted, the shutter cylinder 60 rotates in a forward and backward direction around the cylinder axis such that the reinforcing rib 655 slides in the guide groove 723 by an operation of the operation lever 642, and such that the engagement portion 654 of the locking member 65 provided on the shutter cylinder 60 engages with the guide groove 723. Thus, the shutter cylinder 60 can change its position between the closed position T1 and the open position T2.

When the shutter cylinder 60 is set to the closed position T1, the engagement portion 654 engages the first retaining groove 725, thereby locking the shutter cylinder 60 at its closed position T1. Also, when the shutter cylinder 60 is set to the open position T2, the engagement portion 654 engages with the second retaining groove 726, thereby locking the shutter cylinder 60 at its open position T2.

Upon changing a position of the shutter cylinder 60, the user need only press the arc-like operation member 652 extending outward from the guide groove 723 in a direction of the guide groove 723. Then, the arc-like operation member 652 elastically deforms and thus the engagement portion 654 is released from the first retaining groove 725 or the second retaining groove 726, such that the shutter cylinder 60 becomes rotatable. At this time, if the operation lever 642 is operated, the position of the shutter cylinder 60 can be changed.

Figure 18A:
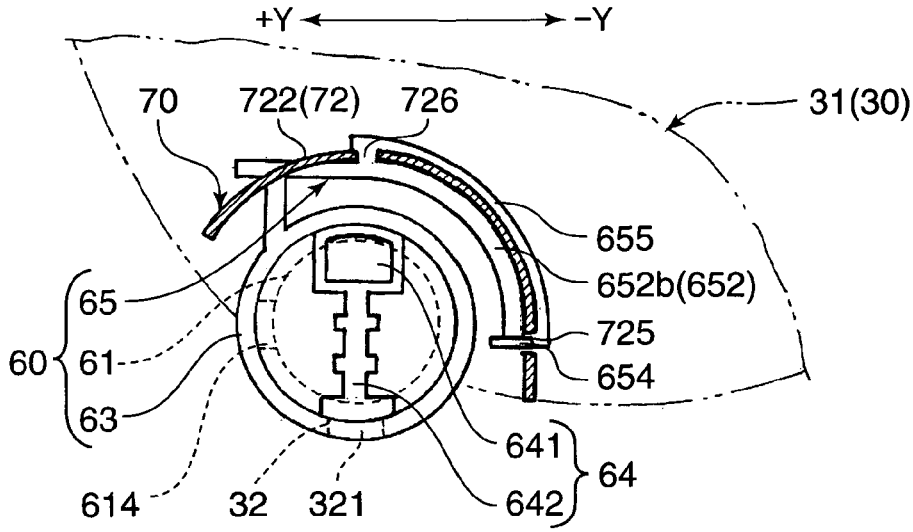
FIGS. 18A, 18B, and 18C are partial cross sectional views each illustrating the toner container viewed from the left to illustrate an operation of a locking mechanism of the shutter cylinder.
Figure 18B:
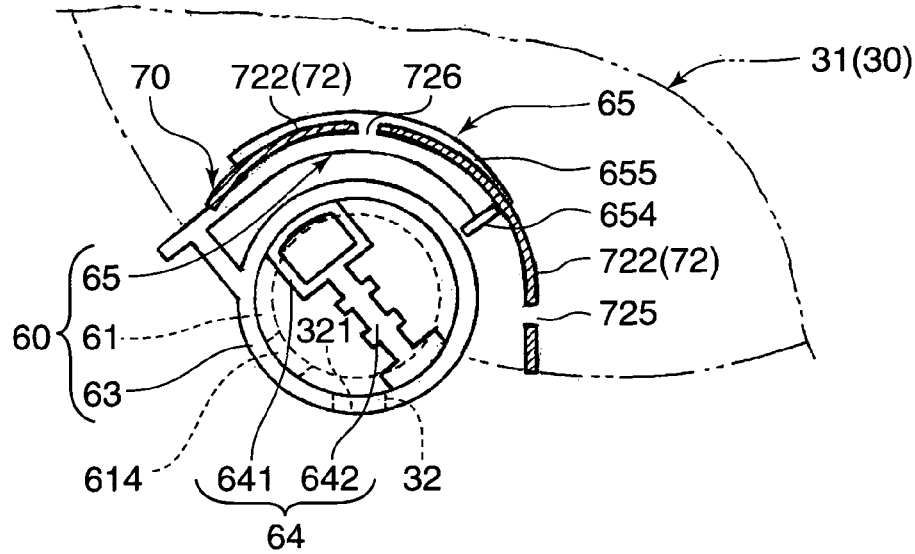
Figure 18C:
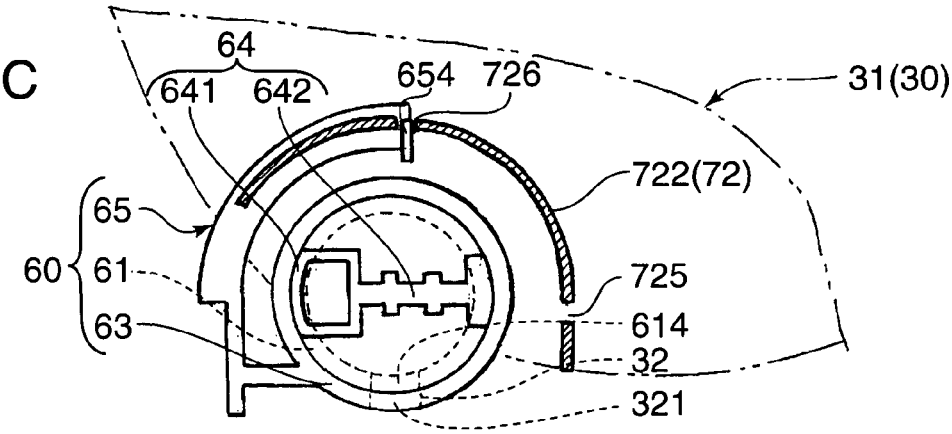

FIGS. 18A to 18C are partial cross sectional views of the toner container 20 in left side view, each illustrating an effect of a locking mechanism of the shutter cylinder 60. FIG. 18A illustrates the shutter cylinder 60 in the closed position T1. FIG. 18B illustrates the shutter cylinder 60 about to change its position from the closed position T1 to the open position T2.

FIG. 18C illustrates the shutter cylinder 60 changed to the open position T2. The forward and backward direction indicated by Y in FIGS. 18A to 18C is identical to that in FIGS. 1A and 1B (−Y: forward, +Y: backward).

As shown in FIG. 18A, when the shutter cylinder 60 is set to the closed position T1 corresponding to the configuration before the toner container 20 is installed in the printer 10, the toner discharge opening 614 of the shutter cylinder body 61 of the shutter cylinder 60 is oriented to the rear. Therefore, the toner within the container main body 31 will not be released through the toner discharge hole 321 of the shutter installation cylinder 32.

Also, in the above condition, the engagement portion 654 at a leading end of the locking member 65 provided on the shutter cylinder 60 fits into the first retaining groove 725 provided on the periphery portion 722 of the covering cap 70 to be retained therein. Thus, the shutter cylinder 60 is locked such that the closed position T1 of the shutter cylinder 60 becomes stable.

When the toner container 20 is mounted to the printer 10, the user operates the operation lever 642 in order to replenish the container 30 of the developing device 122 with toner. However, prior to this operation, the user presses the reinforcing rib 655 projecting outward from the guide groove 723 of the covering cap 70 in the axial direction of the shutter cylinder 60 (see FIG. 9). Accordingly, the arc-like operation member 652 is elastically deformed, resulting in the release of the engagement portion 654 from its locked configuration in the first retaining groove 725. As such the shutter cylinder 60 becomes rotatable around the cylinder axis.

The operation lever 642 is operated in a counterclockwise direction around the cylinder axis in this state, and the shutter cylinder 60 thereby rotates in a counterclockwise direction in such a manner that the engagement portion 654 comes into slide contact with an internal surface of the periphery portion 722 as shown in FIG. 18B.

When the shutter cylinder 60 rotates by about 90 degrees, the toner discharge opening 614 of the shutter cylinder 60 is changed to the open position T2 which corresponds to the toner discharge hole 321 of the shutter installation cylinder 32 as shown in FIG. 18C. Then, the inside of the toner charging chamber Z of the toner container 20 connects to the developing device 122 through the toner discharge opening 614 of the shutter cylinder 60 and the toner discharge portion 321 of the toner container 20. As such, the toner within the toner container 20 can be charged to the developing device 122.

When the shutter cylinder 60 is changed to the open position T2, the arc-like operation member 652 that is elastically deformed then recovers to the original shape and thus the engagement portion 654 of the shutter cylinder 60 fits into the second retaining groove 726 of the periphery portion 722. As such, the shutter cylinder 60 is locked to the open position T2.

When toner is consumed and thus the toner container 20 becomes empty, the toner container 20 is changed to a new toner container 20, and the shutter cylinder 60 which is set to the open position T2 is changed to the closed position T1 by means of the operation lever 642.

The reinforcing rib 655 is initially pressed to release the engagement portion 654 that is engaged with and retained by the second retaining groove 726 for unlocking. The operation lever 642 is continuously operated in the clockwise direction. This operation rotates the shutter cylinder 60 in the clockwise direction while the engagement portion 654 comes into slide contact with an interior surface of the periphery portion 722. When the shutter cylinder rotates by about 90 degrees, the shutter cylinder 60 changes its position to the closed position T1 and the engagement portion 654 fits into the first retaining groove 725, thereby locking the shutter cylinder 60 in the closed position.

Upon exchange of the toner container 20, even if an old toner container is removed from the printer 10 and handled for toner recovery, the leakage of toner from the toner container 20 is reliably prevented.

As described above, the toner container 20 according to the first embodiment is detachably mounted on the apparatus main body 11 of the printer 10 in order to charge toner to the developing device 122 that is built into the printer 10. The toner container 20 includes: the container 30 with the toner discharge hole 321; the toner conveyance screw 51 for conveying the toner within the container 30 toward the toner discharge hole 321; and the shutter cylinder having the peripheral wall formed with the toner discharge opening 614 at the position corresponding to the toner discharge hole 321. The toner conveyance screw 51 is rotatably supported at its one end by the shaft supporting hole 633 in the shutter cylinder 60, and the shutter cylinder 60 is mounted to the left portion 314 which is one of side walls of the container 30 in a rotation free manner.

When the toner container 20 is mounted to the apparatus main body 11 of the printer 10, the toner discharge opening 614 of the shutter cylinder 60 is set to a position corresponding to the toner discharge hole 321 of the container 30. Namely, the shutter cylinder 60 is set to the open position T2.

In this state, the shutter cylinder 60 is rotated around the cylinder axis to have the toner discharge opening 614 oppose to the toner discharge hole 321 of the container 30 to drive the toner conveyance screw 51 in this state, resulting in that the toner within the container 30 is conveyed by the toner conveyance screw 51 to reach the toner discharge opening 614. Then, the developing device 122 is replenished with toner through the toner discharge opening 614 and the toner discharge hole 321.

The toner conveyance screw 51 is rotatably supported at its one end by the bearing hole 633 in the shutter cylinder 60, and the shutter cylinder 60 is mounted to the left portion 314 of the container 30 in a rotation free manner. Therefore, it becomes possible to arrange the toner conveyance screw 51 throughout an entire length of the container 30, resulting in that a full amount of toner within the container 30 can be pushed away without having a dead region in the container 30.

Also, the shutter cylinder 60 is mounted to the left portion 314 of the container 30. As such, the toner conveyance screw 51 is rotatably supported by the opposed left portion 314. Therefore, a notably stable rotatably supporting state of the toner conveyance screw 51 is achieved.

Further, the shutter cylinder 60 is mounted to the left portion 314 of the container 30 in a rotation free manner. Therefore, after the toner conveyance screw 51 is installed into the container 30 through a predetermined installation hole formed in the left portion 314, the shutter cylinder 60 is inserted into the installation hole, whereby the toner conveyance screw 51 can be supported at its end by the shaft supporting hole 633 formed in the shutter cylinder 60. Therefore, the assembling operation of the toner conveyance screw 51 and the shutter cylinder 60 with respect to the container 30 is easier.

Furthermore, the shutter cylinder 60 has the ring seal 66 which is to be engaged with the outer periphery of the shutter cylinder 60. Therefore, the toner within the container 30 is advantageously prevented from leaking to the outside through the peripheral surface of the shutter cylinder 60. This also provides a reliable sealing property in comparison with a sealing method in which an area seal is placed on an end of the shutter cylinder 60.

Moreover, the left portion 314 of the container 30 is provided with a shutter installation cylinder 32 with the toner discharge hole 321 which communicates with the inside of the container 30, and the shutter cylinder 60 is inserted into the shutter installation cylinder 32 in a rotation free manner. Therefore, the shutter cylinder 60 can be stably installed to the left portion 314 of the container 30 since the shutter cylinder 60 is inserted into the shutter installation cylinder 32 provided on the left portion 314 of the container 30 in a rotation free manner.

There are provided an engaging claw 621*b* and an annular projection 322 (first engagement portion) in order to regulate a movement of the shutter cylinder 60 in an axial direction. Further, there are provided a stopper 654 and first and second retaining grooves 725, 726 (second engagement portions) in order to regulate a rotational movement of the shutter cylinder 60 around the shaft axis beyond the rotational range. Because the shutter cylinder 60 is inserted into the shutter installation cylinder 32, the engaging claw 621*b* is engaged with the annular projection 322, thereby making it to prevent the shutter cylinder 60 from dropping off the shutter installation cylinder 32. Also, the shutter cylinder 60, while it is installed in the shutter installation cylinder 32, is regulated of its rotational range since the stopper 654 interferes with either one of the first and the second retaining grooves 725, 726, such that the shutter cylinder 60 can be prevented from rotating beyond the rotational range.

One side surface 610 of the shutter cylinder 60 where the toner discharge opening 614 of the shutter portion 61 is formed is reduced in its diameter to form a reduced portion to which a sealing pad 67 is attached. Therefore, when toner within the container 30 is charged to the developing device 122, a sealing effect of the sealing pad 67 can prevent the toner from leaking to the outside through a space between the shutter cylinder 60 and the left portion 314 of the container 30.

The shutter cylinder 60 is integrally provided with a locking member 65 in order to lock the rotation of the shutter cylinder 60. Therefore, in both of the shutter cylinder 60 is in the open position T2 and in the closed position T1, the locking member 65 locks the rotation of the shutter cylinder 60 to place the open position T2 and the closed position T1 of the shutter cylinder 60 in a stable condition. Further, the locking member 65 is integrally provided on the shutter cylinder 60, such that the number of parts can be decreased.

Furthermore, the shutter cylinder 60 includes a base end flange 611 which comes into slide contact with the interior peripheral surface of the shutter installation cylinder 32 of the container 30, and further has a guide rib 615 extending downward in an installation direction of the shutter cylinder 60 into the shutter installation cylinder 32 from base end flange 611. Therefore, upon installation of the shutter cylinder 60 to the left portion 314 of the container 30, the shutter cylinder 60 is guided by the guide rib 615 extending downward in the installation direction to the left portion 314 while the shutter cylinder 60 is inserted into the left portion 314. Accordingly, the shutter cylinder 60 is smoothly inserted into the shutter installation cylinder 32 without the base flange 611 hitting an edge of the shutter installation cylinder 32. As such, the assembling operation of the shutter cylinder 60 to the shutter installation cylinder 32 can be improved.

The shutter cylinder 60 is formed with a spill hole 622 for getting the toner having been supplied into the shutter cylinder 60 away into the container 30. The toner having been supplied into the shutter cylinder 60 is partially discharged through the toner discharge opening 614 of the shutter cylinder 60 and the toner discharge hole 321 of the container 30, and the remaining toner is returned into the container 30 through the spill hole 622. Therefore, even if the toner is compressed into the shutter cylinder 60 by the toner conveyance screw 60, the toner is suppressed from clogging or clotting near the inlet of the shutter cylinder 60. As such, the toner can be pushed away in a stable manner over a long time period.

Second Embodiment

Figure 19:
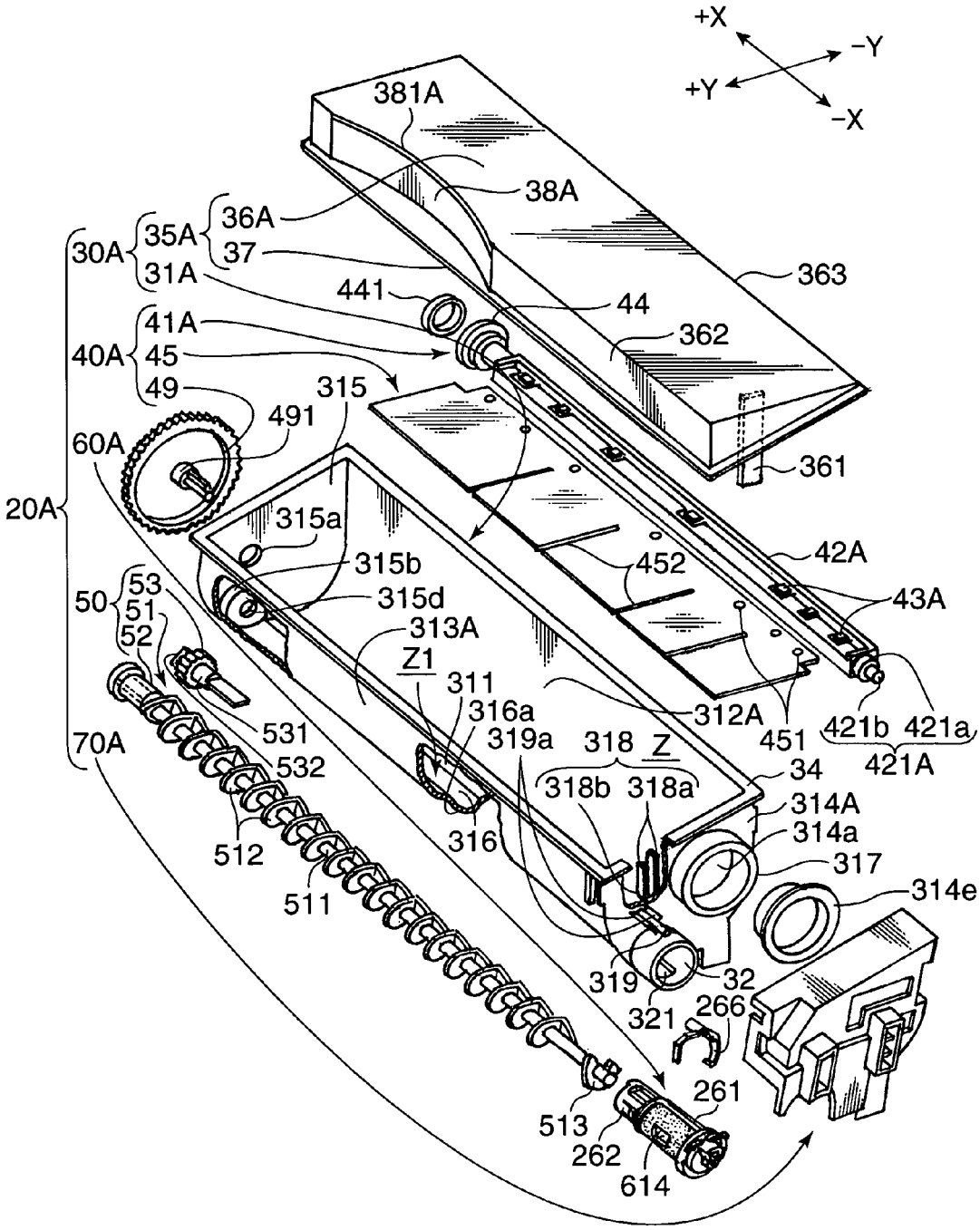
FIG. 19 is a partially cut exploded perspective view illustrating a toner container according to a second embodiment of the present invention.
Figure 20:
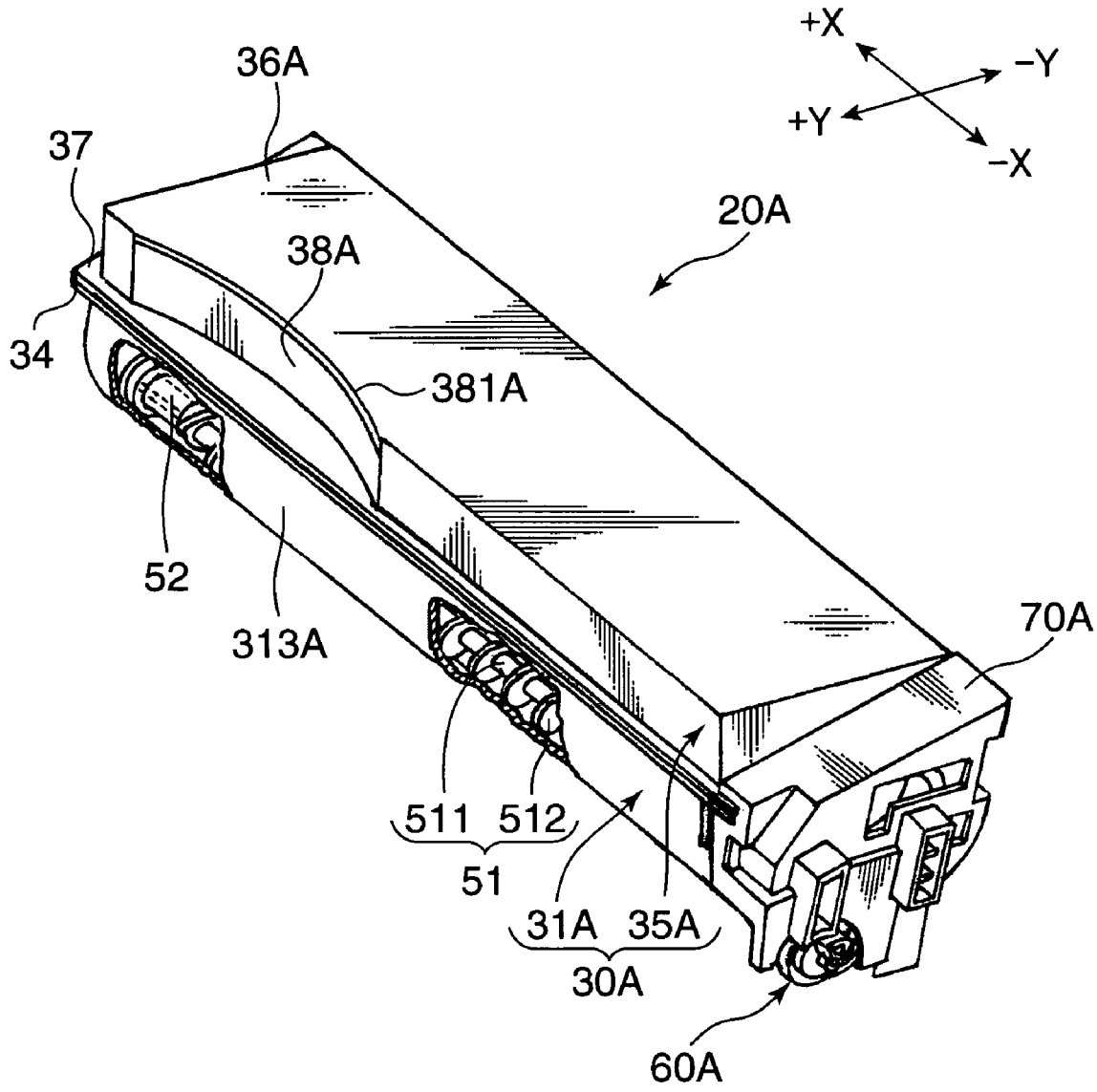
FIG. 20 is a partially cut perspective view illustrating an assembled toner container of FIG. 19 viewed from an obliquely upward front direction.
Figure 21:
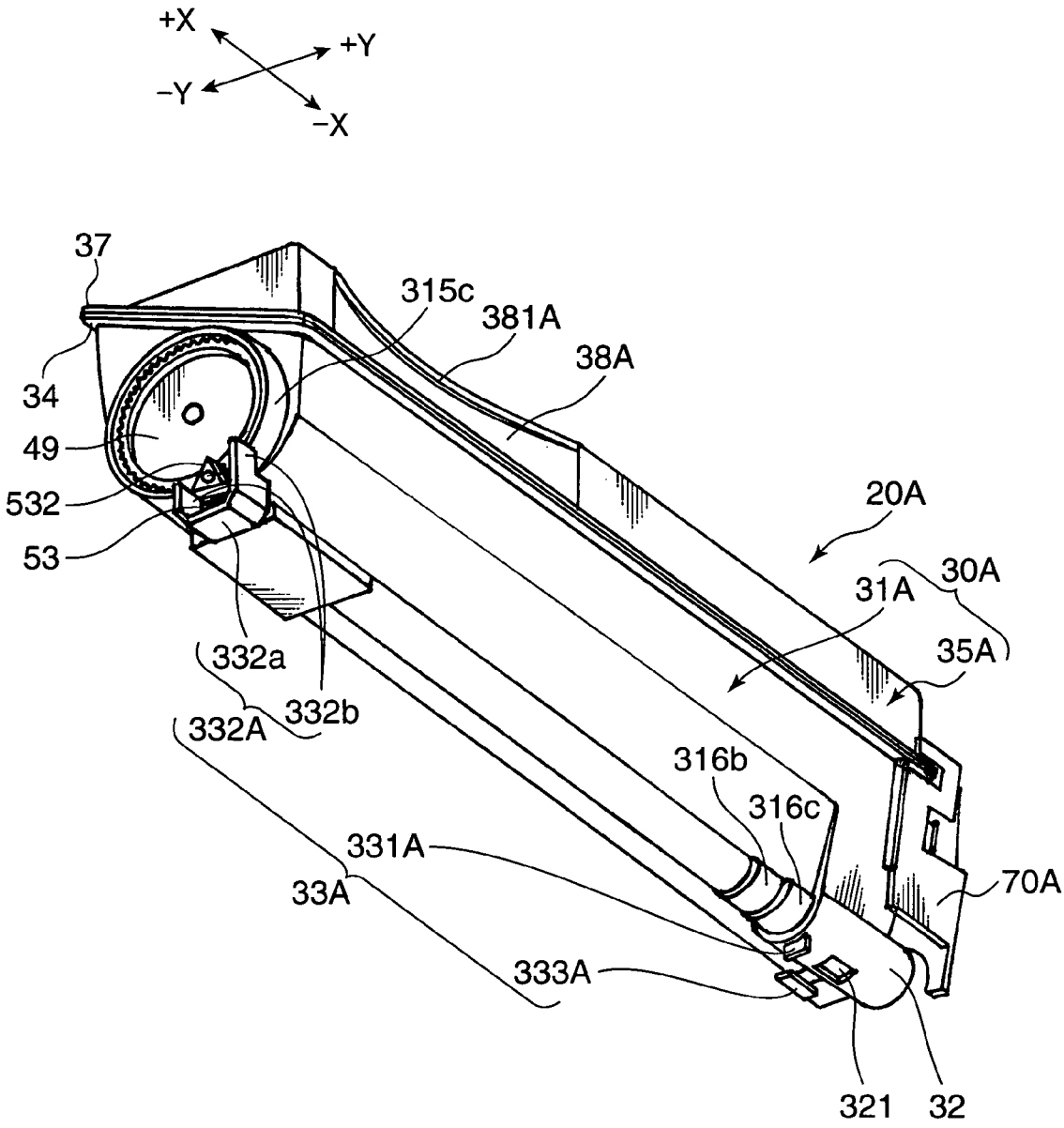
FIG. 21 is a perspective view of the toner container according to the second embodiment viewed from an obliquely downward rear direction.

FIG. 19 is a partially cut exploded perspective view illustrating a toner container 20A according to a second embodiment. FIG. 20 is a partially cut perspective view of the assembled toner container 20A viewed from an obliquely upward front direction; and FIG. 21 is a perspective view of the toner container 20A viewed from an obliquely downward rear direction, respectively. In those drawings, components identical to those of the toner container 20 according to the first embodiment are given the same reference numbers. For ease of the explanation, explanation will be omitted or simplified with respect to the identical components.

The toner container 20A includes: a container 30A for containing toner; an agitator 40A for agitating toner within the container 30A; a conveying member 50 for conveying the toner within the container 30A; a shutter cylinder 60A for switching over a supply and non-supply of the toner; and a covering cap 70A for covering the left portion 314. The container 30A comprises a container main body 31A and a cover 35A for closing an top surface opening of the container main body 31A.

The toner container 20A according to the second embodiment differs from the toner container 20 according to the first embodiment mainly in shapes of the container main body 31A and the cover 35A, a supporting structure of the agitator 40A, a locking method of the shutter cylinder 60A, and the like. Now, the toner container 20A will be described with a focus on these differences.

The container main body 31A includes: an arc-shaped bottom portion 311, a front side portion 312A, a rear side portion 313A, a left portion 314A, and a right portion 315. The rear side portion 313A has a height shorter than that of the front side portion 312A. Namely, a rising height of the rear side portion 313A from the arc-shaped bottom portion 311 is lower than that of the front side portion 312A. Therefore, the container main body 31A has such a structure that the top surface of the container main body declines downward in a rear direction.

An interior surface of the left portion 314A is provided with a U-shaped groove member 318 for supporting a center shaft 421A of the agitator 40A projecting therefrom. This U-shaped groove member 318 includes a pair of longitudinal ribs 318*a* extending in parallel with each other in a frontal direction and a bottom portion 318*b* bridged between bottom end portions of these pair of longitudinal ribs 318*a*. The agitator 40A has such a structure that a small diameter center shaft 421*b* of an end of the center shaft 421A is fit into a space between the pair of longitudinal ribs 318*a* of the U-shaped groove member 318 and supported by the bottom portion 318*b*, such that the left end of the agitator 40A comes to be installed into the container main body 31A.

Further, the left portion 314A is provided with the shutter installation cylinder 32 which projects to the right concentrically with a center of curvature of the recessed screw accommodation portion 316 for installing the shutter cylinder 60A.

Moreover, the supporting shaft 319 for receiving a below described locking member 266 is provided in a projecting manner immediately above the shutter installation cylinder 32 of the left portion 314A. The supporting shaft 319 is provided with a plurality of stoppers 319*a* projecting in a radial direction from a base portion of the supporting shaft. The locking member 266 is stopped by these stoppers 319*a* such that a fitting amount of the locking member into the supporting shaft 319.

A bottom of the container main body 31A is provided with supporting legs 33A for supporting the container 30A on the partition 18 (FIG. 2). The supporting legs 33A includes a left leg 331A projecting downward from a rear surface of the shutter installation cylinder 32, a right leg 332A provided on a lower right end of the arc-shaped bottom portion 311, and a positioning leg 333A projecting downward from a bottom end of the covering cap 70A provided at an inherent position of each of the containers 20M, 20C, 20Y, 29K.

The right leg 332A is so structured that a rear surface of the horizontal small portion 332*a* comes into contact with (namely, in flush with) the same flat surface of a bottom end of the left leg 331. To the contrary, the positions of the positioning legs 333A vary for the containers 20M, 20C, 20Y, 20K in the frontal direction. The partition 18 is provided with not shown recess portions for receiving the positioning legs 333 at positions corresponding to the positioning legs 333A of the containers 20M, 20C, 20Y, 20K.

Therefore, when each of the containers 20M, 20C, 20Y, 20K is placed at an appropriate position in the container accommodation chamber Q, the positioning leg 333A of each container is engaged with the corresponding recess portion. If the toner container 20A is installed into an incorrect position, the positioning leg 333A will not be engaged with the recess portion 181, and thus cannot be installed correctly. Accordingly, this enables the user to recognize the incorrect installation of the toner container 20A.

Now, the cover 35A closes the top surface opening of the container main body 31A and includes a cover main body 36A having an opening at its entire bottom surface and a cover side flange 37 projecting outwardly throughout the entire periphery of the cover main body from its bottom end. A rear side portion 362 of the cover main body 36A has a predetermined height, but the front side portion 363 of the cover main body has little height. Namely, the cover main body 36A has a general triangular shape in cross sectional view in the frontal direction. The rear side portion 362 has almost the same height as a gap between the rear side portion 313A and the front side portion 312A of the container main body 31A.

A rear surface of the cover main body 36A is provided with a strip-shaped press member 361 projecting downward from the left end of the cover main body. The press member 361 serves to press the top surface of the large diameter center shaft 421*a* of the agitator 40A by a bottom edge of the press member. As described above, the small diameter center shaft 421*b* of the center shaft 421 of the agitator 40A is engaged with and thereby supported by the U-shaped groove member 318. In this state, when the cover 35A is installed to the container main body 31A, a top surface of the large diameter center shaft 421*a* next to the small diameter center shaft 421*b* is pressed by the press member 361, thereby the shaft body 41A being locked. As a result thereof, the agitator 40A can be installed into the container main body 30A in a stable manner.

The cover main body 36A is provided with a concave handle 38A at an appropriate position (rightward position of the present embodiment) of the rear side portion 362A of the cover main body 36A. The concave handle 38A is formed such that the rear side portion 362 of the cover main body 36 is recessed forward into an arc-shape. In this embodiment, a concave handle 38A is set to a dimension operable to receive four fingers such as an index finger, a middle finger, a ring finger, and a little finger. For example, a length of the rear side portion 362 is set to about 10 mm. Accordingly, the user can stably hold the cover 35A. An upper edge of the concave handle 38A is provided with a hooking flange 381A.

Figure 22:
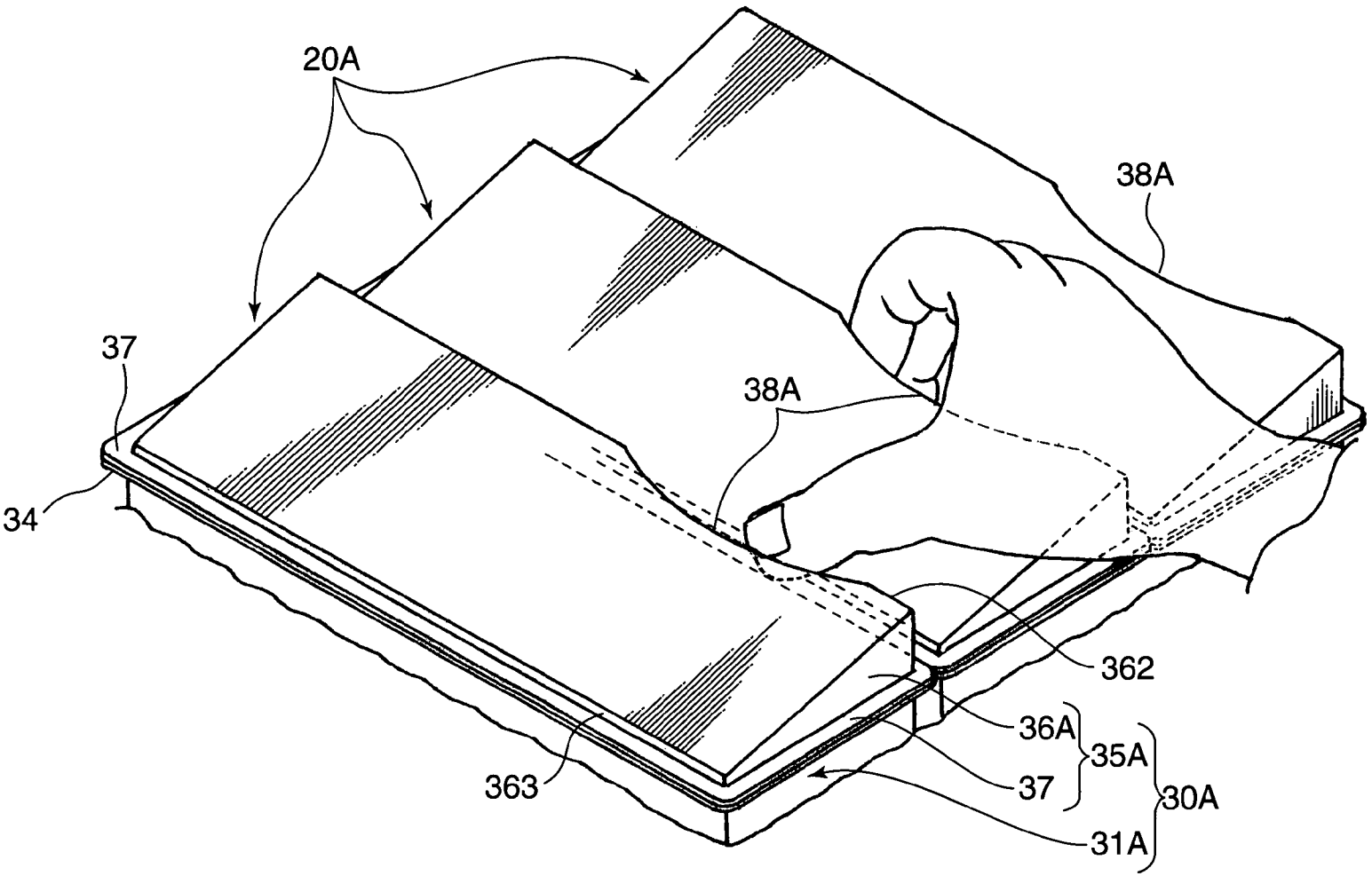
FIG. 22 is a view illustrating a state that a plurality of toner containers according to the second embodiment are mounted to the apparatus main body.

FIG. 22 is a perspective view illustrating a state that the toner container 20A is held by the user. FIG. 22 illustrates such a state that the flanges 34, 37 of each of the containers 30A are oriented to a horizontal direction and each container is installed in the container accommodation chamber Q. In the above state, since containers 30A are installed in the container accommodation chamber Q side by side, a side of the rear side portion 362 of the cover 35A is placed so as to project upward like a saw-tooth.

In other words, since the front side portion 363 of the next toner container 20A is positioned at the side of the rear side portion 362 of the toner container 20A, the user can easily place his index finger into the concave handle 38A. On the other hand, since concave handle 38A of the other adjacent toner container 20A resides at a side of the front side portion 363, the user can touch an upper end corner by his thumb with ease. Accordingly, the user can insert his four fingers such as an index finger, a middle finger, a ring finger and a little finger into the concave handle 38A projecting upward, place his thumb at the side of the front side portion 363 to hold the cover 35A, and then raise the toner container 20A, thereby picking up the toner container 20A from the container accommodation chamber Q of the printer 10 with ease.

The agitator 40A includes a shaft member 41A bridged between the U-shaped groove member 318 provided on the left portion 314A of the container main body 31A and the shaft supporting hole 315*a* formed in the right portion 315 of the container main body 31A, and the agitating blade 45 and the agitation gear 49 having the similar structures according to the first embodiment. The shaft member 41 includes a rectangular shaft 42A having a general square shape in cross sectional view and a plurality of blade support members 43A provided on the rectangular shaft 42A.

The rectangular shaft 42A has a center shaft 421A eccentric with the rectangular shaft 42A. The center shaft 421A comprises a large diameter center shaft 421*a* and a small diameter center shaft 421*b* projecting to the left from a leading end surface of the large diameter center shaft 421*a*. The small diameter center shaft 421*b* is set to have a diameter slightly smaller than a distance between a pair of longitudinal ribs 318*a* of the U-shaped groove member 318, such that the small diameter center shaft can be engaged with the groove between the longitudinal ribs 318*a*. On the other hand, the large diameter center shaft 421*a* cannot intrude into the groove since it has larger diameter than the distance between the longitudinal ribs 318*a*.

When the shaft member 41A is installed in the container main body 31A and the cover 35A is installed into the container main body 31A, the large diameter center shaft 421*a* resides at a position it comes into contact with a bottom edge of the press member 361. Therefore, the large diameter center shaft 421*a* is pressed by the press member 361 when the cover 35 is installed into the large diameter center shaft 421*a*. On the other hand, the small diameter center shaft 421*b* is rotationally supported by an arc-shaped bottom portion 318*b* of the U-shaped groove member 318.

In the above state, a bottom of the left small diameter center shaft 421*b* comes into contact with the bottom portion 318*b* and a top of the left small diameter center shaft comes into no contact. On the other hand, a top of the large diameter center shaft 421*a* comes into contact with a bottom of the press member 361 and the other portion of the large diameter center shaft comes into no contact. Therefore, if toner intrudes into a space between the small diameter center shaft 421*b* and the bottom portion 318*b*, or a space between the large diameter center shaft 421*a* and the press member 361 because of the rotation of the agitator 40A, the toner still can escape to upward or downward. Therefore, the toner is suppressed from clogging with or becoming cloggy onto those portions, thereby keeping the agitator 40A in a good rotation ability.

Figure 23A:
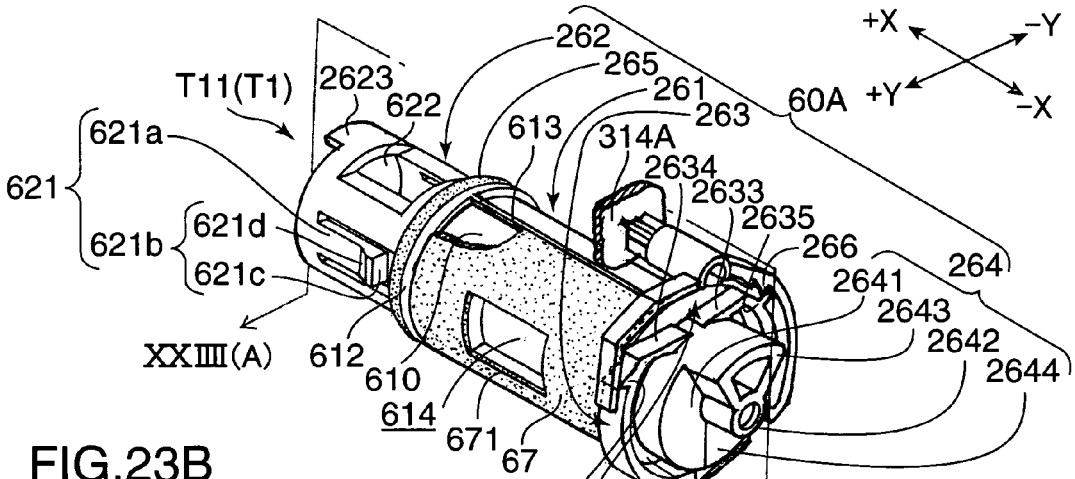
FIGS. 23A through 23C are perspective views illustrating a shutter cylinder to be mounted to the toner container according to the second embodiment.
Figure 23B:
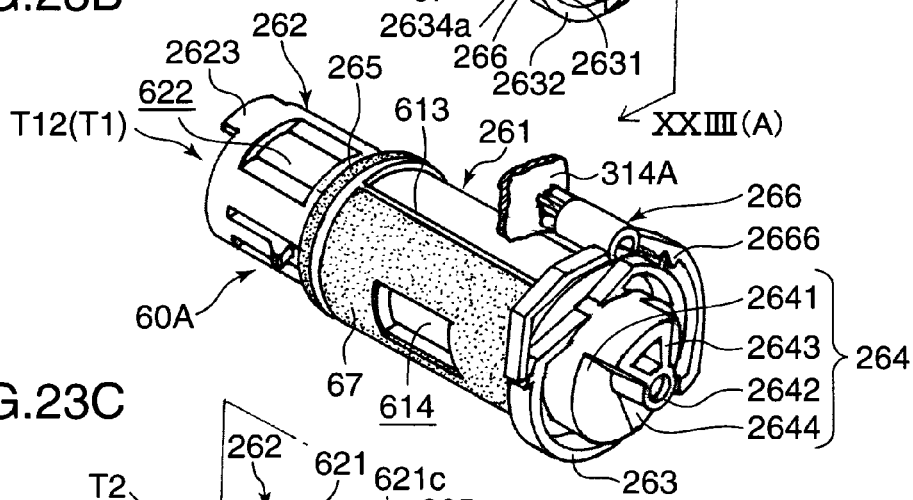
Figure 23C:
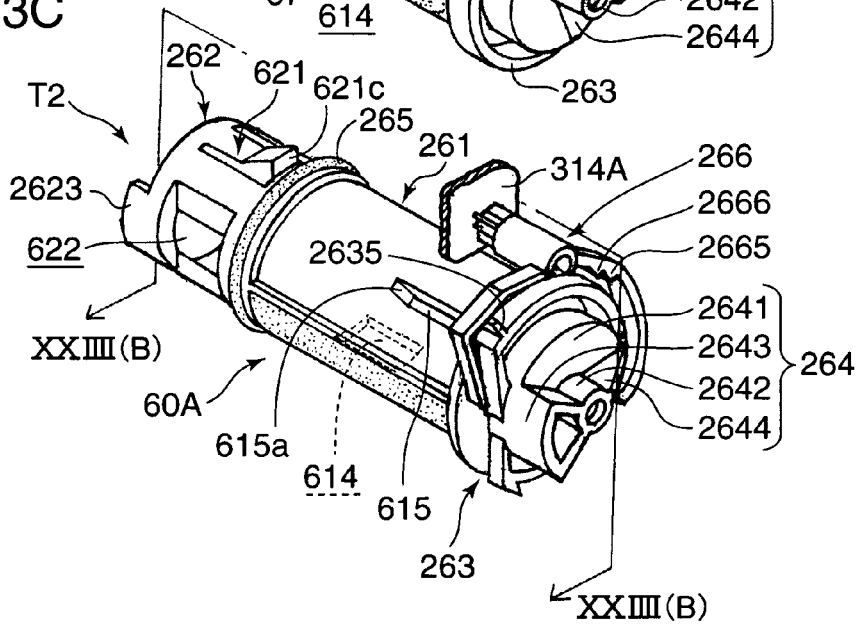
Figure 24A:
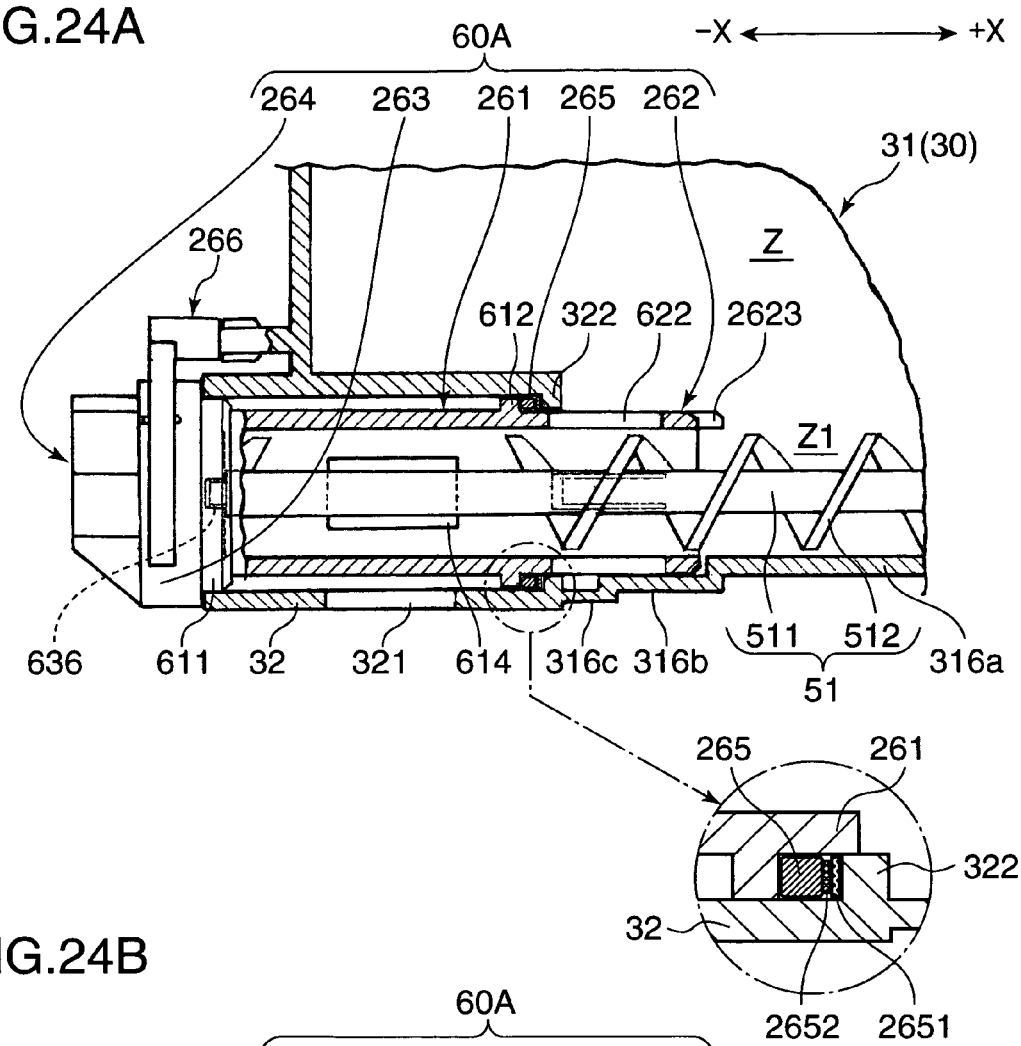
FIG. 24A is a cross sectional view of the shutter cylinder taken along line XXIIII(A)-XXIIII(A) in FIG. 23A.
Figure 24B:
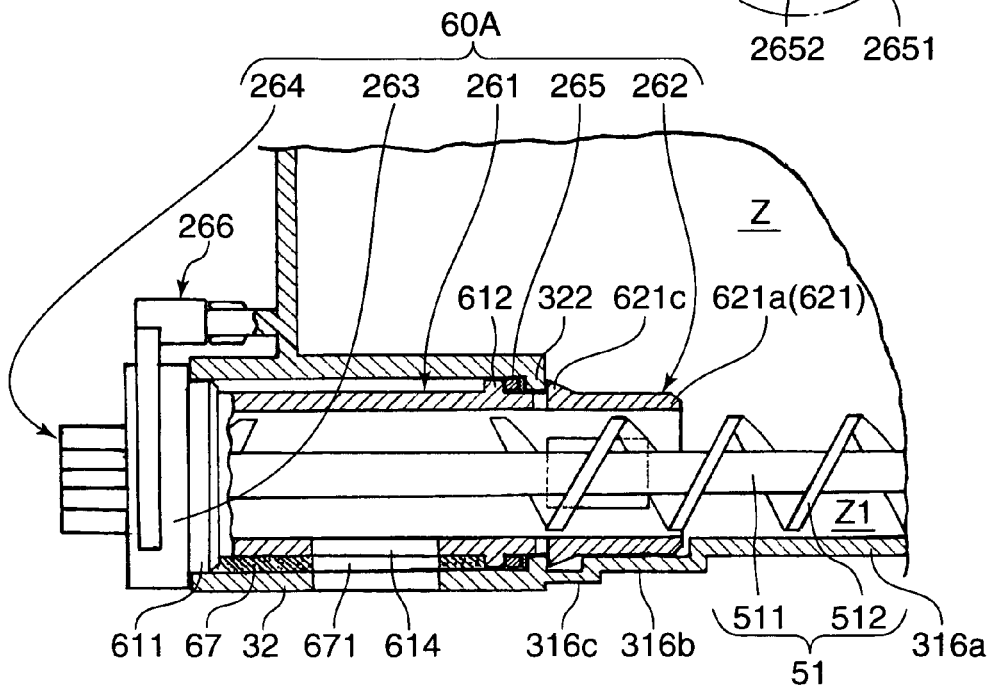
FIG. 24B is a cross sectional view of the shutter cylinder taken along line XXIIII(B)-XXIIII(B) in FIG. 23C.
Figure 25A:
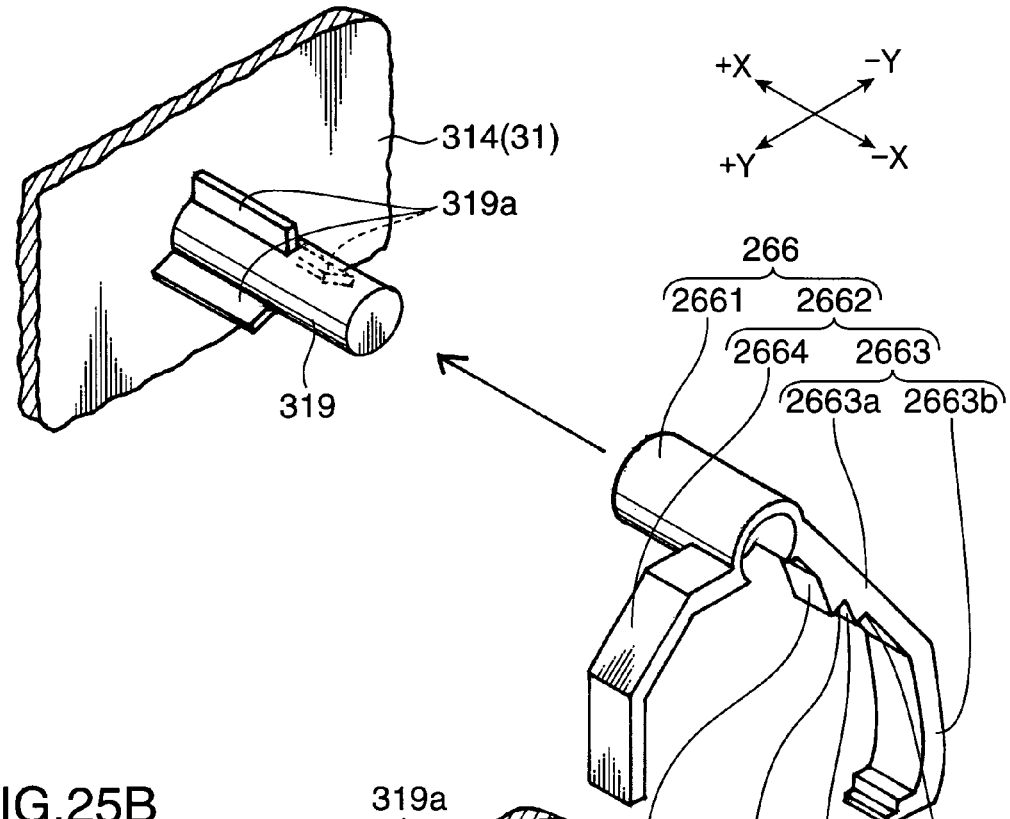
FIGS. 25A and 25B are enlarged perspective views illustrating a locking member.
Figure 25B:
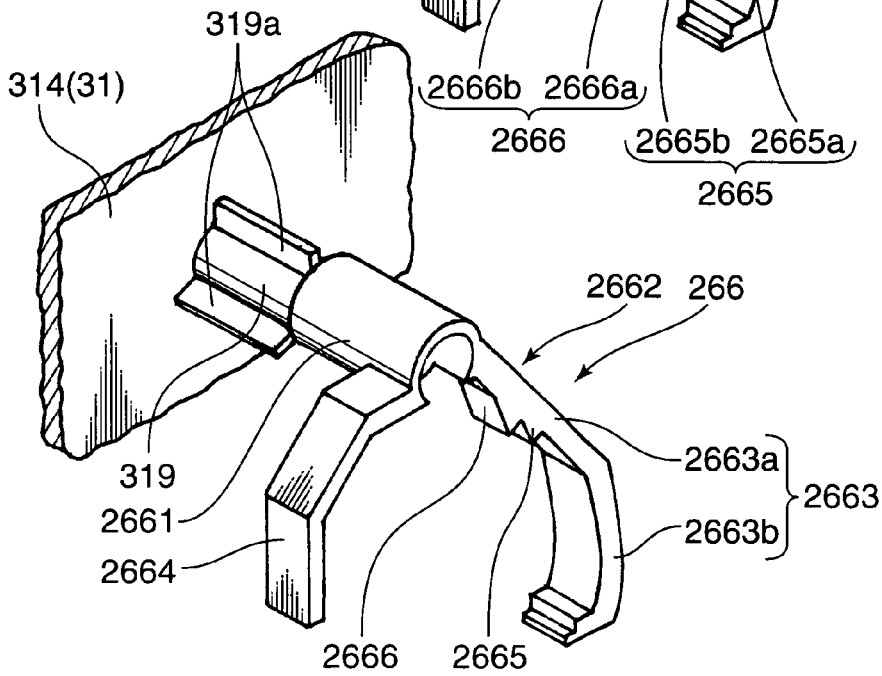
Figure 26A:
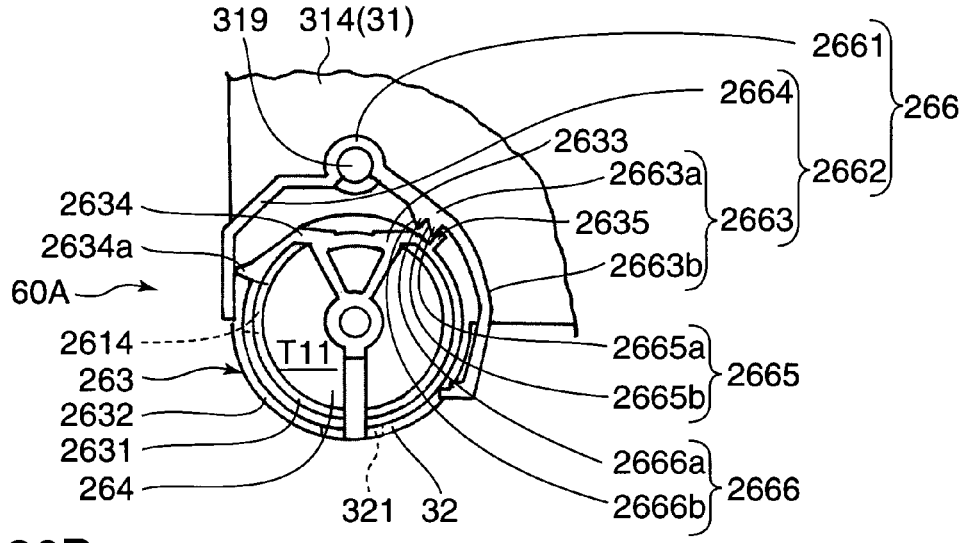
FIGS. 26A through 26C are explanatory diagrams for explaining an action of the locking member.
Figure 26B:
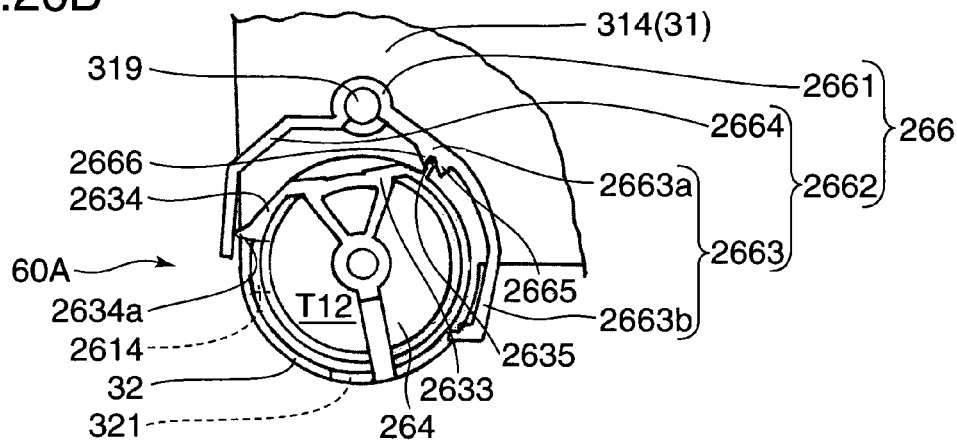
Figure 26C:
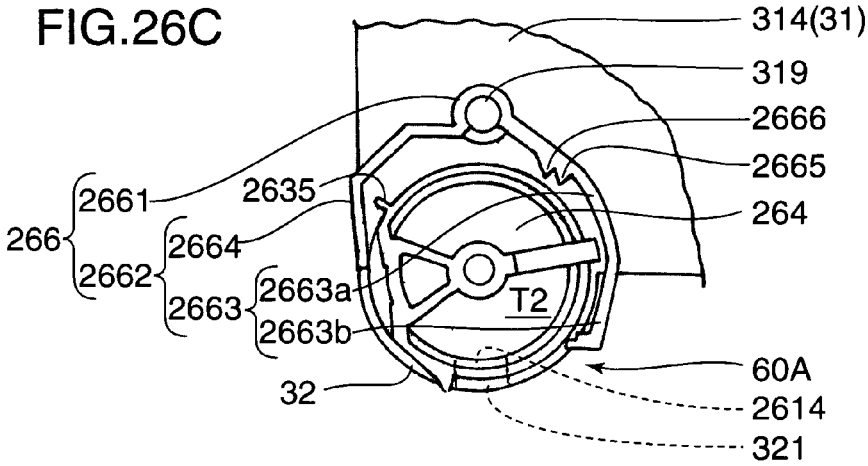

Now, a shutter cylinder 60A according to the second embodiment will be described below with reference to FIGS. 23A through 26C. FIGS. 23A through 23C are perspective views of the shutter cylinder 60A. FIG. 24A is a cross sectional view of the shutter cylinder taken along line XXIIII (A)-XXIIII(A) in FIG. 23A; and FIG. 24B is a cross sectional view of the shutter cylinder taken along line XXIIII(B)-XXIIII(B) in FIG. 23A, respectively. FIGS. 25A and 25B are enlarged perspective views illustrating an embodiment of the locking member. FIGS. 26A through 26C are explanatory diagrams for illustrating an action of the locking member. FIG. 26A illustrates that the shutter cylinder 60A is in a first closed position T11; FIG. 26B illustrates that the shutter cylinder 60A is in a second closed position T12; and FIG. 26C illustrates that the shutter cylinder is in the open position T2.

The shutter cylinder 60A has a general cylindrical body, and when it is installed into the shutter installation cylinder 32 to be rotated around the cylinder axis in a forward and backward direction, the shutter cylinder can change its position between the closed position T1 where the toner can not be charged and the open position T2 (reference position) where the toner can be charged toward the developing device 122. When the shutter cylinder 60A is engaged with the shutter installation cylinder 32, the left end of the screw shaft 511 of the toner conveyance screw 51 is supported by a shaft supporting hole 636 of the shutter cylinder 60A in a relatively rotational manner around the shaft axis.

The closed position T1 of the shutter cylinder 60A can be selectively set to the first closed position T11 where the shutter cylinder largely rotates or shifts from the reference position or the second closed position T12 where the shutter cylinder rotates or shifts less than the first closed position T11. When the shutter cylinder 60A is set to the closed position T1, the shutter cylinder is locked by the locking member 266, which will be described later, at the closed position T1 or T12 so as not to move toward the open position T2.

The first closed position T1 is a position the shutter cylinder 60A changes its position from the open position T2 as the reference position (FIG. 23C) to the position rotated therefrom by slightly larger than 90 degrees around the cylinder axis in a clockwise direction as shown in FIG. 23A. Also, the second closed position T12 is a position the shutter cylinder 60S changes its position from the open position T2 to the position rotated therefrom by approximately 90 degrees around the cylinder axis in the clockwise direction (FIG. 23B). The above stated phase shifts of the closed positions T11 and T12 are only examples, and thus the phase shift between the first closed position T11 and the second closed position T12 can be made slightly larger.

The shutter cylinder 60A includes a shutter cylinder body 261, a cylindrical retaining body 262, a circular closed portion 263, an operating portion 264, and a ring seal 265. The shutter cylinder body 261 has a cylindrical body to be inserted into the shutter installation cylinder 32 of the container main body 31A. The cylindrical retaining body 262 serves to retain the shutter cylindrical body 261 into the shutter installation cylinder 32, the shutter cylindrical body 261 extending to the right eccentrically from a leading end side (right end side) of the shutter cylindrical body 261. The circular closed portion 263 is provided at a base end side (left end side) of the shutter cylindrical body 261 and has a diameter larger than that of the shutter cylindrical body 261. The operating portion 264 projects to the left from a left end surface of the circular closed portion 263 to rotate the shutter cylindrical body 261. The ring seal 265 is an elastic sealing member engaged with a peripheral surface between the shutter cylindrical body 261 and the cylindrical retaining body 262.

The shutter cylinder 60A is provided with the locking member 266. The locking member 266 serves to lock the position of the shutter cylinder 60A (first closed position T1 and second closed position T12) and is provided immediately above the shutter installation cylinder 32 in the left portion 314A of the container main body 31A.

Since the shutter cylindrical body 261 and the cylindrical retaining body 262 are made of substantially the same member as the shutter cylindrical body 61 and the cylindrical retaining body 62 according to the first embodiment, explanation thereof will be omitted here. However, the cylindrical retaining body 262 is provided with an arc-shaped stopper 2623 which projects to the right from the right end of the cylindrical retaining body and has a diameter of curvature identical to that of the cylindrical retaining body 262. The arch-shaped stopper 2623 interferes with a predetermined position of the container main body 31 to prevent further rotation in the clockwise direction in FIG. 23A, while the shutter cylinder 60A is in the first closed position T11 of the closed position T1. Also, the arc-shaped stopper 2623 interferes with the other predetermined position of the container main body 31A to prevent further rotation in the counterclockwise direction in FIG. 23C when the shutter cylinder 60A is in the second closed position T2 (FIG. 23C).

The circular closed portion 263 serves to close a left end surface of the shutter cylindrical body 261. The circular closed portion 263 includes a closed disc 2631 and an annular body 2632. The closed disc 2631 is eccentric with a cylinder axis of the shutter cylindrical body 261, fixed integrally to the left end of the shutter cylindrical body 261, and has a disc-like body having a diameter larger than that of the shutter cylindrical body 261. The annular body 2632 is integrally formed throughout the peripheral surface of the closed disc 2631 while the closed disc 2631 projects to the left.

A center position of a right surface of the closed disc 2631 is recessed to form the shaft supporting hole 636 as shown in FIG. 24A. The shaft supporting hole 636 receives the left end of the screw shaft 511 in a rotational manner.

The annular body 2632 is provided with a forward wing portion 2633, a backward wing portion 2634, a retaining projection 2635, and a claw portion 2634*a*. The forward wing portion 2633 and the backward wing portion 2634 are formed into a plane shape by partially cutting the annular body 2632 and are placed in approximately horizontal direction when the shutter cylinder 60A is in the first closed position T11. The retaining projection 2635 is provided on the annular body 2632 so as to project outwardly in the radial direction of the annular body 2632 at a position shifted slightly in the clockwise direction from the forward strip portion 2633. The claw portion 2634*a* projects outward in a tangential direction of the annular body 2632 from a rear end side of the backward strip portion 2634.

The operation portion 264 serves to operate the shutter cylinder 60A to rotate it and projects to the left from the closed disc 2631 of the circular closed portion 263. The operating portion 264 includes: a disc 2641 projecting to the left eccentrically from the closed disc 2631; a cylindrical projection 2642 projecting eccentrically from a center position of the disc 2641; a fan-like operating projection 2643 having a fan-like shape viewed from −X direction and projecting outward in the radial direction from the cylindrical projection 2642; and a triangular operating portion 2644 projecting from an opposite side of the fan-like operating projection 2643 with respect to the cylindrical projection 2642, and having a triangular shape viewed from a side.

The cylindrical projection 2642, the fan-like operating projection 2643, and the triangular operating portion 2644 are provided with a not-shown holding cover having a shape suitable for the user to hold and operate them. The shutter cylinder 60A is actually operated for its rotational operation through the holding cover.

The fan-like operating projection 2643 turns upward as well as the triangular operating portion 2644 turns downward, when the shutter cylinder 60A is in the first closed position T11 of the closed position T1 (FIG. 23A). In this state, the operating portion 264 is rotated by a predetermined small angle in the counterclockwise direction around the cylinder axis, thereby placing the shutter cylinder in the second closed position T12 of the closed position T1 as shown in FIG. 23B. Further, the operating portion 264 is rotated by about 90 degrees, thereby changing the position of the shutter cylinder 60A having been in the closed position T1 to the open position T2 (FIG. 23C).

The ring seal 265 is a member corresponding to the ring seal 66 according to the first embodiment. However, according to the second embodiment, a washer 2651 is provided in order to decrease an operation torque of the operating portion 264 as shown by an enlarged view in a circle in FIG. 24A. The washer 2651 is an annular part made of resin film member of a good sliding property and is placed between the ring seal and the annular projection 322 of the shutter installation cylinder 32 to be bonded by a double-faced adhesive tape 2652 on a right surface of the ring seal 265.

Now, explanation will be given to the locking member 266 with reference to FIGS. 25A and 25B. FIG. 25A illustrates a state before the locking member 266 is engaged with the supporting shaft 319; and FIG. 25B illustrates a state that the locking member 266 is engaged with the supporting shaft 319, respectively. Directions represented by X and Y in FIGS. 25A and 25B are identical to those in FIG. 4, namely, X represents a widthwise direction (−X: leftward, +X: rightward) and Y represents a frontal direction (−Y: forward, +Y: backward).

The locking member 266 serves to lock the shutter cylinder 60A between the first closed position T11 and the second closed position T12 in the closed position T1 of the shutter cylinder 60A and is engaged with and thus supported by the supporting shaft 319 projecting from the left portion 314A of the container main body 31A. The supporting shaft 319 includes at a base end side thereof (right (+X) side) a plurality of stoppers 319*a* projecting in the radial direction. The locking member 266 having been engaged with the supporting shaft 319 is stopped by the stoppers 319*a* to thereby being positioned in the widthwise direction. The locking member 266 is prevented from being dropping off from the supporting shaft 319 by means of the covering cap 70A (FIG. 19) installed in the left surface side (−X side) of the container main body 31A.

The locking member 266 is elastically deformable, and includes a locking cylinder 2661 to be engaged with the supporting shaft 319 in a slidable manner, and a holding arm 2662 projecting downward from a left end of the locking cylinder 2661 so as to form a reverse U-shape. The holding arm 2662 is placed conforming to an outer periphery of the shutter cylinder 60A so as to enclose the annular body 2632 of the shutter cylinder 60A from the outside.

The holding arm 2662 comprises a locking arm 2663 projecting forward from the left end (−X side) of the locking cylinder 2661 and an additional arm 2664 projecting backward from the left end of the locking cylinder. Such a holding arm 2662 is formed into a general arc-shape along a circumferential direction of the shutter cylinder 60A (annular body 2632) and set to a diameter of curvature slightly larger than that of the annular body 2632. Accordingly, the holding arm 2662 can hold the annular body 2632.

The locking arm 2663 includes an inclined portion 2663*a* projecting to decline forward with a general 45 degrees from the locking cylinder 2661 and a trailing portion 2663*b* trailing from a bottom end of the inclined portion 2663*a*. A distance between the trailing portion 2663*b* and the additional arm 2664 is slightly shorter than an outer diameter of the annular body 2632. Therefore, the holding arm 2662 elastically deforms in a direction that the distance between the trailing portion 2663*a* and the additional arm 2664 become larger when it holds the annular body 2632.

A rear surface of the inclined portion 2663*a* of the locking arm 2663 includes a first engagement portion 2665 and a second engagement portion 2666 for engaging with the retaining projections 2635 provided on the circular closing portion 263 of the shutter cylinder 60A, respectively, in a manner projecting downward.

When the first engagement portion 2665 is engaged with the retaining projection 2635, the shutter cylinder 60A is set to the first closed position T11 to be locked by the engagement. Also, when the second engagement portion 2666 is engaged with the retaining projection 2635, the shutter cylinder 60A is set to the second closed position T12 to be locked by the engagement. The first engagement portion 2665 is provided next to and forward from the second engagement portion 2666 spaced with a predetermined distance in a circumferential direction of the annular body 2632.

The first engagement portion 2665 includes an orthogonal surface 2665*a* extending in the widthwise direction orthogonal to a rear surface of the inclined portion 2663*a* of the locking arm 2663, and an inclined surface 2665*b* inclined obliquely backward direction toward the inclined portion 2663*a* from an end of the orthogonal surface 2665*a*. The second engagement portion 2666 also includes an orthogonal surface 2666*a* and an inclined surface 2666*b*.

Therefore, the shutter cylinder 60A having been set to the open position T2 (FIG. 23C) is rotated in the clockwise direction around the cylinder axis, such that the retaining projection 2635 initially interferes with the inclined surface 2666*b* of the second engagement portion 2666. The locking arm 2663 is elastically deformed due to the interference and the retaining projection 2635 reaches the orthogonal surface 2666*a* getting over the inclined surface 2666*b*. Accordingly, the shutter cylinder 60A changes its position to the second closed position T12 (FIG. 23B) with the shutter cylinder locked.

When the shutter cylinder 60A is in the second closed position T12, if the shutter cylinder 60A is further rotated in the clockwise direction around the cylinder axis, the retaining projection 2635 interferes with the inclined surface of 2665*b* of the first engagement portion 2665. The locking arm 2663 is elastically deformed due to the interference, such that the retaining projection 2635 gets over the inclined surface 2665*b* to reach the orthogonal surface 2665*a*. Accordingly, the shutter cylinder 60A is set to the first closed position T11 (FIG. 23A) with the shutter cylinder locked.

In order to unlock the shutter cylinder 60A having been set to the first or the second closed position T11, T12, the user operates the locking arm 2663 so as to move apart from the annular body 2632. According to the elastic deformation of the locking arm 2663 caused by this operation, an engagement of the first or the second engagement portion 2665, 2666 is leased with respect to the retaining projection 2635, thereby unlocking the shutter cylinder 60A. The above described rotational locking operation and unlocking operation for the shutter cylinder 60A is performed such that the user rotationally operates a not-shown holding cover over the operating portion 264.

FIGS. 26A through 26C are explanatory diagrams for explaining actions of the locking member 266. FIG. 26A illustrates a state that the shutter cylinder 60A is set to the closed position T11; FIG. 26B illustrates a state that the shutter cylinder 60A is set to the second closed position T12; and FIG. 26C illustrates a state that the shutter cylinder 60A is set to the open position T2, respectively.

When the shutter cylinder 60A is in the first closed position T11, the retaining projection 2635 of the shutter cylinder 60A is stopped by the orthogonal surface 2665*a* of the first engagement portion 2665 provided on the locking arm 2663 of the locking member 266 as shown in FIG. 26A. Accordingly, the shutter cylinder 60A is locked with being set to the first closed position T11.

In the above state, the rotational amount of the shutter cylinder 60A around the cylinder axis in the clockwise direction become maximum, such that the toner discharge opening 614 of the shutter cylinder 60A comes to be at the most far position from the toner discharge opening 321 of the shutter installation cylinder 32. Also, the sealing area sealed by the sealing pad 67 around the toner discharge opening 614 (an area of the seal pad 67 residing between the toner discharge opening 614 and the toner discharge hole 321) is large. Therefore, a sealing property against the toner within the container 30A, namely, a sealing property for a root in which the toner may leak to the outside from the toner discharge hole 321 through a space between an outer peripheral surface of the cylindrical shutter body 261 and an inner peripheral surface of the shutter installation cylinder 32 can be improved.

Therefore, when the toner container 20A is transferred to a site where it is used after the toner is charged into the container main body 31A at a site of manufacturing the toner container 20A, the toner within the toner container 20A can be reliably prevented from leaking to the outside due to a vibration while the toner container is transferred only if the shutter cylinder 60A is set to the first closed position T11.

Then, when the toner container 20A is transferred to the site where it is used from the site where it was manufactured to be installed into a predetermined printer 10, the shutter cylinder 60A in the first closed position T11 is changed to the second closed position T12. Upon changing the position, the locking arm 2663 is rotated around the supporting shaft 319 in the counterclockwise direction. According to the elastic deformation of the locking arm 2663 by the above operation, a retaining condition of the first engagement portion 2665 with respect to the retaining projection 2635 is released, and therefore, the shutter cylinder 60A will be temporarily unlocked. Then, according to a rotational operation by the operating portion 264 in the counterclockwise direction, the retaining projection 2635 will be engaged with the second engagement portion 2666. Accordingly, the shutter cylinder 60A is set to the second closed position T12 as shown in FIG. 26B.

When the user exchanges the toner container of the printer 10, the user operates the operating portion 264 to have the shutter cylinder place in the open position T2 after a new toner container 20A is installed into the printer 10, as shown in FIG. 26C. Accordingly, the toner discharge opening 614 of the shutter cylinder 60A corresponds to the toner discharge hole 321 of the shutter installation cylinder 32 to place the shutter cylinder in a toner suppliable condition.

The rotational operation from the second closed position T12 to the open position T2 requires less rotational amount of the shutter cylinder 60A in comparison with the rotational operation from the first closed position T11 to the open position T2. Therefore, a rotation load occurs in the shutter cylinder 60A due to the sealing pad 67; however, a load of operation by the user can be decreased because of the less rotational amount, thereby improving the operation ability.

It may be preferable that, in order to decrease the rotational torque for rotating the shutter cylinder 60A, the sealing pad 67 is made into as small as possible (for example, the sealing pad 67 is made into such a size that the sealing pad would not close the toner discharge hole 321 when the shutter cylinder is in the closed position T1), or corners of the sealing pad 67 are chamfered.

In the examples as illustrated in FIGS. 26A through 26C, when the shutter cylinder 60A is in the closed position T1 (the first or the second closed position T11, T12), a claw portion 2634*a* of the annular body 2632 presses the additional arm 2664 of the locking member 266 outward in the radial direction. Therefore, the locking member 266 is applied with a force moving in the clockwise direction around the supporting shaft 319. Consequently, the first and the second engagement portions 2665, 2666 can obtain better retaining condition with respect to the retaining projections 2635, resulting in providing more stable locking condition to the shutter cylinder 60A.

As described above, in the toner container 20A according to the second embodiment, the shutter cylinder 60A is shiftable between a reference position (open position T2) in which the toner discharge opening 614 faces the toner discharge hole 321 owing to the fact that the shutter cylinder rotates around the cylinder axis and the closed position T1 in which the peripheral wall of the shutter cylinder closes the toner discharge hole 321.

There is provided a locking member 266 which can lock the closed position of the shutter cylinder 60A and can unlock the closed position of the shutter cylinder. The locking member 266 can selectively lock the shutter cylinder 60A at a position between the first closed position T11 having been largely rotated from the reference position (open position T2) and the second closed position T12 having been less rotated than the first closed position T11.

Therefore, in a case where the sealing property against toner has a priority, for example, where the toner container 20A is delivered, if the first closed position T11 is selected to lock the rotation of the shutter cylinder 60A, the toner can be more reliably prevented from leaking through the toner discharge opening. On the other hand, in a case where the operating performance of the shutter cylinder 60A has a priority, for example, where the toner container 20A is used, if the second closed position T12 is selected to lock the rotation of the shutter cylinder 60A, the operation for rotating the shutter cylinder 60A to the open position T2 can be performed with ease.

The first and the second embodiments of the present invention have been described above; however, the present invention is not limited to the above embodiments but may include the following modification.

In the above embodiment, as an example, the color printer 10 is described as the image forming apparatus to which the toner container 20 is to be provided. However, the printer 10 may be a monochrome printer. Also, the image forming apparatus is not limited to a printer but may be a copying machine or a facsimile machine.

In the above embodiment, as an example, the manual operation of the operation lever 642 is described. Instead of manual operation, a structure may be employed such that a guiding member for guiding rotational operation of the operation lever 642 is placed at the container accommodation chamber Q side and the operation lever 642 is guided by the guiding member to change its position automatically from the closed position T1 to the open position T2 when the shutter cylinder 60 is inserted into the container accommodation chamber Q. The operation lever 642 is guided in the opposite direction by the guiding member to automatically change its position from the open position T2 to the closed position T1 when the shutter cylinder 60 is taken out of the container accommodation chamber Q. Thus, the necessity of manual operation of the operation lever 642 is eliminated and ease of attachment and detachment of the toner container 20 to and from the apparatus main body 11 is improved.

In the above embodiment, a cap having a shape more suitable for manual operation of the operation lever 642 may be provided to allow easy manual operation of the operation lever 642.

In the above embodiment, the shutter cylinder 60 inserted into the shutter installation cylinder 32 is prevented from dropping off because the engaging claw 621*b* contacts and is stopped by the annular projection 322 of the shutter installation cylinder 32. Instead of this structure, an edge surface of the circular closure 63 of the shutter cylinder 60 may be covered by the covering cap 70, thereby preventing the shutter cylinder 60 from dropping off. Accordingly, the necessity of providing the cylindrical retaining body 62 with the engaging claw 621 and the spill holes 622 is eliminated, and thus the shutter cylinder 60 can be made shorter. In this case, an opening on a right surface of the shutter cylinder body 61 of the shutter cylinder 60 serves as a spill hole releasing the toner.

In the above embodiment, an example is illustrated where the concave handle 38 is provided on the cover 35 on the driving force convey side of the toner container 20 where the conveyance gear 53 is provided. However, the concave handle 38 may be provided on the shutter side where the shutter cylinder 60 is provided, or alternatively at a center of a longitudinal direction thereof.

In the above embodiment, an example is illustrated wherein the two spill holes 622 are provided in the cylinder retaining body 62 of the shutter cylinder 60 in a radial direction opposing each other. However, the number of spill holes 622 may be one or may be three or more.

In the above embodiment, an example is illustrated wherein the handle is formed into a concave shape on the cover 35; however, the handle may be formed into a convex shape extending from the cover 35.

In the above embodiment, since the toner container 20 is attached to and detached from the apparatus main body 11, the concave handle 38 is provided on the cover 35 of the container 30 for this attachment and detachment operation. However, if the toner container 20 is attached to and detached from a side of the apparatus main body 11, the concave handle 38 may be provided on a side of the container main body 31 of the container 30.

In the above embodiment, three supporting legs 33 are illustrated; however, the number of supporting legs 33 may be equal to or more than four or may be less than three. If the number of the supporting legs 33 is less than three, a supporting portion such as a supporting projection for supporting a bottom portion of the container 30, in particular the arc-like bottom portion 311 of the above embodiment, should be provided at a side of the partition 18 of the apparatus main body 11.

In the above embodiment, the joint cross 42 is employed as the agitating shaft for supporting the agitating blade 45 on the agitator 40; however, it may be replaced with a normal cylinder axis or a square shaft having a square shape in its cross sectional view.

In the above embodiment, only one agitating blade 45 is mounted to the joint cross 42 of the agitator 40; however, a plurality of agitating blades 45 may be mounted to the joint cross 42.

The above described specific embodiments mainly include the invention having the below described structure.

A toner container according to an aspect of the present invention is a toner container for replenishing toner to a developing device, comprises:

a container for containing toner, and having a toner discharge hole;

a toner conveyance screw for conveying the toner within the container toward the toner discharge hole; and a shutter cylinder including a peripheral wall formed with a toner discharge opening at a position corresponding to the toner discharge hole;

wherein one end of the toner conveyance screw is supported by a bearing within the shutter cylinder; and the shutter cylinder is mounted to a side wall of the container in a rotation free manner.

With the above described structure, when the shutter cylinder is rotated around the cylinder axis in order to place the toner discharge opening in a position corresponding to the toner discharge hole of the container and then the toner conveyance screw is driven, the toner within the container is conveyed by the toner conveyance screw to reach the toner discharge opening, resulting in that the developing device is replenished with the toner through the toner discharge opening and the toner discharge hole of the container.

Here, one end of the toner conveyance screw is supported by the bearing in the shutter cylinder and the shutter cylinder is mounted to the side wall of the container in a rotation free manner. Therefore, it becomes possible to place the toner conveyance screw throughout an entire length of the container and thus all of the toner can be pushed away from the container without causing a blind spot in the container.

Also, because the shutter cylinder is mounted to the side wall of the container in a rotation free manner, the toner conveyance screw can be rotatably supported by side walls of container which are opposed to each other. Accordingly, the toner conveyance screw can be rotatably supported in a satisfactory stable manner.

Further, because the shutter cylinder is mounted to the side wall of the container in a rotation free manner, an assembling operation will be improved. In other words, after the toner conveyance screw is mounted into the container through a predetermined mounting hole formed in the side wall, the shutter cylinder is inserted into the mounting hole to have the bearing provided on the shutter cylinder support the one end of the toner conveyance screw, such that the toner conveyance screw and the shutter cylinder can be assembled with respect to the container with ease.

In the above structure, it may be preferable that the shutter cylinder includes a ring seal on the outer periphery of the shutter cylinder. With such a structure, the ring seal prevents the toner within the container from leaking to the outside through the peripheral surface of the shutter cylinder. Also, in comparison with a sealing method in which an area seal is provided on an end of the shutter cylinder, more reliable sealing effect can be produced.

In the above structure, it may be preferable that the side wall of the container is provided with a cylindrical receiving portion having the toner discharge hole, and the shutter cylinder is inserted into the cylindrical receiving portion.

With the above described structure, since the shutter cylinder is inserted into the cylindrical receiving portion in a rotation free manner, the shutter cylinder can be installed onto the side wall of the container in a stable manner in comparison with a case where the shutter cylinder is supported only with holes in the side walls of the container.

It may be preferable to further provide the above structure with a ring seal provided on the outer periphery of the shutter cylinder and a washer to be disposed on the side surface of the ring seal corresponding to a part of the cylindrical receiving portion.

According to the above described structure, since the washer is disposed between the cylindrical receiving portion and the ring seal, an operation torque of the shutter cylinder can be reduced to improve the operability.

It may be preferable that the shutter cylinder is provided with an engaging claw, and the container is provided with an engagement portion engageable with the engaging claw when the shutter cylinder is inserted into the cylindrical receiving portion.

According to the above described structure, the shutter cylinder is inserted into the cylindrical receiving portion and the engaging claw of the shutter cylinder engages with the engagement portion formed in the cylindrical receiving portion. Accordingly, the shutter cylinder can be reliably placed in the cylindrical receiving portion.

It may be preferable to further provide the above described structure with a first engagement portion for regulating a movement of the shutter cylinder in an axial direction and a second engagement portion for regulating a rotation of the shutter cylinder around the shaft axis so as not to beyond the predetermined rotational range.

According to the above described structure, the shutter cylinder is inserted into the cylindrical receiving portion, and the engaging claw of the shutter cylinder is engaged with the first engagement portion of the cylindrical receiving portion. Therefore, the shutter cylinder is prevented from dropping off from the cylindrical receiving portion. Also, since the rotation of the shutter cylinder is regulated within the rotational range because of the interference between the engaging claw and the second engagement portion with the shutter cylinder installed into the cylindrical receiving portion, the shutter cylinder is prevented from rotating beyond the required rotational range.

In the above described structure, it may be preferable that the shutter cylinder includes a reduced diameter portion which is formed such that the diameter of the peripheral portion of the toner discharge hole is reduced and the reduced diameter portion is provided with a seal pad.

According to the above structure, a sealing property can be ensured in the vicinity of the toner discharge opening owing to the seal pad. Therefore, when the toner within the container is charged with the developing device through the toner discharge opening of the shutter cylinder and the toner discharge hole of the container, the sealing effect of the seal pad prevents the toner from leaking to the outside through the space between the shutter cylinder and the side wall of the container.

In the above described structure, it may be preferable that the shutter cylinder is integrally provided with a locking member for locking the shutter cylinder from rotating.

According to the above structure, since the locking member for preventing the rotation of the shutter cylinder is integrally provided on the shutter cylinder, the number of parts can be decreased.

In the above described structure, it may be preferable that the shutter cylinder includes a flange operable to come into slide contact with the side wall of the container and a guide rib extending downward in the installation direction of the flange to the side wall of the shutter cylinder.

With the above described structure, when the shutter cylinder is installed onto the side wall of the container, the shutter cylinder is guided by the guide rib extending downward in the installation direction to the side wall while the shutter cylinder is inserted into the side wall. Therefore, the flange will not interfere with the side wall to thereby ease the installing operation of the shutter cylinder. As such, the workability in assembling the shutter cylinder is remarkably improved.

In the above structure, it may be preferable that the peripheral wall of the shutter cylinder that is upstream of the toner discharge opening in the toner conveyance direction is formed with a spill hole through which the toner having been conveyed to the shutter cylinder by driving the toner conveyance screw is spilled out into the container.

According to the above described structure, a portion of the toner having been conveyed to the shutter cylinder by driving the toner conveyance screw is spilled out through the spill hole. Therefore, even if the toner is compressed into the shutter cylinder by the toner conveyance screw, the toner is suppressed from becoming a clot near the inlet of the shutter cylinder. Therefore, such a problem will not occur that the toner clot closes the toner discharge opening and thus the toner can be consistently replenished into the developing device over a long time period.

In this case, it may be preferable that the shutter cylinder is provided at a toner inlet side thereof with a leading end cylinder portion having the engaging claw for retaining the container owing to an elastic deformation of a part thereof, and the spill hole is formed in the leading end cylinder portion.

According to the above described structure, the leading end cylinder provided at the inlet side of the shutter cylinder also serves as a portion to be formed with the spill hole and as a portion to be provided with the engaging claw which installs the shutter cylinder onto the side wall of the container. Therefore, a simple structure and thus downsizing of the shutter cylinder can be achieved.

In the above described structure, it may be preferable that: the toner conveyance screw includes a screw shaft and a spiral blade provided on the screw shaft; the screw shaft is rotatably supported by a bearing in the shutter cylinder; and the spiral blade extends to a position just before the toner discharge opening on the screw shaft inserted into the shutter cylinder.

According to the above structure, the toner can be reliably conveyed to the toner discharge opening and also the toner can be smoothly pushed away since there is no spiral blade near the toner discharge opening.

In this case, it may be preferable that a reverse spiral blade of a spiral shape extending in the opposite direction to a spiral direction of the spiral blade is provided at a position beyond the toner discharge opening on the screw shaft.

According to the above described structure, a portion of the toner having conveyed to the shutter cylinder, which has not been pushed away from the toner discharge opening but having been headed to a deeper side of the shutter cinder, is approached to the toner discharge opening by the rotation of the reverse spiral blade. Therefore, the toner can be discharged more smoothly through the toner discharge opening.

It may be preferable that the above described structure further includes: a locking member operable to lock the rotation of the shutter cylinder and unlock the locking condition of the shutter cylinder; in which the shutter cylinder rotates in such a manner that the shutter cylinder can change its position between a reference position where the toner discharge opening faces the toner discharge hole and a closed position where the toner discharge hole is closed by shifting off the toner discharge opening from the position of the toner discharge hole to close the toner discharge hole by the peripheral wall of the shutter cylinder; and the locking member is operable to selectively lock the shutter cylinder at either a first position rotated or shifted largely from the reference position or a second position rotated or shifted less than the first position.

According to the above described structure, the shutter cylinder is locked at the first closed position when, for example, the toner container is transferred from a site where the toner container is manufactured to a site where the toner container is used, namely, when a high sealing effect is required against the toner leakage since a large movement of the toner container is prospected. Accordingly, the toner discharge opening of the shutter cylinder comes to far away from the toner discharge hole of the container, thereby achieving a more reliable prevention of the toner leakage. On the other hand, when the toner container is installed in the developing device and when an excellent operability is required, the shutter cylinder is locked at the second closed position. In this case, since it requires only a small rotational amount from the reference position, the position can be switched more rapidly.

In the above described structure, it may be preferable that: the shutter cylinder is provided with a retaining projection projecting outwardly from the peripheral surface of the shutter cylinder in the radial direction; the locking member includes a locking arm which is provided at a container side so as to securely lock the shutter cylinder with a help of an engagement with the retaining projection; and the locking arm is elastically deformable, and includes a first engaging claw and a second engaging claw corresponding to the first closed position and the second closed position respectively.

According to the above described structure, the shutter cylinder is set to the first closed position because the retaining projection is engaged with the first engagement portion while it is set to the second closed position because the retaining projection is engaged with the second engaging claw. A position change operation between the reference position and the closed position (namely, an opening and closing operation of the toner discharge opening) will be carried out by elastically deforming the locking arm. Therefore, the toner discharge opening can be closed in two stages with a simple structure.

In this case, the locking arm includes a general arc-shaped member and is disposed along the outer periphery of the shutter cylinder; and the first engaging claw and the second engaging claw are provided on an interior surface of the locking arm while they are spaced apart to each other in an arc direction. According to the structure, the locking arm can be made into more simple shape.

It may be preferable that the above structure further includes a seal pad for preventing the toner from leakage, and an area of the seal pad residing between the toner discharge opening and the toner discharge hole when the locking arm is in the second closed position is smaller than an area of the seal pad residing between the toner discharge opening and the toner discharge hole when the locking arm is in the first closed position.

In the case where the seal pad is attached to the peripheral portion of the toner discharge opening, the seal pad tends to apply a rotational load to the shutter cylinder. According to the above described structure, a good sealing effect can be produced by making the area of the seal pad between the toner discharge opening and the toner discharge hole relatively large when the shutter cylinder is in the first closed position, whereas a user operation load can be reduced by decreasing the rotational operation involving the rotation load even if the sealing effect would be somewhat lowered when the shutter cylinder is in the second closed position.

A developer replenishing device according to another aspect of the present invention is adapted for replenishing a developing device with developer, comprises: a container for containing developer, and having a developer discharge hole; a developer conveyance member having a rotational shaft for conveying the developer within the container to the developer discharge hole; and a shutter cylinder including a peripheral wall formed with a developer discharge opening at a position corresponding to the developer discharge hole. One end of the rotational shaft of the developer conveyance member is supported by a bearing in the shutter cylinder. The shutter cylinder is mounted to a side surface of the container in a rotation free manner.

It may be preferable that, in the above structure, the peripheral wall of the shutter cylinder that is upstream of the developer discharge opening in the developer conveyance direction is formed with a spill hole for spilling the developer having been conveyed into the shutter cylinder by driving the developer conveyance member out into the container.

It may be preferable that the above structure further includes a locking member operable to lock the rotation of the shutter cylinder and unlock the locking condition of the shutter cylinder, and the shutter cylinder can rotate between the reference position where the developer discharge opening faces the developer discharge hole and the closed position where the developer discharge hole is closed by the peripheral wall of the shutter cylinder by the shifting off of the developer discharge opening from the developer discharge opening, and the locking member is operable to selectively lock the shutter cylinder at either a first closed position where the shutter cylinder largely rotates from the reference position or a second closed position where the shutter cylinder rotates less than the first closed position.

This application is based on patent application Nos. 2007-006340 and 2007-006344 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A toner container for replenishing a developing device with toner, comprising:

a container for containing toner, and having a toner discharge hole;

a toner conveyance screw for conveying the toner within the container to the toner discharge hole; and a shutter cylinder including a peripheral wall formed with a toner discharge opening at a position corresponding to the toner discharge hole;

a cylindrical receiving portion provided on a side wall of the container and formed with the toner discharge hole, the cylindrical receiving portion for receiving the shutter cylinder in a rotation free manner;

wherein one end of the toner conveyance screw is supported by a bearing in the shutter cylinder;

the shutter cylinder is mounted to the side wall of the container in a rotation free manner;

a portion of the peripheral wall of the shutter cylinder that is upstream of the toner discharge opening in a toner conveyance direction is formed with a spill hole for spilling out into the container the toner that has been conveyed into the shutter cylinder by driving the toner conveyance screw;

the shutter cylinder is provided with an engaging claw; and the container is provided with an engagement portion engageable with the engaging claw when the shutter cylinder is inserted into the cylindrical receiving portion.

2. The toner container according to claim 1, further comprising a ring seal provided on an outer periphery of the shutter cylinder.

3. The toner container according to claim 1, wherein the engagement portion comprises:

a first engagement portion for regulating a movement of the shutter cylinder in an axial direction; and a second engagement portion for regulating a rotation of the shutter cylinder in the axial direction beyond a predetermined rotational range.

4. The toner container according to claim 1, further comprising a seal pad for preventing the toner from leaking, wherein:

the shutter cylinder includes a reduced diameter portion formed by reducing a diameter of a peripheral portion of the toner discharge opening; and the seal pad is attached to the reduced diameter portion.

5. The toner container according to claim 1, further comprising a locking member provided integrally with the shutter cylinder for locking the shutter cylinder from rotating.

6. The toner container according to claim 1, wherein the shutter cylinder comprises:

a flange operable to come into slide contact with the side wall of the container; and a guide rib extending downward from the flange in an installation direction into the side wall of the shutter cylinder.

7. The toner container according to claim 1, wherein:

the shutter cylinder is provided at a toner inlet side thereof with a leading end cylinder portion having an engaging claw for retaining the container owing to an elastic deformation of a part thereof; and the spill hole is formed in the leading end cylinder portion.

8. The toner container according to claim 1, wherein the toner conveyance screw includes a screw shaft and a spiral blade provided on the screw shaft, the screw shaft being rotatably supported by the bearing within the shutter cylinder; and the spiral blade extends to a position just before the toner discharge opening on the screw shaft inserted into the shutter cylinder.

9. The toner container according to claim 8, wherein a reverse spiral blade having a spiral shape extending in the opposite direction to a spiral direction of the spiral blade is provided at a position beyond the toner discharge opening on the screw shaft.

10. The toner container according to claim 1, further comprising a locking member operable to lock a rotation of the shutter cylinder and unlock the locking condition of the shutter cylinder, wherein:

the shutter cylinder is rotatable between a reference position where the toner discharge opening faces the toner discharge hole and a closed position where the toner discharge hole is closed by the peripheral wall of the shutter cylinder by shifting off of the toner discharge opening from the toner discharge hole; and the locking member is operable to selectively lock the shutter cylinder at either a first closed position shifted greatly from the reference position or a second closed position shifted less than the first closed position.

11. The toner container according to claim 10, wherein:

the shutter cylinder is provided with a retaining projection projecting outwardly from the peripheral wall of the shutter cylinder in a radial direction;

the locking member includes a locking arm which is provided on a side of the container and engaged with the retaining projection to securely lock the shutter cylinder;

and the locking arm is elastically deformable, and includes a first engaging claw and a second engaging claw corresponding to the first closed position and the second closed position respectively.

12. The toner container according to claim 11, wherein:

the locking arm including a general arc-shaped member is arranged along an outer periphery of the shutter cylinder; and the first engaging claw and the second engaging claw project from an interior surface of the locking arm with a predetermined distance therebetween in an arc direction.

13. The toner container according to claim 11, further comprising a seal pad for keeping the toner from leaking, wherein:

an area of the seal pad residing between the toner discharge opening and the toner discharge hole when the locking arm is in the second closed position is smaller than an area of the seal pad residing between the toner discharge opening and the toner discharge hole when the locking arm is in the first closed position.

14. The toner container according to claim 1, further comprising:

a ring seal arranged along an outer periphery of the shutter cylinder; and a washer placed on a side surface of the ring seal opposing to a part of the cylindrical receiving portion.

15. A developer replenishing device for replenishing a developing device with developer, comprising:

a container for containing the developer, and having a developer discharge hole;

a developer conveyance member including a rotational shaft for conveying the developer within the container to the developer discharge hole; and a shutter cylinder including a peripheral wall formed with a developer discharge opening at a position corresponding to the developer discharge hole;

a cylindrical receiving portion provided on a side wall of the container and formed with the toner discharge hole, the cylindrical receiving portion for receiving the shutter cylinder in a rotation free manner;

wherein one end of the rotational shaft of the developer conveyance member is supported by a bearing within the shutter cylinder;

the shutter cylinder is mounted to the side wall of the container in a rotation free manner;

a portion of the peripheral wall of the shutter cylinder that is upstream of the toner discharge opening in a toner conveyance direction is formed with a spill hole for spilling out into the container the toner having been conveyed into the shutter cylinder by driving the toner conveyance screw;

the shutter cylinder is provided with an engaging claw; and the container is provided with an engagement portion engageable with the engaging claw when the shutter cylinder is inserted into the cylindrical receiving portion.

16. The developer replenishing device according to claim 15, further comprising a locking member operable to lock a rotation of the shutter cylinder and unlock the locked condition of the shutter cylinder, wherein:

the shutter cylinder is rotatable between a reference position where the developer discharge opening faces the developer discharge hole and a closed position where the peripheral wall of the shutter cylinder closes the developer discharge hole by shifting off of the developer discharge opening from the developer discharge hole; and the locking member is operable to selectively lock the shutter cylinder at either the first closed position shifted greatly from the reference position or the second closed position shifted less than the first closed position.

* * * * *